US010401746B2

(12) United States Patent
Watariguchi et al.

(10) Patent No.: US 10,401,746 B2
(45) Date of Patent: Sep. 3, 2019

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Kaname Watariguchi, Yokohama (JP); Shoma Hinata, Tokyo (JP); Kazuko Araki, Tokyo (JP); Tsutomu Nishida, Mishima (JP); Jumpei Kuno, Yokohama (JP); Masataka Kawahara, Mishima (JP); Yuto Ito, Koganei (JP); Isao Kawata, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/961,756

(22) Filed: Apr. 24, 2018

(65) Prior Publication Data

US 2018/0314171 A1 Nov. 1, 2018

(30) Foreign Application Priority Data

Apr. 28, 2017 (JP) ..... 2017-089521

(51) Int. Cl.

| | |
|---|---|
| ***G03G 5/00*** | (2006.01) |
| ***G03G 5/06*** | (2006.01) |
| ***G03G 5/05*** | (2006.01) |
| ***G03G 5/047*** | (2006.01) |

(52) U.S. Cl.

CPC ..... *G03G 5/0696* (2013.01); *G03G 5/047* (2013.01); *G03G 5/0525* (2013.01)

(58) Field of Classification Search

CPC ..... G03G 5/0696; G03G 5/047

USPC ..... 430/59.4

See application file for complete search history.

(56) References Cited

U.S. PATENT DOCUMENTS

| | | | | |
|---|---|---|---|---|
| 9,921,499 | B2 * | 3/2018 | Watariguchi | C09B 67/0026 |
| 2018/0314171 | A1 * | 11/2018 | Watariguchi | C03G 5/0696 |

FOREIGN PATENT DOCUMENTS

| | | | |
|---|---|---|---|
| JP | 7-319188 | A | 12/1995 |
| JP | 9-138516 | A | 5/1997 |
| JP | 2006-72304 | A | 3/2006 |

OTHER PUBLICATIONS

Nakai, I, & Izumi, F., "Funmatsu X-sen kaiseki no jissai" (The Practice of Powder X-ray Analysis, in Japanese), Asakura Publishing Co. LTD., 2009, pp. 63, 81-82, 83-84, 119, 120-123, 140-142, 254.

Borsenberger, P.M., & Ateya, A.I.,"Hole photogeneration in poly(N-vinylcarbazole)", J. Appl. Phys. 49(7), Jul. 1978, p. 4035-4041.

* cited by examiner

*Primary Examiner* — Mark A Chapman

(74) *Attorney, Agent, or Firm* — Canon U.S.A. Inc., IP Division

(57) ABSTRACT

An electrophotographic photosensitive member includes a support member, a charge generating layer containing a phthalocyanine pigment as a charge generating material, a charge transport layer containing a charge transporting material in this order. The charge generating layer has a thickness of less than 200 nm, and the phthalocyanine pigment includes phthalocyanine crystalline particles having a particle size distribution and satisfies a requirement that the volume average of the products of Φi and Ψi is 0.31 or more.

7 Claims, 3 Drawing Sheets

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present disclosure relates to an electrophotographic photosensitive member, and a process cartridge and an electrophotographic apparatus each including the electrophotographic photosensitive member.

Description of the Related Art

Multilayer photosensitive layers including a charge generating layer containing a charge generating material and a charge transport layer containing a charge transporting material are the mainstream of the photosensitive layer of electrophotographic photosensitive members. Multilayer photosensitive layers have advantages of, for example, being highly sensitive and allowing a variety of material design.

Phthalocyanine pigments, which are superior as photoconductor and are highly sensitive to light in a wide range of wavelengths, are used as a charge generating material of the electrophotographic photosensitive member of electrophotographic apparatuses using a semiconductor laser capable of oscillation in a wide range of wavelengths as an image exposure device. It has been known that phthalocyanine pigments exhibit various electrical properties, depending on the crystal form thereof and also on the manufacturing process (which is varied in treating method performed by, for example, UV irradiation, pulverization, or using solvent, or in synthesizing method) even if the crystal form is the same.

When a photosensitive material is used in an electrophotographic process in practice, it is desirable that the S/N ratio of the difference (latent image contrast) between the charged potential of the non-image area and the exposure potential of the image area be high. The term "S/N ratio" used herein refers to the ratio of the difference between charged potential and exposure potential to the decrease in charged potential caused by various reasons including dark decay and repeated use of the photosensitive member or to the increase in exposure potential caused by various reasons including uneven thickness of the charge generating layer and repeated use of the photosensitive member. By increasing the S/N ratio to stabilize the latent image contrast, both the difference (development contrast) between development potential and exposure potential and the difference (Vback) between charged potential and development potential are stabilized. When the development contrast is stable, the amount of toner in the image area becomes stable. Also, when the Vback value is stable, fogging over the non-image area (phenomenon in which toner is developed in an area where charged potential is reduced). Thus, increasing the S/N ratio of latent image contrast leads to improved image quality.

In view of recent demands for high image quality, high speed output and long life of electrophotographic images, it is particularly desired to suppress the increase of dark decay to keep the S/N ratio of the latent image contrast high after repeated use. An increased dark decay results in a reduced charged potential for development and a reduced S/N ratio of the latent image contrast. Consequently, the Vback value becomes unstable, causing fogging. From the viewpoint of reducing dark decay, a method has been being studied for forming a charge generating layer to a small thickness.

However, the amount of light that a thin charge generating layer can absorb is small. Accordingly, the ratio of energy of light absorbed by the photosensitive layer to the total energy of exposure light, that is, light absorptance of the photosensitive layer, decreases, and consequently, the sensitivity decreases and becomes unstable. This sometimes causes exposure potential to increase and become unstable, reducing the S/N ratio of the latent image contrast. Accordingly, some approaches have been proposed for improving the performance of the phthalocyanine pigment itself by increasing the ratio of the number of photocarriers generated from the charge generating material to the number of photons absorbed by the photosensitive layer, that is, quantum efficiency (Japanese Patent Laid-Open Nos. 2006-72304, 9-138516, and 7-319188).

Japanese Patent Laid-Open No. 2006-72304 discloses an electrophotographic photosensitive member using a technique in which a mixture of a phthalocyanine pigment, an organic electron accepter, and a specific solvent is pulverized in a wet process so that the organic electron accepter is taken into the surfaces of the phthalocyanine pigment particles and/or the vicinities of the surfaces while the crystal form of the phthalocyanine pigment is changed. According to this prior art document, this technique can sufficiently impart a chargeability, a sensitivity to light, and a low dark decay to the electrophotographic photosensitive member, thus reducing image defects, such as fogging and ghosting.

Japanese Patent Laid-Open No. 9-138516 discloses an electrophotographic photosensitive member containing: a phthalocyanine compound having a particle size distribution in which particles with a particle size in the range of 0.1 μm to less than 0.5 μm account for 60% of the total volume of the compound; and an organic compound having a specific structure and capable of acting as an acceptor. According to this prior art document, this technique reduces residual potential to impart high sensitivity to the photosensitive member while improving the dispersibility of phthalocyanine pigment.

Japanese Patent Laid-Open No. 7-319188 discloses an electrophotographic photosensitive member including a photosensitive layer containing a binder resin and a titanyl phthalocyanine pigment (oxytitanium phthalocyanine) dispersed in the binder resin. This titanyl phthalocyanine pigment exhibits a CuKα X-ray diffraction spectrum having the strongest peak at a Bragg angle 2θ of 26.3°±0.2° with a half width (full width at half maximum) of 0.4° or less. According to this prior art document, the charged potential of this electrophotographic photosensitive member is not much reduced even by repeated use, and thus the electrophotographic photosensitive member exhibits good electrical properties. The half width depends on the manufacturing conditions, such as the time for pulverization or dispersion, the size and specific gravity of the pulverization or dispersion media such as beads or balls, and the rotational speed of the pulverization or dispersion mill such as a ball mill. This prior art document explains that this is because the crystal lattice of the titanyl phthalocyanine can be irregularly distorted by the stress placed thereon by pulverization or dispersion.

SUMMARY OF THE INVENTION

Accordingly, an aspect of the present disclosure, there is provided an electrophotographic photosensitive member including a support member, a charge generating layer having a thickness of less than 200 nm and containing a phthalocyanine pigment as a charge generating material, and a charge transport layer containing a charge transporting material in this order. The phthalocyanine pigment includes phthalocyanine crystalline particles having a particle size distribution and satisfies a requirement that the volume average of the products of Φi represented by equation (E1) and Ψi represented by equation (E2) is 0.31 or more:

$$\Phi_i = 1 - \frac{0.425}{kR_i}\sum_{n=1}^{\infty}\left[1 - \frac{\Gamma(n, kR_i/0.425)}{\Gamma(n)}\right]\left[1 - \frac{\Gamma(n, 15.7/(kR_i))}{\Gamma(n)}\right] \quad \text{(E1)}$$

$$\Psi_i = \begin{cases} 1 - 10^{-\alpha d} & (Pd/R_i > 1) \\ (Pd/R_i)(1 - 10^{-\alpha R_i/P}) & (Pd/R_i \leq 1) \end{cases} \quad \text{(E2)}$$

In the equations, k represents a parameter representing the ratio r/R of the crystallite correlation length r of the phthalocyanine pigment to the volume average diameter R of the crystalline particles in the particle size distribution of the phthalocyanine pigment, and Ri represents the respective diameters of the crystalline particles in the particle size distribution. Also, α represents the absorption coefficient of the charge generating layer, d represents the thickness of the charge generating layer, and P represents the ratio of the volume of the charge generating material to the total volume of the charge generating layer.

According to another aspect, there is provided a process cartridge capable of being removably attached to an electrophotographic apparatus. The process cartridge includes the electrophotographic photosensitive member and at least one device selected from the group consisting of a charging device, a developing device, and a cleaning device. The electrophotographic photosensitive member and the at least one device are held in one body.

Also, an electrophotographic apparatus is provided. The electrophotographic apparatus includes the above-described electrophotographic photosensitive member, a charging device, an exposure device, a developing device, and a transfer device.

Thus, the present disclosure provides a highly sensitive electrophotographic photosensitive member exhibiting an increase S/N ratio of latent image contrast, and also provides a process cartridge and an electrophotographic apparatus that include the electrophotographic photosensitive member.

Further features of the present invention will become apparent from the following description of exemplary embodiments with reference to the attached drawings.

DESCRIPTION OF THE EMBODIMENTS

Figure 1:
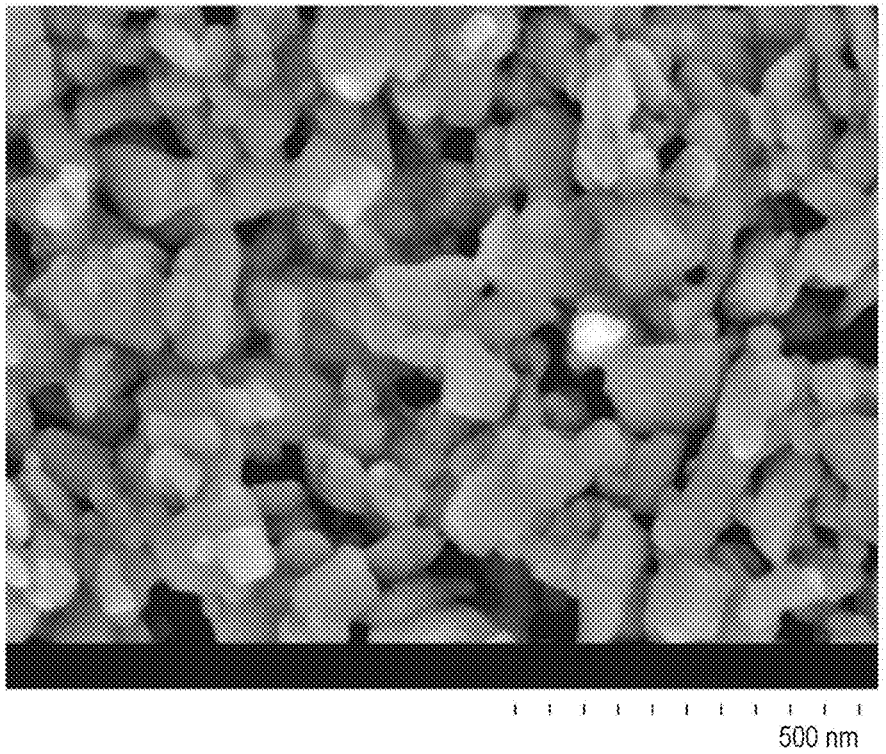
FIG. 1 is an SEM micrograph of the hydroxygallium phthalocyanine pigment produced in Photosensitive Member Production Example 37.

Phthalocyanine pigments have been improved in a variety of ways for use as a charge generating material in electrophotographic photosensitive members.

According to the research by the present inventors, however, the above-cited known photosensitive members have not fully brought out the advantageous electrophotographic properties of the phthalocyanine pigment itself, and the sensitivity of the photosensitive members have not reached the level that is being desired.

More specifically, in the electrophotographic photosensitive member disclosed in Japanese Patent Laid-Open No. 2006-72304, which is not intended to improve the electrophotographic properties of the phthalocyanine pigment itself, the organic electron acceptor is mixed with the phthalocyanine pigment. This reduces the dispersibility of the phthalocyanine pigment and locally reduces the chargeability of the electrophotographic photosensitive member. Therefore, the S/N ratio of latent image contrast is insufficient.

With regard to the phthalocyanine compound disclosed in Japanese Patent Laid-Open No. 9-138516 and the titanyl phthalocyanine pigment disclosed in Japanese Patent Laid-Open No. 7-319188, the relationship between the crystallinity of the phthalocyanine pigment and the particle size thereof and the relationship among the phthalocyanine pigment, the layered structure of the photosensitive layer, and the thickness of the photosensitive layer are not clear nor sufficiently optimized. Therefore, the S/N ratio of latent image contrast is insufficient. Japanese Patent Laid-Open No. 9-138516 discloses a 20 μm-thick single-layer photosensitive layer containing X type metal-free phthalocyanine pigment and a specific organic compound capable of acting as an acceptor, wherein the phthalocyanine pigment particles having a particle size from 0.1 μm to less than 0.5 μm account for 76.1% or more of the phthalocyanine pigment. In this single-layer structure, the layer containing the phthalocyanine pigment is thick and is therefore inferior in chargeability, resulting in an insufficient S/N ratio of the latent image contrast. Japanese Patent Laid-Open No. 7-319188 discloses a 0.2 μm-thick charge generating layer containing a titanyl phthalocyanine pigment that exhibits a CuKα X-ray diffraction spectrum having the strongest peak at a Bragg angle 2θ of 26.3°±0.2° with a half width of 0.28°. In this prior art document, while the crystallinity of the phthalocyanine pigment is controlled to be high, the particle size of the pigment is not controlled, and the S/N ratio of the latent image contrast is therefore insufficient.

The present disclosure provides a highly sensitive electrophotographic photosensitive member including a multilayer photosensitive layer having a thin charge generating layer and exhibiting an increased S/N ratio of latent image contrast, and also provides a process cartridge and an electrophotographic apparatus that include the electrophotographic photosensitive member.

The subject matter of the present disclosure will be described in detail in the following exemplary embodiments.

First, the terms "crystalline particle" and "crystallite correlation length" mentioned herein will be described. The "crystalline particle" of a phthalocyanine pigment mentioned herein refers to the primary particle defined by an aggregate of phthalocyanine molecules. FIG. 1 shows a scanning electron microscope (SEM) image of a phthalocyanine pigment. Each of the lumps shown in FIG. 1 is a crystalline particle. The term "crystalline particle size R" mentioned herein, which will be described in detail herein later, refers to the volume average diameter of the crystalline particles in the particle size distribution of the phthalocyanine pigment. Also, the term "crystalline particle size $R_i$" refers to the respective diameters of crystalline particles in the particle size distribution.

The term "crystallite correlation length" of a phthalocyanine pigment mentioned herein refers to the size of a region that can be considered to be a phthalocyanine single crystal in the crystalline particle. The crystallite correlation length depends on the crystal distortion defined as local irregularity in distance between crystal planes or in orientation of crystal planes, and depends on the size of the crystallite defined as a region that locally has a crystal distortion but, from a view of a wide region, does not vary in distance between crystal planes or in orientation of crystal planes (reference: Nakai, I, & Izumi, F. "Funmatsu X-sen kaiseki no jissai" (The Practice of Powder X-ray Analysis, in Japanese), p. 63, Asakura Publishing Co., Ltd.) Crystal distortion and crystallites cannot be recognized in the SEM micrograph shown in FIG. 1. In the present disclosure, the value "r" calculated from the CuKα X-ray diffraction spectrum of a phthalocyanine pigment by using the Scherrer equation is considered to be the "crystallite correlation length" of the phthalocyanine pigment. Details of this will be describe later.

In general, the sensitivity of an electrophotographic photosensitive member is represented by the product of quantum efficiency and light absorptance. The present inventors have found through their many experimental results that quantum efficiency and light absorptance depend on the particle size distribution of crystalline particles. The present inventors have also found that quantum efficiency depends on crystallite correlation length and clarified a relationship between the particle size distribution and the crystallite correlation length of the crystalline particles. Furthermore, the present inventors have found, from these findings, an evaluation parameter for determining the optimal particle size distribution and crystallite correlation length of the crystalline particles of phthalocyanine pigment when it is used as the charge generating material of a thin charge generating layer, and confirmed that the phthalocyanine pigment produced based on an evaluation using the evaluation parameter exhibits a high sensitivity. Quantum efficiency and light absorptance will now be described.

The quantum efficiency η of the charge generating material in an electrophotographic photosensitive member depends on electric field intensity, and this dependence is often explained by the Onsager theory. According to the Onsager theory, when a charge generating material has a quantum efficiency $\eta_{max}$ at an adequately high electric filed intensity, the quantum efficiency η of the charge generating material at an electric field E is represented by the following equation (E3) (reference: P. M. Borsenberger and A. I. Ateya, Hole photogeneration in poly(N-vinylcarbazole), J. Appl. Phys. 49(7), July 1978, P. 4035):

$$\frac{\eta(r_0, E)}{\eta_{max}} = 1 - \frac{1}{2(E/E_c)(r_0/r_c)} \sum_{n=1}^{\infty}\left\{\left[1 - \frac{\Gamma(n, 2(E/E_c)(r_0/r_c))}{\Gamma(n)}\right]\left[1 - \frac{\Gamma(n, r_c/r_0)}{\Gamma(n)}\right]\right\} \quad \text{(E3)}$$

In the equation, Γ( ) represents a Gamma function, Γ(,) represents an incomplete gamma function, and $r_0$ represents a constant depending on the charge generating material. $r_c$ and $E_c$ are each defined by the following equations (E4) and (E5), respectively:

$$r_c = \frac{e^2}{4\pi\varepsilon k_B T} \quad \text{(E4)}$$

wherein e represents elementary charge, ε represents dielectric constant, $k_B$ represents Boltzmann constant, and T represents absolute temperature; and $$E_c = \frac{k_B T}{\varepsilon r_c} \quad \text{(E5)}$$

In contrast, the light absorptance of the charge generating layer of a multilayer electrophotographic photosensitive member depends on the thickness d of the charge generating layer. When d is large, the light absorptance follows Beer-Lambert law. The light absorptance of a charge generating layer with an absorption coefficient α is represented by the following equation (E6):

$$\frac{I}{I_0} = 1 - 10^{-\alpha d} \quad \text{(E6)}$$

wherein $I_0$ represents the total energy of light incident on the charge generating layer, and I represents the energy of light absorbed by the charge generating layer.

If a phthalocyanine pigment is used as the charge generating material that acts to absorb light, the actual thickness d of the charge generating layer becomes almost the same as the respective diameters $R_i$ of the crystalline particles, and gaps are formed among the phthalocyanine pigment particles, causing the light absorptance to deviate from equation (E6) based on the Beer-Lambert law. The present inventors have found that the following equation (E7) allows for this deviation geometrically.

$$\frac{I}{I_0} = \begin{cases} 1 - 10^{-\alpha d} & (Pd/R_i > 1) \\ (Pd/R_i)(1 - 10^{-\alpha R_i/P}) & (Pd/R_i \leq 1) \end{cases} \quad \text{(E7)}$$

wherein P represents the ratio of the volume ($m^3$) of the charge generating material to the total volume ($m^3$) of the charge generating layer.

The present inventors have derived an evaluation parameter for determining the optimal particle size distribution and crystallite correlation length of the crystalline particles of the phthalocyanine pigment in a thin charge generating layer from a combination of equation (E7) with the equation that is converted from equation (E3) representing quantum efficiency by substituting the crystallite correlation length of each crystalline particle for $r_0$ with substitution of E=30 V/μm, T=296.15, and $\varepsilon=3.6\varepsilon_0$ ($\varepsilon_0$ represents the dielectric constant in vacuum). The respective crystallite correlation lengths of the crystalline particles are determined by the product $kR_i$ of the respective diameters $R_i$ of the crystalline particles and a parameter k (=r/R) defined by using the crystallite correlation length r obtained from the above-described Scherrer equation and the volume average diameter R in the particle size distribution of the crystalline particles.

Parameter k defined by (crystallite correlation length r)/(crystalline particle size R) will be described below. As crystal distortion and the number of interfaces between crystallites are increased, the crystallite correlation length decreases. Hence, the smaller the parameter k, the larger the crystalline distortion and the number of interfaces between the crystallites, each per unit volume of the crystalline particles. Thus, parameter k has high correlations with the crystal distortion and the number of interfaces between crystallites, each per unit volume of crystalline particles.

Accordingly, in order to derive the respective crystallite correlation lengths of crystalline particles from $kR_i$, the crystalline particles have the same k, hence having the same crystal distortion and the same number of interfaces between crystallites, each per unit volume. As described above, the present inventors have found that the evaluation parameter derived from a combination of equation (E7) with the equation converted from equation (E3) by substitution of $kR_i$ for $r_0$, provided that the respective crystallite correlation lengths of crystalline particles are equivalent to $kR_i$, has good correlation with the sensitivity experimentally obtained by using an actual phthalocyanine pigment having a particle size distribution, thus confirming that the parameter k of phthalocyanine pigment produced in the same process can be considered to be the same independent of the respective diameters of the crystalline particles. However, it should be noted that phthalocyanine pigments produced in different processes, in general, have different k values.

Thus, the evaluation parameter is obtained by volume averaging the products of $\Phi_i$ calculated by equation (E1) and $\Psi_i$ calculated by equation (E2) in the particle size distribution of crystalline particles:

$$\Phi_i = 1 - \frac{0.425}{kR_i}\sum_{n=1}^{\infty}\left[1 - \frac{\Gamma(n, kR_i/0.425)}{\Gamma(n)}\right]\left[1 - \frac{\Gamma(n, 15.7/(kR_i))}{\Gamma(n)}\right] \quad \text{(E1)}$$

$$\Psi_i = \begin{cases} 1 - 10^{-\alpha d} & (Pd/R_i > 1) \\ (Pd/R_i)(1 - 10^{-\alpha R_i/P}) & (Pd/R_i \le 1) \end{cases} \quad \text{(E2)}$$

The reason of volume averaging is that it is assumed that the number of photocarriers generated from a phthalocyanine pigment is proportional to the volume of the pigment.

The present inventors found through their experiments that when the evaluation parameter is 0.31 or more, advantageous effect can be produced. An evaluation parameter of less than 0.31 implies that at least either $\Phi_i$ or $\Psi_i$ is low.

A low $\Phi_i$ results from a particle size distribution in which there are many crystalline particles having excessively small $R_i$, and/or a phthalocyanine pigment having low k. As $R_i$ or k decreases, the respective crystallite correlation lengths of crystalline particles decrease. The crystallite correlation length is the size of the region that can be considered to be a phthalocyanine single crystal in a mass of phthalocyanine crystalline particles, as described above. The present inventors therefore assume that the crystallite correlation length is considered to be equal to the distance between pairs of positive charge carriers and negative charge carriers immediately after the phthalocyanine crystalline particles are excited by absorbing light, that is, to be equal to $r_0$ in the Onsager equation (E3).

A low $\Psi_i$ results from a particle size distribution in which there are many crystalline particles having excessively large $R_i$. If $P \cdot d/R_i$ is varied to 1 or less by increasing $R_i$, there occurs a region containing no charge generating material when viewed in the thickness direction of the multilayer structure. This region allows incoming light to pass through without absorbing the light, resulting in reduced light absorptance.

If the charge generating layer has a sufficient thickness d of 200 nm or more, $P \cdot d/R_i$ can be larger than 1 even if $R_i$ is increased, and accordingly, both $\Phi_i$ and $\Psi_i$ can be increased by simply increasing $R_i$. In contrast, in the case of the system as disclosed herein in which the thickness of the charge generating layer is reduced to less than 200 nm from the viewpoint of suppressing the increase of dark decay so as to stabilize chargeability, the above-described evaluation parameter is low irrespective of whether $R_i$ is small or large.

Thus, in a multilayer electrophotographic photosensitive member including a charge generating layer having a thickness of less than 200 nm and containing a phthalocyanine pigment, when the volume average of the products of $\Phi_i$ defined by equation (E1) and $\Psi_i$ defined by equation (E2) in the particle size distribution of the phthalocyanine pigment is 0.31 or more, the electrophotographic photosensitive member exhibits a satisfactory sensitivity with a stable chargeability required for an electrophotographic photosensitive member, and a significantly increased S/N ratio of the latent image contrast.

Phthalocyanine Pigment

As described above, the phthalocyanine pigment used in the embodiments of the present disclosure include phthalocyanine crystalline particles having a particle size distribution and satisfies the requirement that the volume-average of the products of $\Phi_i$ represented by equation (E1) and $\Psi_i$ represented by equation (E2) is 0.31 or more:

$$\Phi_i = 1 - \frac{0.425}{kR_i}\sum_{n=1}^{\infty}\left[1 - \frac{\Gamma(n, kR_i/0.425)}{\Gamma(n)}\right]\left[1 - \frac{\Gamma(n, 15.7/(kR_i))}{\Gamma(n)}\right] \quad \text{(E1)}$$

$$\Psi_i = \begin{cases} 1 - 10^{-\alpha d} & (Pd/R_i > 1) \\ (Pd/R_i)(1 - 10^{-\alpha R_i/P}) & (Pd/R_i \le 1) \end{cases} \quad \text{(E2)}$$

wherein k is a parameter representing the ratio r/R of the crystallite correlation length r of the phthalocyanine pigment to the volume average diameter R of the crystalline particles in the particle size distribution of the phthalocyanine pigment, and $R_i$ represents the respective diameters of the crystalline particles in the particle size distribution, and wherein $\alpha$ represents the absorption coefficient of the charge generating layer, d represents the thickness of the charge generating layer, and P represents the ratio of the volume of the charge generating material to the total volume of the charge generating layer.

The product of $\Phi_i$ and $\Psi_i$ is not determined by only the phthalocyanine pigment, and the condition of the charge generating layer containing the phthalocyanine pigment as the charge generating material is involved in this value.

For calculating the volume average of the products of $\Phi_i$ and $\Psi_i$ in the particle size distribution in practice, a mathematical processing system, Mathematica 9.0 (produced by Wolfram Research) was used. The present inventors have found through their studies that, with regard to the phthalocyanine pigment used as the charge generating material in the electrophotographic photosensitive member, the error of the infinite sum of equation (E1) with a dummy variable n from the true value is as small as 0.01% even when n is substituted with valuables 1 to 20. In the present disclosure, $\Phi_i$ is calculated by substituting the infinite sum of equation (E1) with the sum of equation (E1) obtained by substituting n with variables of 1 to 100.

The particle size distribution of the crystalline particles of the phthalocyanine pigment can be determined by a method capable of measuring the primary particle size of the crystalline particles, such as dynamic light scattering, laser diffraction, gravitational sedimentation, ultrasonic attenuation, or imaging. In the Examples of the present disclosure, the particle size distribution of the crystalline particles of the phthalocyanine pigment was determined by SEM imaging.

More specifically, 10,000 or more crystalline particles are selected from the SEM micrograph of each sample of the phthalocyanine pigment with an image processing software program Photoshop (produced by Adobe). Subsequently, the area S of each of the selected crystalline particles was measured, and the diameter of a circle having the same area as area S, that is, $2\times(S/\Pi)^{1/2}$, is defined as the crystalline particle size $R_i$ of the corresponding crystalline particle.

Alternatively, the crystalline particle size $R_i$ may be calculated by using an electrophotographic photosensitive member containing the phthalocyanine pigment, according to the following procedure. First, the electrophotographic photosensitive member is processed so that the charge generating layer containing the phthalocyanine pigment can be exposed to the surrounding environment. For example, the layer(s) overlying the layer containing the phthalocyanine pigment is removed by using a solvent. Then, the surface of the layer containing the phthalocyanine pigment is equally divided into 10 segments in the peripheral direction of the photosensitive member and into 25 segments in the axial direction of the photosensitive member. A randomly selected point in each of the 250 segments in total is observed by SEM (the magnification in FIG. 1 is 100 thousand times). Thus, some crystalline particles are selected from the segments (40 or more particles from each segment, 10,000 or more particles in total), and the particle size $R_i$ of each crystalline particle is calculated as described above.

The particle size distribution is determined based on the crystalline particle sizes $R_i$ thus calculated (total number of particles N≥10,000), and the volume average particle size is calculated as crystalline particle size R. More specifically, the particle size R of crystalline particles i (i=1, 2, 3, . . . , N) having respective diameters $R_i$ (nm) is calculated by the following equation (E8):

$$R = \frac{\sum_{i=1}^{N} R_i^4}{\sum_{i=1}^{N} R_i^3} \tag{E8}$$

The crystallite correlation length r of a phthalocyanine pigment is a value calculated from the CuKα X-ray diffraction spectrum of the phthalocyanine pigment by using the Scherrer equation. How to calculate the crystallite correlation length r will be described in detail below.

The Scherrer equation is expressed by equation (E9):

$$\tau = \frac{K\lambda}{\beta\cos\theta} \tag{E9}$$

wherein K represents Scherrer constant (shape factor); λ represents the X-ray wavelength (nm) (in the case of CuKα X-ray diffraction spectrum, λ=0.154 nm); β represents the integral breadth (rad); and θ represents the Bragg angle.

Figure 2:
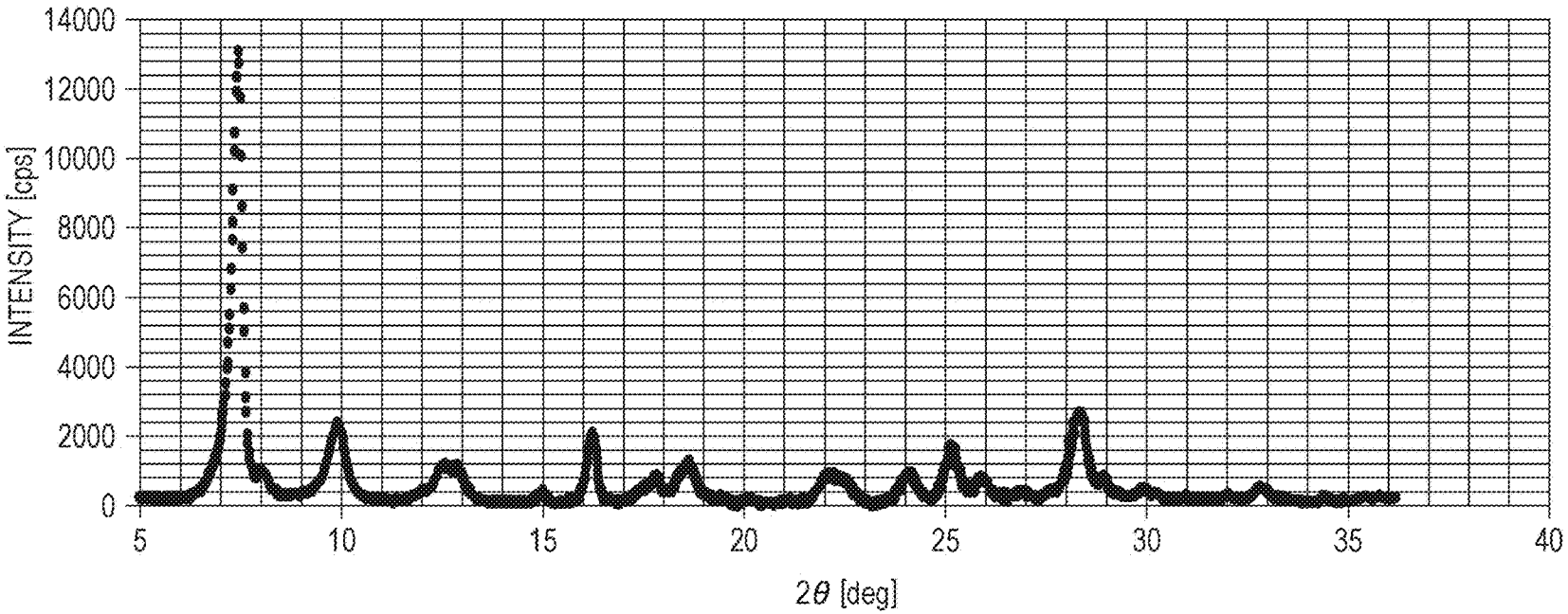
FIG. 2 is a powder X-ray diffractogram of the hydroxygallium phthalocyanine pigment produced in Photosensitive Member Production Example 37.

The Bragg angle θ in equation (E9) is the angle at which the CuKα X-ray diffraction spectrum of the phthalocyanine pigment exhibits the peak having the highest intensity. In general, the Bragg angle producing such a peak lies at 2θ in the range of 5° to 35° in X-ray diffraction spectra. In FIG. 2, for example, the Bragg angle showing the peak having the highest intensity lies around 2θ=7.5°. The integral breadth β is a value obtained by correcting the quotient of the peak area at the Bragg angle θ (represented as 2θ in X-ray diffraction spectra) divided by the peak height, using the reference material and correction formula described below. The positions, areas and heights of peaks can be determined by using profile parameters obtained by fitting with a profile function of the X-ray diffraction spectrum appropriately processed by, for example, eliminating the baseline. The profile functions that can be used here include Gaussian function, Lorentz function, Pearson VII function, Voigt function, pseudo-Voigt function, and functions asymmetric with respect to these functions (reference: Nakai, I, & Izumi, F. "Funmatsu X-sen kaiseki no jissai" (The Practice of Powder X-ray Analysis, in Japanese), pp. 120-123, Asakura Publishing Co., Ltd.)

In the Examples of the present disclosure, a pseudo-Voigt function was used as the profile function. Also, lanthanum boride $LaB_6$ (NIST 660b) was used as the reference material, and the peak at 2θ=21.3° was used as the reference profile. At this time, the integral breadth was corrected as below (reference: Nakai, I, & Izumi, F. "Funmatsu X-sen kaiseki no jissai" (The Practice of Powder X-ray Analysis, in Japanese), pp. 83-84 and 254, Asakura Publishing Co., Ltd.)

For each sample, Gaussian function components $X_{Pc,G}$ and $X_{ref,G}$ and Lorenz function components $X_{Pc,L}$ and $X_{ref,L}$ of the full width at half maximum of the pseudo-Voigt function are determined using the fitted parameters obtained by the profile fitting of the X-ray diffraction peaks of the phthalocyanine pigment and the reference material.

Subsequently, the Gaussian function components and Lorenz function components of the full width at half maximum are corrected by using the following equations (E10) and (E11):

$$X_G=\sqrt{X_{\mathrm{Pc},G}^2-X_{\mathrm{ref},G}^2} \tag{E10}$$

$$X_L=X_{Pc,L}-X_{ref,L} \tag{E11}$$

Then, the corrected full width X at half maximum of the pseudo-Voigt function and shape parameter η are calculated by the following equations (E12) and (E13):

$$X = \left(\begin{array}{c} X_G^5 + 2.69269X_G^4X_L + 2.42843X_G^3X_L^2 + \\ 4.47163X_G^2X_L^3 + 0.07842X_GX_L^4 + X_L^5 \end{array}\right)^{\frac{1}{5}} \tag{E12}$$

$$\eta = 1.36603\frac{X_L}{X} - 0.47719\left(\frac{X_L}{X}\right)^2 + 0.1116\left(\frac{X_L}{X}\right)^3 \tag{E13}$$

In Photosensitive Member Production Example 37 in the present disclosure, for example, the shape parameter η was 0.76. This suggests that the pseudo-Voigt function that is the profile function is closer to the Lorenz function than to the Gaussian function. In the case where the profile function is a Gaussian function, the full width at half maximum is corrected by using the above equation (E10). In the case where the profile function is a Lorenz function, the full width at half maximum should be corrected by using the above equation (E11). In the present disclosure, the corrected value of the full width at half maximum lies between these two corrections, and the balance therebetween is determined by shape parameter η.

Finally, the corrected integral breadth is calculated by the following equation (E14):

$$\beta = \frac{\pi X}{2\left[\sqrt{\pi \ln 2}\,(1-\eta)+\eta\right]} \quad \text{(E14)}$$

Thus, the integral breadth of the sample itself is obtained, from which the integral breadth derived from the apparatus has been eliminated by use of a reference material. Thus, the value τ calculated by the Scherrer equation with Scherrer constant K=1 represents the "volume-weighted average thickness" (reference: Nakai, I, & Izumi, F. "Funmatsu X-sen kaiseki no jissai" (The Practice of Powder X-ray Analysis, in Japanese), pp. 81-82, Asakura Publishing Co., Ltd.) In the present disclosure, this value is defined as "crystallite correlation length r".

As described above, the crystalline particle size R and the crystallite correlation length r are each the volume-averaged value. This is because it is assumed that the number of photocarriers generated per crystalline particle is proportional to the volume of the crystalline particle.

The CuKα X-ray diffraction spectrum of a phthalocyanine pigment can be obtained by characteristic powder X-ray diffraction. In order to eliminate the influence of preferred orientation on the measurement, Boro-Silicate capillary (70 mm in length, 0.01 mm in thickness, 0.7 mm in inner diameter, manufactured W. Muller) was used as the capillary (reference: Nakai, I, & Izumi, F. "Funmatsu X-sen kaiseki no jissai" (The Practice of Powder X-ray Analysis, in Japanese), pp. 119 and 140-142, Asakura Publishing Co., Ltd.) The phthalocyanine pigment is thus subjected to characteristic powder X-ray diffraction analysis in the capillary. Also, the capillary empty of the sample is subjected to the X-ray diffraction analysis in the same manner to yield background data.

Beneficially, the parameter k (=r/R) of the phthalocyanine pigment used in the present disclosure is in the range of 0.17 to 0.42. The reason for this is as below.

One of the causes of deactivation of photocarriers and the memory phenomenon resulting from the electrophotographic photosensitive member is retention of photocarriers (holes and electrons) in the photosensitive layer (charge generating layer). The present inventors have found through their studies that photocarriers can retain in portions having a crystal distortion in a mass of crystalline particles of the phthalocyanine pigment and at the interfaces between crystallites of the crystalline particles. Hence, by reducing crystal distortion and the number of interfaces between crystallites, each per unit volume of the crystalline particles, deactivation of photocarriers and the memory phenomenon can be reduced. That is, the phthalocyanine pigment can efficiently function as a photoconductor. The inventors also have found that if the crystal distortion and the number of interfaces between crystallites, each per unit volume of crystalline particles are excessively reduced, the electrical resistance of the crystalline particles decreases to the extent that the resulting electrophotographic photosensitive member cannot have a required chargeability.

As described above, parameter k has high correlations with the crystalline distortion and the number of interfaces between crystallites, each per unit volume of the crystalline particles. When k is 0.17 or more, therefore, crystalline distortion and the number of interfaces between crystallites decrease, and accordingly, photocarriers become unlikely to be retained at the crystal distortion and the interfaces between the crystallites. In contrast, when k is 0.42 or less, the crystalline particles have a high electrical resistance and good chargeability. When k is 0.42 or less, in addition, the crystal distortion of the crystalline particles and the number of interfaces between crystallites are large to some extent. Accordingly, the crystalline particles vary from a state of single crystal; hence, the probability decreases that the electrical conditions at the surfaces of the adjacent crystalline particles become similar to each other. Consequently, the crystalline particles are not likely to aggregate or to cause charge concentration, and, thus, the chargeability of the resulting electrophotographic photosensitive member is increased.

For the reasons just described, when parameter k (=r/R) is in the range of 0.17 to 0.42, the sensitivity is increased due to increased chargeability, reduced memory phenomenon, and suppressed photocarrier deactivation, and, thus, the S/N ratio of the latent image contrast is increased.

As described above, the evaluation parameter used herein is not determined by only the phthalocyanine pigment, and the condition of the charge generating layer is involved in the evaluation parameter. For producing a phthalocyanine pigment that can form a charge generating layer having satisfactory electrophotographic properties and has an evaluation parameter value satisfying the above-described requirement, a specific pulverizing force (any one of the following four forces: compressive force, impulsive force, frictional force, and shear force) may be applied for crystal transformation over a specific period of time by a specific milling operation. The milling operation performed for producing such a phthalocyanine pigment is a treatment performed by using a milling machine such as a sand mill or a ball mill, containing or not containing a dispersing aid or dispersing media, such as glass beads, steel beads, or alumina balls. If the pulverizing force of the milling operation is to be reduced, stirring with a magnetic stirrer or ultrasonic dispersion may be applied as the milling operation. Two or more milling methods may be combined.

The present inventors have found through their researches that the two-step milling operation performed by applying a strong pulverizing force in the early stage of crystal transformation and then applying a weak pulverizing force for a long time enables the phthalocyanine pigment of the present disclosure to be efficiently produced while facilitating the control of the crystal transformation. The present inventors think that the reason why the two-step milling operation is suitable for producing the phthalocyanine pigment is as below.

Crystal transformation consists of the early stage in which the crystals of the crystalline particles are transformed throughout the pigment, and the later stage in which the crystalline particle size and the crystallite correlation length are varied while the crystals are being slightly transformed. The phthalocyanine pigment of the present disclosure has characteristic features: including crystalline particles having an appropriate uniform size compared with those of the known phthalocyanine pigments; and having a controlled balance between the particle size of the crystalline particles and the crystallite correlation length. In general, however, it is difficult to apply a pulverizing force by which those two characteristic features can be satisfied in the first-stage crystal transformation. A high pulverizing force must be applied in order to reduce the crystalline particle size, whereas a low pulverizing force must be applied in order to increase the crystallite correlation length. In the above-described two-step milling operation, if the crystalline particle size is made appropriately uniform in the early stage of the crystal transformation, the particle size distribution of the crystalline particles is kept in the later stage, and the later stage allows the crystallite correlation length to increase slowly. Thus, the phthalocyanine pigment of the present disclosure has both of the above-described two characteristic features. As is clear from this mechanism, if the magnitudes of the pulverizing forces are reversed in the two-step milling operation, that is, if a low pulverizing force is applied in the early stage of the crystal transformation and then a high pulverizing force is applied for a long time, the phthalocyanine pigment of the present disclosure cannot be obtained. It is important to make the crystalline particle size appropriately uniform in the early stage in which the crystal transformation of the crystalline particles is completed throughout the pigment. Therefore, the phthalocyanine pigment of the present disclosure is not produced thorough a two-step milling operation performed in such a manner that the early stage proceeds in a dry process without using a solvent required for crystal transformation.

The present inventors have found that centrifugation of the phthalocyanine pigment that has been subjected to milling, apart from the two-step milling operation, is effective in producing the phthalocyanine pigment having the evaluation parameter disclosed herein for the charge generating layer having satisfactory electrophotographic properties. The present inventors assume that the reason why combination of milling and centrifugation is advantageous for producing the phthalocyanine pigment of the present disclosure is as follows:

The phthalocyanine pigment of the present disclosure has characteristic features: including crystalline particles having an appropriate uniform size compared with those of the known phthalocyanine pigments; and having a controlled balance between the particle size of the crystalline particles and the crystallite correlation length, as described above. It is however difficult to apply a pulverizing force that can produce these two characteristic features unless an effective way of crystal transformation by, for example, two-step milling operation is devised. Centrifugation enables the control of the particle size of the crystalline particles without applying a pulverizing force to the phthalocyanine pigment; hence, parameter k (=r/R) is hardly varied before and after centrifugation. Thus, the phthalocyanine pigment of the present disclosure can be produced through a milling operation for controlling the particle size of the crystalline particles and the balance between the particle size and the crystallite correlation length and subsequent centrifugation for optimizing the particle size distribution of the crystalline particles. Centrifugation may be performed after the two-step milling operation.

Charge Generating Layer

The charge generating layer disclosed herein is a thin layer having a thickness of less than 200 nm so as to suppress the increase in dark decay and is designed so as to preventing unstable Vback value resulting from increased fogging and preventing increase of fogging resulting from unstable Vback, thus ensuring stable chargeability. In view of this, to control the evaluation parameter disclosed herein to 0.31 or more, the feature of the charge generating layer is taken into account, as well as the feature in terms of the crystalline particles and the crystallites of the phthalocyanine pigment.

The charge generating layer used in the embodiments of the present disclosure has an absorption coefficient $\alpha$ [$nm^{-1}$] and a thickness of d [nm], and contains a charge generating material with a volume ratio of P to the total volume thereof. These features will now be described in detail.

The absorption coefficient of a charge generating layer mentioned herein is that of the charge generating layer satisfying $P \cdot d/R > 1$. This is because when $P \cdot d/R > 1$ holds true, the thickness of the charge generating layer is much larger than the particle size R of the crystalline particles, and Beer-Lambert law applies to the case. In practice, first, single-layer charge generating layers satisfying $P \cdot d/R > 1$ with thickness d were formed to respective 5 thicknesses on a PET film (polyethylene terephthalate film), and the transmittance of the layers was measured with a goniometer to determine the light transmittance for each thickness. At this time, the measurements were corrected by the light transmittance of the PET film alone. Subsequently, the light transmittance values thus obtained were plotted on a graph where the vertical axis represents the common logarithm of the light transmittance with the horizontal axis representing the thickness of the charge generating layer, and the absorption coefficient $\alpha$ was determined from the absolute value of the gradient of the approximate straight line obtained by the least-squares method. For example, the absorption coefficient $\alpha$ in photosensitive member production example 37 was 0.0055 [$nm^{-1}$].

In the case of determining the absorption coefficient $\alpha$ of the charge generating layer in the structure of an electrophotographic photosensitive member, the following procedure is applied. First, the electrophotographic photosensitive member is processed so that the charge generating layer containing the phthalocyanine pigment can be exposed to the surrounding environment. For example, the layer(s) overlying the layer containing the phthalocyanine pigment is removed by using a solvent. Then, the light reflectance is measured in this state. Subsequently, the charge generating layer is removed in the same manner as above to expose the underlying layer, and the light reflectance in this state is measured. The light absorptance of the charge generating layer alone was calculated using the two measured reflectances. Also, the thickness of the charge generating layer is determined by FIB-SEM Slice & View, which will be described herein later. The absorption coefficient was obtained from the gradient of a line passing two points: representing the common logarithm of the absorptance determined above and the thickness; and representing common logarithm of 100% absorptance, which is hence 0, and a thickness of 0.

The absorption coefficient $\alpha$ basically depends on the chemical species and crystal form of the charge generating material and the chemical species of other constituents and binder resin. In other words, if these factors are not changed and d and P are each constant, the absorption coefficient measured under the condition satisfying $P \cdot d/R > 1$ is constant independent of the particle size distribution of the crystalline particles.

The ratio P of the volume of the charge generating material to the total volume of the charge generating layer may be calculated using the ratio of the weight of the charge generating material to the weight of the binder resin in the coating liquid used for forming the charge generating layer, the specific gravity of the phthalocyanine pigment used as the charge generating material, and the specific gravity of the binder resin. For example, in photosensitive member production example 37, the ratio of the weight of the charge generating material to the total weight of the charge generating layer was 2:3. The hydroxygallium phthalocyanine pigment has a specific gravity of 1.6, and polyvinyl butyral used as the binder resin has a specific gravity of 1.1. Therefore, P is calculated to be 0.58.

In the case of determining the volume ratio P of the charge generating layer in the structure of the electrophotographic photosensitive member, the charge generating layer may be extracted from the electrophotographic photosensitive member by FIB and thus observed by FIB-SEM Slice & View. The phthalocyanine pigment and the binder resin are distinguished by the difference between their FIB-SEM Slice & View contrasts. Thus, the volume ratio P can be determined.

The volume ratio P may be in the range of 0.42 to 0.72. If the volume ratio P is less than 0.42, the molecules of the phthalocyanine pigment acting as an electrical conductor in the charge generating layer are not likely to come into contact with each other, reducing electrical conductivity. Consequently, the sensitivity is reduced, and a severe memory phenomenon occurs. The present inventors assume that the value P=0.42 is the percolation threshold of the phthalocyanine pigment in a state where it is dispersed in the binder resin. On the other hand, if the volume ratio P is more than 0.72, the phthalocyanine pigment is not likely to disperse sufficiently in the charge generating layer and is likely to form aggregates that can cause dot defects (blue spots) and fogging. A low volume ratio of the binder resin results in a reduced adhesion of the charge generating layer to the adjacent layer, causing a problem with durability, such as a separation of the charge generating layer during use in an electrophotographic process. By controlling the volume ratio P in the above-mentioned range, the reduction in sensitivity and the memory phenomenon which result from the electrical conductivity of the charge generating layer can be suppressed while sufficient dispersion and good durability are achieved.

The thickness d of the charge generating layer can be determined by FIB-SEM Slice & View. For simplicity, the thickness d may be determined by using the average specific gravity and the weight of the charge generating layer. The thickness of the charge generating layer used in the embodiments of the present disclosure is less than 200 nm, and it may be less than 160 nm in an embodiment from the viewpoint of reducing fogging over a repeated use. For example, in Photosensitive Member Production Example 37, the charge generating layer had a thickness of 150 nm.

The electrophotographic photosensitive member using an appropriate combination of the phthalocyanine pigment and the charge generating layer that are disclosed herein is as below. For a charge generating layer having $\alpha$, P, and d (<200 nm), which are determined as described above, formed using a phthalocyanine pigment as the charge generating material whose crystalline particles have diameters $R_i$ (total number N≥10,000) and parameter k, $\Phi_i$ and $\Psi_i$ are calculated by the following equations (E1) and (E2):

$$\Phi_i = 1 - \frac{0.425}{kR_i}\sum_{n=1}^{\infty}\left[1 - \frac{\Gamma(n, kR_i/0.425)}{\Gamma(n)}\right]\left[1 - \frac{\Gamma(n, 15.7/(kR_i))}{\Gamma(n)}\right] \quad \text{(E1)}$$

$$\Psi_i = \begin{cases} 1 - 10^{-\alpha d} & (Pd/R_i > 1) \\ (Pd/R_i)(1 - 10^{-\alpha R_i/P}) & (Pd/R_i \le 1) \end{cases} \quad \text{(E2)}$$

The evaluation parameter, or the volume average of the products of $\Phi_i$ and $\Psi_i$, is calculated by the following expression (E15) for crystalline particles i (i=1, 2, 3, . . . , N) having diameters $R_i$(nm):

$$\frac{\sum_{i=1}^{N} R_i^3 \Phi_i \Psi_i}{\sum_{i=1}^{N} R_i^3} \quad \text{(E15)}$$

By adjusting the particle size distribution, the ratio of the crystallite correlation length to the particle size of the crystalline particles, the absorption coefficient of the charge generating layer, and the ratio of the volume of the charge generating material to the total volume of the charge generating layer so that the evaluation parameter calculated as above can be 0.31 or more, and controlling the thickness of the charge generating layer to less than 200 nm, a combination of the phthalocyanine pigment and the charge generating layer is established suitably for the electrophotographic photosensitive member disclosed herein.

Electrophotographic Photosensitive Member

Figure 3:
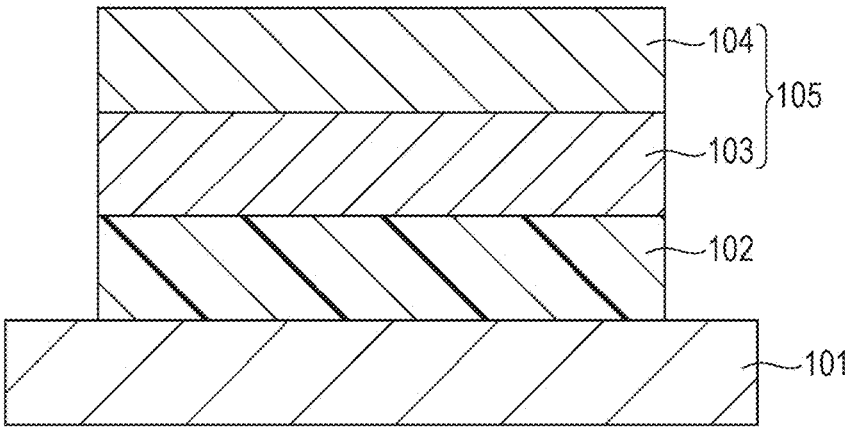
FIG. 3 is the multilayer structure of an electrophotographic photosensitive member according to an embodiment of the present disclosure.

The electrophotographic photosensitive member according to an embodiment of the present disclosure includes a support member and a multilayer photosensitive layer (including a charge generating layer and a charge transport layer) over the support member. FIG. 3 is an illustrative representation of the multilayer structure of an electrophotographic photosensitive member. The electrophotographic photosensitive member shown in FIG. 3 includes a support member 101, an undercoat layer 102, and a multilayer photosensitive layer 105 including a charge generating layer 103 and a charge transport layer 104. In an embodiment, the undercoat layer 102 is not necessarily provided.

Support Member

The support member may be electrically conductive (electroconductive support member), and may be made of a metal, such as aluminum, iron, copper, gold, stainless steel, nickel, or an alloy thereof. An insulating support member provided with an electroconductive coating film over the surface thereof may be used. The insulating support member may be made of a plastic, such as a polyester resin, a polycarbonate resin, or a polyimide resin, or glass or paper. The electroconductive coating film may be a metal thin film made of, for example, aluminum, chromium, silver, or gold, a thin film of any other electroconductive material such as indium oxide, tin oxide, or zinc oxide, or a thin film of an electroconductive ink containing silver nanowires.

The support member may be in the form of a cylinder, a film, or the like. The cylindrical aluminum support member is superior in mechanical strength, electrophotographic properties, and cost. A plain pipe, as it is, may be used as the support member, or the plain pipe may be surface-treated to improve the electrical characteristics or reduce interference fringes by for example, physical treatment, such as cutting, honing, or blasting, or anodization or other chemical treatment using an acid or the like. A plain pipe support member treated by physical treatment so as to have a ten-point surface roughness $R_{zjis}$, specified in JIS B0601: 2001, of 0.8 μm or more, such as cutting, honing, or blasting, can reduce interference fringes effectively.

Electroconductive Layer

The electrophotographic photosensitive member may optionally include an electroconductive layer between the support member and the photosensitive layer to cover the roughness of or defects at the support member or reduce interference fringes. Particularly in the case of using a plain pipe as the support member, forming the electroconductive layer is a simple way to reduce interference fringes. This is very advantageous in terms of productivity and cost efficiency.

The electroconductive layer may be formed by applying a coating liquid prepared by dispersing electroconductive particles and a binder resin in a solvent to form a coating film and drying the coating film. For preparing the dispersion liquid, for example, a paint shaker, a sand mill, a ball mill, or a high-speed liquid collision disperser may be used.

Examples of the electroconductive particles include carbon black, acetylene black, powder of metal such as aluminum, nickel, iron, Nichrome, copper, zinc, or silver, and powder of a metal compound such as tin oxide, indium oxide, titanium oxide, or barium sulfate. The binder resin may be a polyester resin, a polycarbonate resin, a polyvinyl butyral resin, an acrylic resin, a silicone resin, an epoxy resin, a melamine resin, a urethane resin, a phenol resin, or an alkyd resin. Examples of the solvent of the coating liquid include ethers, such as tetrahydrofuran, dioxane, ethylene glycol monomethyl ether, and propylene glycol monomethyl ether; alcohols, such as methanol, ethanol, and isopropanol; ketones, such as acetone, methyl ethyl ketone, and cyclohexanone; esters, such as methyl acetate and ethyl acetate; and aromatic hydrocarbons, such as toluene and xylene. The coating liquid for the electroconductive layer may further contain roughing particles.

The thickness of the electroconductive layer may be in the range of 5 μm to 40 μm, such as in the range of 10 μm to 30 μm, from the viewpoint of reducing interference fringes and covering the defects at the surface of the support member.

Undercoat Layer

An undercoat layer acting as a barrier or an adhesive may optionally be disposed on the support member or the electroconductive layer. The undercoat layer may be formed by applying a coating liquid prepared by dissolving a resin in a solvent to form a coating film and drying the coating film.

Examples of the resin as the material of the undercoat layer include acrylic resin, allyl resin, alkyd resin, ethyl cellulose resin, methyl cellulose resin, ethylene-acrylic acid copolymer, epoxy resin, casein resin, silicone resin, gelatin resin, phenol resin, butyral resin, polyacrylate resin, polyacetal resin, polyamide-imide resin, polyamide resin, polyallyl ether resin, polyimide resin, polyurethane resin, polyester resin, polyethylene resin, polyethylene oxide resin, polycarbonate resin, polystyrene resin, polysulfone resin, polyvinyl alcohol resin, polybutadiene resin, polypropylene resin, urea resin, agarose resin, and cellulose resin. Among these, polyamide resin is advantageous for acting as a barrier or an adhesive.

The thickness of the undercoat layer may be in the range of 0.3 μm to 5 μm. The undercoat layer may have the commutation function of causing photo carriers to flow to the support member. In the case of a negative charging type, the undercoat layer is an electron transport film containing an electron transporting material and acts so that electrons flow to the support member from the photosensitive layer. More specifically, the undercoat layer may be defined by a film formed by hardening or curing an electron transporting material or a composition containing an electron transporting material, a film formed by drying a coating of a coating liquid prepared by dissolving an electron transporting material, or a film containing an electron transporting pigment. Beneficially, the undercoat layer is a cured or hardened film from the viewpoint of preventing the elution of the electron transporting material to the charge generating layer. In some embodiments, the cured or hardened film may be a cured film formed by curing the composition further containing a crosslinking agent. More beneficially, the composition contains a crosslinking agent and a resin. In some embodiments, the electron transporting material and the resin in the cured film may be an electron transporting compound having a polymerizable functional group and a resin having a polymerizable functional group, respectively. Examples of the polymerizable functional group include hydroxy, thiol, amino, carboxy, and methoxy. The crosslinking agent may be a compound polymerizable or crosslinkable with one or both of the electron transporting compound having a polymerizable functional group and the resin having a polymerizable functional group.

Charge Generating Layer

The charge generating layer having a thickness of less than 200 nm is formed by applying a coating liquid prepared by dispersing the phthalocyanine pigment as the charge generating material and a binder resin in a solvent to form a coating film and drying the coating film.

The coating liquid for forming the charge generating layer may be prepared by dispersing only the charge generating material in a solvent and then adding a binder resin to the dispersion, or by dispersing the charge generating material and the binder resin together in the solvent.

For dispersing the materials, a disperser may be used. Examples of the disperser include media dispersers, such as a sand mill and a ball mill, liquid collision dispersers, and ultrasonic dispersers. Incidentally, the crystallite correlation length of the crystals in the charge generating layer of the electrophotographic photosensitive member formed in each Example or Comparative Example was estimated. More specifically, the charge generating layer was removed and pulverized into powder, followed by dispersion using ultrasonic waves. The powder was subjected to powder X-ray diffraction analysis, and the crystallite correlation length was estimated by the above-described calculation. The estimated crystallite correlation length was compared with the crystallite correlation length of the phthalocyanine pigment before being dispersed in the coating liquid, estimated by power X-ray diffraction analysis and the above-described calculation. Thus, it has been confirmed that the crystallite correlation length of the phthalocyanine pigment of the present disclosure was not varied by the dispersion operation, except for the dispersion operation in Photosensitive Member Production Examples 203 and 204.

The binder resin used in the charge generating layer may be an insulating resin, and examples thereof include polyvinyl butyral resin, polyvinyl acetal resin, polyarylate resin, polycarbonate resin, polyester resin, polyvinyl acetate resin, polysulfone resin, polystyrene resin, phenoxy resin, acrylic resin, polyacrylamide resin, polyvinyl pyridine resin, urethane resin, agarose resin, cellulose resin, casein resin, polyvinyl alcohol resin, polyvinylpyrrolidone resin, polyvinylidene chloride resin, acrylonitrile copolymers, and polyvinyl benzal resin. Organic photoconductive polymers may also be used, such as poly-N-vinyl carbazol, polyvinyl anthracene, and polyvinyl pyrene. The binder resin may be composed of a single resin or may be a mixture or a copolymer of two or more resins.

Examples of the solvent used in the coating liquid for forming the charge generating layer include toluene, xylene, tetralin, chlorobenzene, dichloromethane, chloroform, trichloroethylene, tetrachloroethylene, carbon tetrachloride, methyl acetate, ethyl acetate, propyl acetate, methyl formate, ethyl formate, acetone, methyl ethyl ketone, cyclohexanone, diethyl ether, dipropyl ether, propylene glycol monomethyl ether, dioxane, methylal, tetrahydrofuran, water, methanol, ethanol, n-propanol, isopropanol, butanol, methyl cellosolve, methoxypropanol, dimethylformamide, dimethylacetamide, and dimethyl sulfoxide. These solvents may be used singly or in combination.

Phthalocyanine Pigment

The phthalocyanine pigment used as the charge generating material, which may a metal-free phthalocyanine or a metal phthalocyanine, may have a substituent or axial ligands. In particular, titanyl phthalocyanine and gallium phthalocyanine are suitable for embodying the idea of the present disclosure. The crystalline particles of these phthalocyanine pigments have high quantum efficiency, and the use thereof in the charge generating layer increases sensitivity when it is formed to a small thickness to increase the light absorptance.

In some embodiments, the phthalocyanine pigment may be a hydroxygallium phthalocyanine pigment including crystalline particles exhibiting peaks at Bragg angles 2θ of 7.4°±0.3° and 28.2°±0.3° in a CuKα X-ray diffraction spectrum.

Beneficially, the crystalline particles of the phthalocyanine pigment contain an amide compound represented by the following formula (A1):

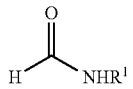

(A1)

wherein $R^1$ represents a group selected from the group consisting of methyl, propyl, vinyl.

Examples of the amide compound of formula (A1) include N-methylformamide, N-propylformamide, and N-vinylformamide.

The content of the amide compound of formula (A1) in the crystalline particles may be in the range of 0.1% by mass to 3.0% by mass relative to the mass of the crystalline particles and is beneficially in the range of 0.1% by mass to 1.4% by mass. When the amide compound content is in the range of 0.1% by mass to 3.0% by mass, the size of the crystalline particles is not excessively reduced, and the standard deviation of the particle size distribution is reduced. Thus, the crystalline particles have similar particle sizes to each other and a controlled balance between the particle size and the crystallite correlation length. Consequently, the evaluation parameter disclosed herein can be increased.

The hydroxygallium phthalocyanine pigment containing the amide compound of formula (A1) in the crystalline particles is produced in a process of crystal transformation performed by wet milling of a hydroxygallium phthalocyanine pigment produced by acid pasting and the amide compound of formula (A1).

If a dispersant is used for this wet milling, the mass of the dispersant may be 10 to 50 times that of the phthalocyanine pigment. Examples of the solvent used for the wet milling include amide-based solvents, such as N,N-dimethylformamide, N,N-dimethylacetamide, a compound represented by formula (A1), N-methylacetamide, and N-methylpropionamide; halogen-based solvents, such as chloroform; ether-based solvents, such as tetrahydrofuran; and sulfoxide-based solvents, such as dimethyl sulfoxide. The mass of the solvent to be used may be 5 to 30 times that of the phthalocyanine pigment.

The present inventors found that if a compound represented by formula (A1) is used as the solvent in the process of crystal transformation for producing the hydroxygallium phthalocyanine pigment including crystalline particles exhibiting peaks at Bragg angles 2θ of 7.4°±0.3° and 28.2°±0.3° in the CuKα X-ray diffraction spectrum, it takes a long time to transform the crystals of the pigment. For example, the time for the crystal transformation in the case of using N-methylformamide as the solvent is several times as long as that in the case of using N,N-dimethylformamide. Since the crystal transformation takes a long time, a time is given to make the crystalline particle size uniform by the time when the crystal transformation is completed, facilitating the production of the phthalocyanine pigment disclosed herein.

Thus, by using a hydroxygallium phthalocyanine pigment including crystalline particles exhibiting peaks at Bragg angles 2θ of 7.4°±0.3° and 28.2°±0.3° in the CuKα X-ray diffraction spectrum, and further using an amide compound represented by formula (A1) as a solvent, the crystal transformation for producing the phthalocyanine pigment disclosed herein can be performed under a wide range of conditions. Indeed, the present inventors found that the phthalocyanine pigment disclosed herein can be produced by applying a specific pulverizing force to such a combination of a phthalocyanine pigment and a solvent by milling for a specific period of time without performing the above-described two-step milling operation.

It was examined by $^1$H-NMR measurement data analysis whether or not the crystalline particles of the hydroxygallium phthalocyanine pigment contain an amide compound represented by formula (A1). Also, the content of the amide compound of formula (A1) in the crystalline particles was determined by $^1$H-NMR data analysis. For example, a hydroxygallium phthalocyanine pigment subjected to milling operation with a solvent capable of dissolving the amide compound of formula (A1) or washed with the solvent after milling operation is analyzed by $^1$H-NMR. If the amide compound of formula (A1) is detected, it can be determined that the crystalline particles contain the amide compound of formula (A1).

If the phthalocyanine pigment is produced through centrifugation, in order to control the ratio P of the volume of the charge generating material to the total volume of the charge generating layer, the weight ratio of the phthalocyanine pigment to the binder resin in the mixture thereof is measured, for example, as will be described in Photosensitive Member Production Example 107. The weight ratio in the mixture of the phthalocyanine pigment and the binder resin was determined by $^1$H-NMR measurement data analysis. For example, if a hydroxygallium phthalocyanine pigment as the phthalocyanine pigment and polyvinyl butyral as the binder resin are used, the weight ratio thereof can be determined by comparing the peak derived from the hydroxygallium phthalocyanine pigment with the peak derived from the polyvinyl butyral in the $^1$H-NMR spectrum.

In the Examples of the present disclosure described herein later, the powder X-ray diffraction and $^1$H-NMR analysis of the phthalocyanine pigment used in the electrophotographic photosensitive member were performed under the following conditions:

Powder X-Ray Diffraction

Apparatus: X-ray diffractometer RINT-TTR II, manufactured by Rigaku
X-ray tube: Cu
X-ray wavelength: Kα1
Tube voltage: 50 kV
Tube current: 300 mA
Scanning: 2θ scan
Scanning speed: 4.0°/min
Sampling interval: 0.02°
Start angle 2θ: 5.0°
Stop angle 2θ: 35.0°
Goniometer: Rotor horizontal goniometer (TTR-2)
Attachment: capillary sample turn table
Filter: none
Detector: Scintillation counter Incident monochromator: used
Slit: Variable slit (parallel beam method)
Counter monochromator: not used
Divergence slit: open
Divergence vertical limit slit: 10.00 mm
Scattering slit: open
Receiving slit: open $^1$H-NMR Analysis Analyzer: AVANCEIII 500, manufactured by BRUKER
Solvent: bisulfuric acid ($D_2SO_4$)
Number of integrations: 2,000

Charge Transport Layer

The charge transport layer is formed by applying a coating liquid prepared by dispersing a charge transporting material and optionally a binder resin in a solvent to form a coating film and drying the coating film.

Examples of the charge transporting material include triarylamine compounds, hydrazone compounds, stilbene compounds, pyrazoline compounds, oxazole compounds, thiazole compounds, and triallylmethane compounds. The charge transporting material may be a polymer having a group derived from these compounds in the main chain or a side chain thereof. Triarylamine compounds, styryl compounds, and benzidine compounds are beneficial as the charge transporting material, and triarylamine compounds are more beneficial. These and those charge transporting materials may be used singly or in combination.

The binder resin used in the charge transport layer may be an insulating resin, and examples thereof include polyvinyl butyral resin, polyvinyl acetal resin, polyarylate resin, polycarbonate resin, polyester resin, polyvinyl acetate resin, polysulfone resin, polystyrene resin, phenoxy resin, polyvinyl acetate resin, acrylic resin, polyacrylamide resin, polyamide resin, polyvinyl pyridine resin, urethane resin, epoxy resin, agarose resin, cellulose resin, casein resin, polyvinyl alcohol resin, polyvinylpyrrolidone resin, polyvinylidene chloride resin, acrylonitrile copolymers, and polyvinyl benzal resin. Organic photoconductive polymers may also be used, such as poly-N-vinyl carbazol, polyvinyl anthracene, and polyvinyl pyrene. Among these and those resins, polycarbonate resin and polyarylate resin are beneficial. The binder resin may be composed of a single resin or may be a mixture or a copolymer of two or more resins. The copolymer may be in any form, such as block copolymer, random copolymer, or alternating copolymer. The weight average molecular weight (Mw) of the binder resin may be in the range of 10,000 to 300,000.

The charge transporting material content in the charge transport layer may be in the range of 20% by mass to 80% by mass, such as in the range of 30% by mass to 60% by mass, relative to the total mass of the charge transport layer.

The thickness of the charge transport layer may be in the range of 5 μm to 40 μm.

Protective Layer

A protective layer may optionally be disposed on the photosensitive layer. The protective layer may be formed by applying a coating liquid prepared by dissolving a resin in a solvent to form a coating film and drying the coating film. Alternatively, the protective layer may be formed by heating the coating film or curing the coating film by, for example, electron beam or ultraviolet light irradiation.

Examples of the resin used in the protective layer include polyvinyl butyral resin, polyester resin, polycarbonate resin (polycarbonate Z, modified polycarbonate, etc.), nylon resin, polyimide resin, polyacrylate resin, polyurethane resin, styrene-butadiene copolymer, styrene-acrylic acid copolymer, and styrene-acrylonitrile copolymer.

From the viewpoint of enabling the protective layer to transport charge carriers, the protective layer may be formed by curing a monomer capable of transporting charge carriers by a polymerization reaction or a crosslinking reaction. For example, the protective layer may be formed by polymerizing or crosslinking a charge-transportable compound having a chain-polymerizable functional group to cure the compound.

The protective layer may contain electroconductive particles, a UV absorbent, or lubricative particles such as fluorine-containing organic particles. The electroconductive particles may be metal oxide particles, such as zinc oxide particles. The thickness of the protective layer may be in the range of 0.05 μm to 20 μm.

The application of the coating liquid for each layer may be performed by dipping, spray coating, spinner coating, bead coating, blade coating, beam coating, or any other coating technique. In an embodiment, dipping may be employed from the viewpoint of efficiency and productivity.

Process Cartridge and Electrophotographic Apparatus

Figure 4:
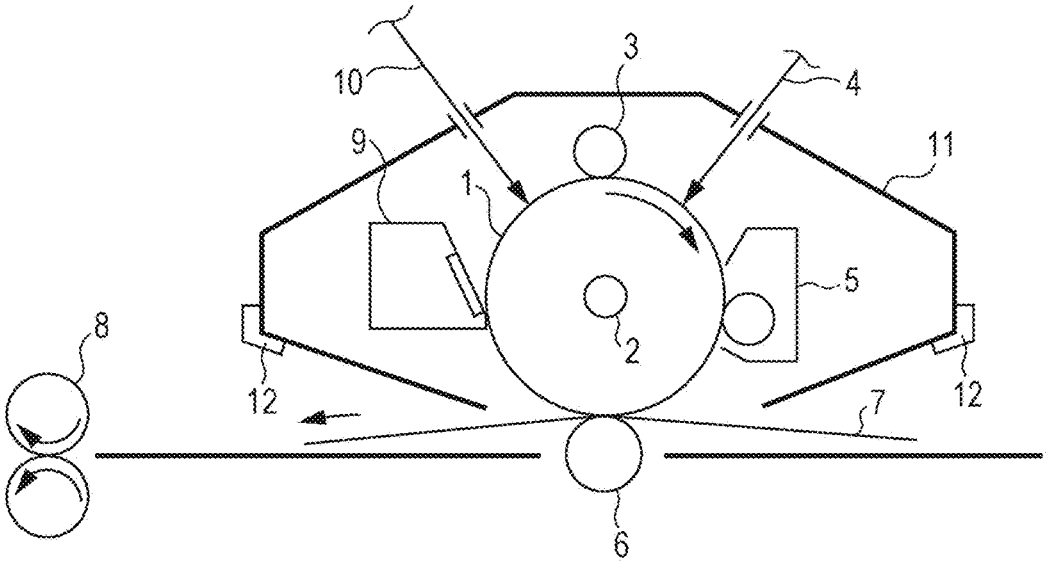
FIG. 4 is a schematic view of the structure of an electrophotographic apparatus provided with a process cartridge including an electrophotographic photosensitive member according to an embodiment of the present disclosure.

FIG. 4 is a schematic view of the structure of an electrophotographic apparatus provided with a process cartridge including an electrophotographic photosensitive member. This electrophotographic photosensitive member 1, which is cylindrical (drum-shaped), is driven for rotation on a shaft 2 in the direction indicated by the arrow at a predetermined peripheral speed (process speed).

When driven for rotation, the surface of the electrophotographic photosensitive member 1 is charged to a predetermined positive or negative potential with a charging device 3. Subsequently, an electrostatic latent image corresponding to targeted image information is formed on the surface of the charged electrophotographic photosensitive member 1 by irradiation with exposure light 4 from an exposure device (not shown). The exposure light 4 has been modulated in intensity according to the time-series electric digital image signals of the targeted image information outputted from the exposure device, such as a slit exposure device or a laser beam scanning exposure device.

The electrostatic latent image formed on the surface of the electrophotographic photosensitive member 1 is developed (normally developed or reversely developed) into a toner image with a toner contained in a developing device 5. The toner image on the surface of the electrophotographic photosensitive member 1 is transferred to a transfer medium 7 by a transfer device 6. At this time, a bias voltage having an opposite polarity to the charge of the toner is applied to the transfer device 6 from a bias source (not shown). When the transfer medium 7 is paper, the medium 7 is fed to the portion between the electrophotographic photosensitive member 1 and the transfer device 6 from a paper feeder (not shown) in synchronization with the rotation of the electrophotographic photosensitive member 1.

The transfer medium 7 to which the toner image has been transferred from the electrophotographic photosensitive member 1 is separated from the surface of the electrophotographic photosensitive member 1 and then conveyed to a fixing device 8 for fixing the toner image, thus being ejected as an image-formed article (printed matter or copy) from the electrophotographic apparatus.

The surface of the electrophotographic photosensitive member 1 from which the toner image has been transferred to the transfer medium 7 is cleaned with a cleaning device 9 to remove therefrom the toner or the like remaining after transfer. A recently developed cleanerless system may be used. In this system, the toner remaining after transfer is directly removed by a developing device or the like. Then, the surface of the electrophotographic photosensitive member 1 is pre-exposed to pre-exposure light 10 from a pre-exposure device (not shown) to remove static electricity before being used again for forming images. If the charging device 3 is a contact charging type using a charging roller or the like, pre-exposure device is not necessarily required.

In an embodiment of the present disclosure, some of the components of the electrophotographic apparatus including the electrophotographic photosensitive member 1, the charging device 3, the developing device 5, and the cleaning device 9 are integrated in a container as a process cartridge. The process cartridge may be removably mounted to the body of the electrophotographic apparatus. For example, at least one selected from among the charging device 3, the developing device 5, and the cleaning device 9 is integrated with the electrophotographic photosensitive member 1 into a cartridge. The cartridge may be guided by a guide 12 such as a rail, thus being used as a process cartridge 11 removable from the body of the electrophotographic apparatus.

If the electrophotographic apparatus is a copy machine or a printer, the exposure light 4 may be light reflected from or transmitted through an original image. Alternatively, the exposure light 4 may be light emitted by laser beam scanning operation according to the signals generated by reading the original image with a sensor, or light emitted from an LED array or a liquid crystal shutter array driven according to such signals.

The electrophotographic photosensitive member 1 disclosed herein can be widely applied to electrophotographic applications in the fields of, for example, laser beam printers, CRT printers, LED printers, FAX machines, liquid crystal printers, and laser plate making.

Electrophotographic Process

An electrophotographic process in which the electrophotographic photosensitive member disclosed herein can be used effectively will now be described.

For the electrophotographic photosensitive member including a charge generating layer whose thickness is reduced to less than 200 nm so as to suppress the increase in dark decay to increase the chargeability and stabilize the Vback value, thus reducing fogging over the non-image area, the present inventors have found, through their studies on the phthalocyanine pigment and the charge generating layer, that a high S/N ratio of the latent image contrast, as well as reduced fogging, can be achieved by increasing and stabilizing the sensitivity of the photosensitive member in the thin-layer structure. In order to reduce fogging and increase the S/N ratio of the latent image contrast, the absolute value of the charge potential may be directly increased to increase the absolute value of the latent image contrast. From the viewpoint of increasing the S/N ratio of the latent image contrast by increasing the sensitivity, the intensity of the electric field applied to the electrophotographic photosensitive member may be increased to increase the sensitivity according to the Onsager equation (E3).

However, if the absolute value of the charge potential is increased, or if the intensity of the electric field is increased, breakdown called leakage becomes likely to occur in the photosensitive member during an electrophotographic process, increasing the risk of image defects. For increasing image quality and stability and preventing leakage, it is therefore beneficial to increase the S/N ratio of the latent image contrast by increasing the chargeability and sensitivity and to set the absolute value of the charge potential low, instead of increasing the charge potential to increase the absolute value of the latent image contrast. From this viewpoint, it is beneficial that the absolute value of the charge potential of the electrophotographic apparatus is less than 500 V.

The lower limit of the absolute value of exposure potential is 0 V. In general, if the absolute value of the charge potential is reduced, the absolute value of the latent image contrast is also reduced. Accordingly, the S/N ratio of the latent image contrast is reduced due to variations in properties resulting from the environment, the durability and the production lots of the electrophotographic photosensitive member. The Vback value and the latent image contrast thus become unstable, consequently degrading the image quality. In a combination of the electrophotographic photosensitive member disclosed herein and an electrophotographic apparatus, in contrast, since the electrophotographic photosensitive member exhibits a high S/N ratio of the latent image contrast, the electrophotographic apparatus can produce high-quality images, exhibit high stability, and prevent leakage when the charge potential of the electrophotographic apparatus is set at less than 500 V.

Also, the electrophotographic photosensitive member has a satisfactory sensitivity because the light absorptance thereof is increased. In a combination of an electrophotographic apparatus and the electrophotographic photosensitive member, therefore, the intensity of the electric field to be applied to the photosensitive member can be reduced, and high image quality and high stability and prevention of leakage can be achieved. The intensity of the electric field may be less than 31 V/μm, such as less than 21 V/μm. Leakage is a phenomenon resulting from an electrical destruction of the insulating layer of the photosensitive member caused by a high current suddenly flowing in the insulating layer when the insulating layer randomly becomes unable to withstand a high electric field locally applied thereto. Therefore, leakage is prevented by controlling the intensity of the global electric field, which depends on the settings of the electrophotographic apparatus and the structure of the electrophotographic photosensitive member, to less than 31 V/μm. Furthermore, when the electric field intensity is less than 21 V/μm, the risk of leakage resulting from a local concentration of electric field caused by foreign matter accidentally attached onto the electrophotographic photosensitive member can be reduced.

EXAMPLES

The subject matter of the present disclosure will be further described in detail with reference to the following examples. In the following description, the term "part(s)" refers to "part(s) by mass". It should be appreciated that the subject matter is not limited to the following Examples. The thicknesses of each layer of the electrophotographic photosensitive members of the Examples and Comparative Examples were determined by measurement using an eddy current thickness meter Fischerscope (manufactured by Fischer) or by calculation using specific gravity and mass per unit area.

Synthesis Example 1

A reactor was charged with 5.46 parts of o-phthalonitrile and 45 parts of α-chloronaphthalene and was then heated to and kept at 30° C. in an atmosphere of nitrogen flow. Subsequently, 3.75 parts of gallium trichloride was added into the reactor at this temperature (30° C.). The water content in the resulting mixture at this time was 150 ppm. Then, the mixture was heated to 200° C. Subsequently, the mixture was subjected to a reaction at 200° C. for 4.5 hours in an atmosphere of nitrogen flow, followed by cooling to 150° C. Then, the reaction product was filtered out. The resulting filtration product was dispersed in N,N-dimethylformamide and washed at 140° C. for 2 hours, followed by filtration. The resulting filtration product was washed with methanol and dried to yield a chlorogallium phthalocyanine pigment with a yield of 71%.

Synthesis Example 2

In 139.5 parts of concentrated sulfuric acid was dissolved at 10° C. 4.65 parts of the chlorogallium phthalocyanine pigment produced in Synthesis Example 1. The solution was dropped into 620 parts of ice water with stirring, and the precipitate was filtered using a filter press under reduced pressure. For this filtration, No. 5C filter (manufactured by ADVANTEC) was used as the filter. The resulting wet cake (filtration product) was dispersed and washed in 2% ammonia solution for 30 minutes and then filtered using a filter press. Subsequently, the resulting wet cake (filtration product) was dispersed and washed in ion exchanged water and then filtered using a filter press. This operation was repeated three times. Finally, the product was freeze-dried to yield a hydroxygallium phthalocyanine pigment (solids content: 23%, hydrous hydroxygallium phthalocyanine pigment) with a yield of 97%.

Synthesis Example 3

In a dryer HYPER-DRY HD-06R (oscillation frequency: 2455 MHz±15 MHz, manufactured by Biocon), 6.6 kg of the hydroxygallium phthalocyanine pigment produced in Synthesis Example 2 was dried as below.

The cake of the hydroxygallium phthalocyanine pigment removed from the filter press (hydrous cake thickness: 4 cm or less) was placed on a dedicated circular plastic tray, and the dryer was set so that the internal wall temperature would be 50° C. and that infrared radiation would be off. For microwave irradiation, the degree of vacuum in the dryer was set in the range of 4.0 kPa to 10.0 kPa by adjusting the vacuum pump and the leakage valve.

In the first step for the drying, the hydroxygallium phthalocyanine pigment was irradiated with microwaves of 4.8 kW for 50 minutes. After temporarily interrupting the microwave radiation, the dryer was evacuated to 2 kPa or less with the leakage valve closed. At this time, the solids content of the hydroxygallium phthalocyanine pigment was 88%. In the second step, the degree of vacuum (internal pressure of the dryer) was returned to the above-set range (4.0 kPa to 10.0 kPa) by adjusting the leakage valve. Then, the hydroxygallium phthalocyanine pigment was irradiated with microwaves of 1.2 kW for 5 minutes. After temporarily interrupting the microwave radiation, the dryer was evacuated to 2 kPa or less with the leakage valve closed. This second step was repeated once (total twice). At this time, the solids content of the hydroxygallium phthalocyanine pigment was 98%. Furthermore, in the third step, irradiation with microwaves was performed in the same manner as in the second step, except that the power of the microwaves was varied from 1.2 kW to 0.8 kW. This third step was repeated once (total twice). Furthermore, in the fourth step, the degree of vacuum (internal pressure of the dryer) was returned to the above-set range (4.0 kPa to 10.0 kPa) by adjusting the leakage valve. Then, the hydroxygallium phthalocyanine pigment was irradiated with microwaves of 0.4 kW for 3 minutes. After temporarily interrupting the microwave radiation, the dryer was evacuated to 2 kPa or less with the leakage valve closed. This fourth step was repeated seven times (total eight times). Thus, 1.52 kg of hydroxygallium phthalocyanine pigment (crystals) with a water content of 1% or less was produced over a period of three hours in total.

Synthesis Example 4

With 200 parts of hydrochloric acid (35% by mass in terms of hydrogen chloride) of 23° C. in temperature was mixed 10 parts of the hydroxygallium phthalocyanine pigment produced in Synthesis Example 2. The mixture was stirred with a magnetic stirrer for 90 minutes. After mixing hydrochloric acid, the ratio of the hydrogen chloride to the hydroxygallium phthalocyanine was 118 mol to 1 mol. After being stirred, the mixture was dropped into 1,000 parts of ion exchanged water cooled with ice water, followed by stirring with a magnetic stirrer for 30 minutes. The resulting mixture was filtered under reduced pressure. For this filtration, No. 5C filter (manufactured by ADVANTEC) was used as the filter. Then, the filtration product was dispersed and washed in 23° C. ion exchanged water four times. Thus, 9 parts of a chlorogallium phthalocyanine pigment was produced.

Synthesis Example 5

In 100 g of α-chloronaphthalene, 5.0 g of o-phthalodinitrile and 2.0 g of titanium tetrachloride were stirred for 3 hours with heating at 200° C. Then, the mixture was cooled to 50° C. to precipitate crystals. The precipitate was separated by filtration to yield paste of a dichlorotitanium phthalocyanine. Subsequently, the paste was stirred and washed in 100 mL of N,N-dimethylformamide heated to 100° C. and then washed in 100 mL of 60° C. methanol twice, followed by filtration. Furthermore, the resulting paste was stirred in 100 mL of deionized water at 80° C. for 1 hour, and the liquid was subjected to filtration to yield 4.3 g of a blue titanyl phthalocyanine pigment.

Then, the resulting pigment was dissolved in 30 mL of concentrated sulfuric acid, and the solution was dropped into 300 mL of 20° C. deionized water with stirring for precipitation. The precipitate was filtered out and sufficiently washed with water to yield an amorphous titanyl phthalocyanine pigment. In 100 mL of methanol was suspended 4.0 g of the resulting amorphous titanyl phthalocyanine pigment at room temperature (22° C.) for 8 hours. The suspension was filtered, and the filtration product was dried under reduced pressure to yield a low-crystallinity titanyl phthalocyanine pigment.

Synthesis Example 6

To 230 parts of dimethyl sulfoxide were added 30 parts of 1,3-diiminoisoindoline and 9.1 parts of gallium trichloride. The materials were subjected to a reaction at 160° C. for 6 hours with stirring to yield a purple-red pigment. The resulting pigment was washed with dimethyl sulfoxide and ion exchanged water in that order and then dried to yield 28 parts of a chlorogallium phthalocyanine pigment.

Synthesis Example 7

The solution of 10 parts of the chlorogallium phthalocyanine pigment produced in the foregoing Synthesis Example 6 in 300 parts of 60° C. sulfuric acid (concentration: 97%) was dropped into the mixed solution of 600 parts of 25% ammonia water and 200 parts of ion exchanged water. After being collected by filtration, the precipitated pigment was washed with N,N-dimethylformamide and ion exchanged water and then dried to yield 8 parts of a hydroxygallium phthalocyanine pigment.

Synthesis Example 8

To 100 mL of α-chloronaphthalene were added 10 g of gallium trichloride and 29.1 g of o-phthalonitrile in an atmosphere of nitrogen flow, and the materials were subjected to a reaction at 200° C. for 24 hours. Then, the reaction product was collected by filtration. The filtration product, which was in the form of wet cake, was dispersed in N,N-dimethylformamide at 150° C. for 30 minutes, followed by filtration. The resulting filtration product was washed with methanol and dried to yield a chlorogallium phthalocyanine pigment with a yield of 83%.

In 50 parts of concentrated sulfuric acid was dissolved 2 parts of this chlorogallium phthalocyanine pigment. After being stirred for 2 hours, the solution was dropped into the ice-cooled mixed solution of 170 mL of distilled water and 66 mL of concentrated ammonia solution to yield a precipitate. After being washed with distilled water, the precipitate was dried to yield 1.8 parts of a hydroxygallium phthalocyanine pigment.

Synthesis Example 9

A reaction of 31.8 parts of phthalonitrile, 10.1 parts of gallium trimethoxide, and 150 mL of methylene glycol was performed at 200° C. for 24 hours in an atmosphere of nitrogen flow. Then, the reaction product was collected by filtration. The resulting product, which was in the form of wet cake, was washed with N,N-dimethylformamide and methanol in that order and then dried to yield 25.1 parts of a gallium phthalocyanine pigment.

In 50 parts of concentrated sulfuric acid was dissolved 2 parts of this chlorogallium phthalocyanine pigment. After being stirred for 2 hours, the solution was dropped into the ice-cooled mixed solution of 170 mL of distilled water and 66 mL of concentrated ammonia solution to yield a precipitate. After being washed with distilled water, the precipitate was dried to yield 1.8 parts of a hydroxygallium phthalocyanine pigment.

Synthesis Example 10

To 230 parts of dimethyl sulfoxide were added 30 parts of 1,3-diiminoisoindoline and 9.1 parts of gallium trichloride. The materials were subjected to a reaction at 160° C. for 4 hours with stirring to yield a purple-red pigment. The resulting pigment was washed with dimethyl sulfoxide and ion exchanged water in that order. The resulting wet cake was vacuum-dried at 80° C. for 24 hours to yield 28 parts of a chlorogallium phthalocyanine pigment.

Photosensitive Member Production Example 1

Support Member

An aluminum cylinder of 24 mm in diameter and 257 mm in length was used as a support member (cylindrical support member).

Electroconductive Layer

Then, in a ball mill were dispersed 60 parts of tin oxide-coated barium sulfate particles (PASTRAN PC1, produced by "Mitsui Mining & Smelting), 15 parts of titanium oxide particles (TITANIX JR, produced by Tayca), 43 parts of resol-type phenol resin (PHENOLITE J-325, produced by DIC, solids content: 70% by mass), 0.015 part of silicone oil (SH28PA, produced by Dow Corning Toray), 3.6 parts of silicone resin particles (TOSPEARL 120, produced by Momentive Performance Materials), 50 parts of 2-methoxy-1-propanol, and 50 parts of methanol for 20 hours to yield a coating liquid for the electroconductive layer. This coating liquid was applied to the surface of the support member by dipping. The resulting coating film was cured by heating at 145° C. for 1 hour to yield a 20 μm-thick electroconductive layer.

Undercoat Layer

Next, 25 parts of N-methoxymethylated nylon 6 (Toresin EF-30T, produced by Nagase Chemtex) was dissolved in 480 parts of methanol/n-butanol mixed solution with a proportion of 2/1 by heating at 65° C., and the resulting solution was cooled. Then, the solution was filtered through a membrane filter FP-022 (pore size: 0.22 μm, manufactured by Sumitomo Electric Industries) to yield a coating liquid for the undercoat layer. This coating liquid was applied to the surface of the electroconductive layer by dipping. The resulting coating film was heated to dry at 100° C. for 10 minutes to yield a 0.5 μm-thick undercoat layer.

Charge Generating Layer

Subsequently, 0.5 part of the hydroxygallium phthalocyanine pigment produced in Synthesis Example 3 and 9.5 parts of N-methylformamide F0059 (produced by Tokyo Chemical Industry) were subjected to milling (first milling operation) with 15 parts of glass beads of 0.9 mm in diameter with a paint shaker (manufactured by Toyo Seiki) at room temperature (23° C.) for 6 hours. For this operation, a standard bottle PS-6 (manufactured by Hakuyo Glass) was used as the container. The liquid subjected to the milling operation was filtered through a filter (N-NO. 125T, pore size: 133 μm, manufactured by NBC Meshtec) to remove the glass beads. The resulting liquid was further subjected to milling (second milling operation) at room temperature (23° C.) for 40 hours by using a ball mill machine. This operation was performed in the standard bottle PS-6 (manufactured by Hakuyo Glass) under the condition where the bottle was rotated at a speed of 120 rpm. In this operation, media, such as glass beads, were not used. After adding 30 parts of N-methylformamide to the resulting liquid, the mixture was filtered, and the filtration product remaining on the filter was sufficiently washed with tetrahydrofuran. Then, the resulting filtration product was vacuum-dried to yield 0.46 part of a hydroxygallium phthalocyanine pigment.

The resulting pigment was exhibited peaks at Bragg angles 2θ of 7.5°±0.2°, 9.9°±0.2°, 16.2°±0.2°, 18.6°±0.2°, 25.2°±0.2°, and 28.3°±0.2° in the CuKα X-ray diffraction spectrum thereof. The crystallite correlation length r, which was estimated from the peak at 7.5°±0.2° that was the strongest of the peaks in the range of 5° to 35°, was 31 nm. The content of the amide compound (N-methylformamide) represented by formula (A1) in the hydroxygallium phthalocyanine crystalline particles, which was estimated by $^{1}$H-NMR analysis, was 2.6% by mass relative to the mass of the hydroxygallium phthalocyanine.

Subsequently, 20 parts of the hydroxygallium phthalocyanine pigment subjected to the above-described milling operation, 10 parts of a polyvinyl butyral S-LEC BX-1 (produced by Sekisui Chemical), and 190 parts of cyclohexanone were dispersed in each other with 482 parts of glass beads of 0.9 mm in diameter in a sand mill K-800 (manufactured by Aimex, disk diameter: 70 mm, 5 disks) for 4 hours with cooling water of 18° C. This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 150 nm-thick charge generating layer.

The hydroxygallium phthalocyanine pigment had a specific gravity of 1.6, and polyvinyl butyral used as the binder resin had a specific gravity of 1.1. Therefore, the ratio P of the volume of the charge generating material to the total volume of the charge generating layer was calculated to be 0.58. The volume average particle size R of the hydroxygallium phthalocyanine pigment in the charge generating layer, which was estimated from the particle size distribution obtained using the SEM micrograph, was 125 nm. From the crystallite correlation length r and the volume average particle diameter R, parameter k (=r/R) was 0.25. For satisfying P·d/R>1, the thickness d [nm] of the charge generating layer is required to satisfy the relationship d>216. Accordingly, charge generating layers having five respective thicknesses of 220, 250, 300, 350, and 400 were formed on a PET film (polyethylene terephthalate film), and the light transmittance of these charge generating layers was measured with a goniometer, together with a simple PET film sample for correction. The absorption coefficient α calculated from the measurement results was $\alpha=0.0055$ [$nm^{-1}$].

Also, $\Phi_i$ was determined for each particle by substituting the diameter $R_i$[nm] of each particle in the particle size distribution estimated from the SEM micrograph and k=0.25 into equation (E1), and $\Psi_i$ was determined for each particle by substituting the diameter $R_i$ [nm] of each particle, the above absorption coefficient $\alpha=0.0055$ [nm--], the thickness d=150 [nm], and the ratio P=0.58 of the volume of the charge generating material to the total volume of the charge generating layer into equation (E2). From these results, the volume average of the products of $\Phi_i$ and $\Psi_i$ in the particle size distribution calculated by equation (E15) was 0.34.

Charge Transport Layer

A coating liquid for forming a charge transport layer was prepared by dissolving the following materials in 630 pars of monochlorobenzene:

70 parts of a triarylamine compound represented by the following formula:

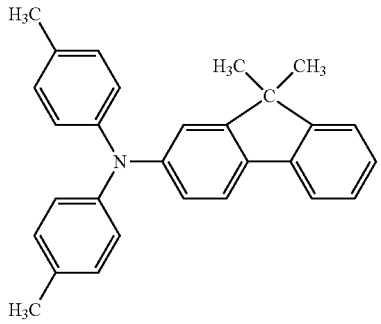

10 parts of a triarylamine compound represented by the following formula:

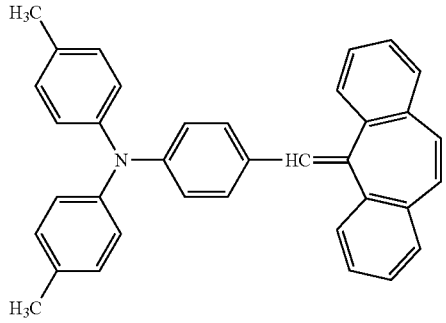

and 100 parts of polycarbonate IUPILON Z-200 (produced by Mitsubishi Engineering-Plastics).

The resulting coating liquid was applied to the surface of the charge generating layer by dipping. The resulting coating film was heated to dry at 120° C. for 1 hour to yield a 15 μm-thick charge transport layer.

The heating treatments of the electroconductive layer, the undercoat layer, the charge generating layer, and the charge transport layer was performed at the respective temperatures in an oven. The heating treatments of these layers in each of the following Photosensitive Member Production Examples were also performed in the same manner as above. Thus, a cylindrical (drum-shaped) electrophotographic photosensitive member of Photosensitive Member Production Example 1 was completed.

The physical properties of the phthalocyanine pigment, the charge generating layer, and the electrophotographic photosensitive member that were produced as just described were shown in Table 1. In Table 1, "HOGaPc" represents a hydroxygallium phthalocyanine pigment; "ClGaPc" represents a chlorogallium phthalocyanine pigment; and "TiOPc" represents a titanyl phthalocyanine pigment. In Table 1, "$\Phi_i\Psi_i$" represents the volume average of the products of $\Phi_i$ and $\Psi_i$ in the particle size distribution.

Photosensitive Member Production Example 2

An electrophotographic photosensitive member of Photosensitive Member Production Example 2 was produced in the same manner as in Photosensitive Member Production Example 1, except that the time for the second milling operation using the ball mill machine was changed from 40 hours to 100 hours. The content of the amide compound (N-methylformamide) represented by formula (A1) in the hydroxygallium phthalocyanine crystalline particles of the pigment, which was estimated by $^1$H-NMR analysis, was 2.4% by mass relative to the mass of the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 3

An electrophotographic photosensitive member of Photosensitive Member Production Example 3 was produced in the same manner as in Photosensitive Member Production Example 1, except that the time for the second milling operation using the ball mill machine was changed from 40 hours to 300 hours. The content of the amide compound (N-methylformamide) represented by formula (A1) in the hydroxygallium phthalocyanine crystalline particles of the pigment, which was estimated by $^{1}$H-NMR analysis, was 2.2% by mass relative to the mass of the hydroxygallium phthalocyanine.

The physical properties of the phthalocyanine pigment, the charge generating later, and the electrophotographic photosensitive member that were produced as just described were determined in the same manner as in Photosensitive Member Production Example 1, and the results are shown in Table 1.

Photosensitive Member Production Example 4

An electrophotographic photosensitive member of Photosensitive Member Production Example 4 was produced in the same manner as in Photosensitive Member Production Example 1, except that the time for the second milling operation using the ball mill machine was changed from 40 hours to 1,000 hours. The content of the amide compound (N-methylformamide) represented by formula (A1) in the hydroxygallium phthalocyanine crystalline particles of the pigment, which was estimated by $^{1}$H-NMR analysis, was 2.0% by mass relative to the mass of the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 5

An electrophotographic photosensitive member of Photosensitive Member Production Example 5 was produced in the same manner as in Photosensitive Member Production Example 1, except that the time for the second milling operation using the ball mill machine was changed from 40 hours to 2,000 hours. The content of the amide compound (N-methylformamide) represented by formula (A1) in the hydroxygallium phthalocyanine crystalline particles of the pigment, which was estimated by $^{1}$H-NMR analysis, was 1.9% by mass relative to the mass of the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 6

An electrophotographic photosensitive member of Photosensitive Member Production Example 6 was produced in the same manner as in Photosensitive Member Production Example 1, except that the second milling operation in the process for producing the hydroxygallium phthalocyanine pigment was changed as below.

In the first milling operation, 0.5 part of the hydroxygallium phthalocyanine pigment produced in Synthesis Example 3 and 9.5 parts of N-methylformamide F0059 (produced by Tokyo Chemical Industry) were subjected to milling with 15 parts of glass beads of 0.9 mm in diameter with a paint shaker (manufactured by Toyo Seiki) at room temperature (23° C.) for 6 hours. For this operation, a standard bottle PS-6 (manufactured by Hakuyo Glass) was used as the container. The resulting liquid was further subjected to milling (second milling operation) at room temperature (23° C.) for 40 hours by using a ball mill machine. For this operation, the container was set to the ball mill machine as it was without removing the contents therefrom, and the container was rotated at a speed of 120 rpm. Hence, both the first and the second milling operation were performed with the same glass beads. The liquid subjected to this operation was filtered through a filter (N-NO. 125T, pore size: 133 μm, manufactured by NBC Meshtec) to remove the glass beads. After adding 30 parts of N-methylformamide to the resulting liquid, the mixture was filtered, and the filtration product remaining on the filter was sufficiently washed with tetrahydrofuran. Then, the resulting filtration product was vacuum-dried to yield 0.46 part of a hydroxygallium phthalocyanine pigment.

The resulting pigment was exhibited peaks at Bragg angles 2θ of 7.5°±0.2°, 9.9°±0.2°, 16.2°±0.2°, 18.6°±0.2°, 25.2°±0.2°, and 28.3°±0.2° in the CuKα X-ray diffraction spectrum thereof. The crystallite correlation length r, which was estimated from the peak at 7.5°±0.2° that was the strongest of the peaks in the range of 5° to 35°, was 27 nm. The content of the amide compound (N-methylformamide) represented by formula (A1) in the hydroxygallium phthalocyanine crystalline particles, which was estimated by $^{1}$H-NMR analysis, was 2.3% by mass relative to the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 7

An electrophotographic photosensitive member of Photosensitive Member Production Example 7 was produced in the same manner as in Photosensitive Member Production Example 6, except that the time for the second milling operation using the ball mill machine was changed from 40 hours to 100 hours. The content of the amide compound (N-methylformamide) represented by formula (A1) in the hydroxygallium phthalocyanine crystalline particles of the pigment, which was estimated by $^{1}$H-NMR analysis, was 1.9% by mass relative to the mass of the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 8

An electrophotographic photosensitive member of Photosensitive Member Production Example 8 was produced in the same manner as in Photosensitive Member Production Example 6, except that the time for the second milling operation using the ball mill machine was changed from 40 hours to 300 hours. The content of the amide compound (N-methylformamide) represented by formula (A1) in the hydroxygallium phthalocyanine crystalline particles of the pigment, which was estimated by $^{1}$H-NMR analysis, was 1.5% by mass relative to the mass of the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 9

An electrophotographic photosensitive member of Photosensitive Member Production Example 9 was produced in the same manner as in Photosensitive Member Production Example 6, except that the time for the second milling operation using the ball mill machine was changed from 40 hours to 1,000 hours. The content of the amide compound (N-methylformamide) represented by formula (A1) in the hydroxygallium phthalocyanine crystalline particles of the pigment, which was estimated by $^{1}$H-NMR analysis, was 0.7% by mass relative to the mass of the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 10

An electrophotographic photosensitive member of Photosensitive Member Production Example 10 was produced in the same manner as in Photosensitive Member Production Example 6, except that the time for the second milling operation using the ball mill machine was changed from 40 hours to 2,000 hours. The content of the amide compound (N-methylformamide) represented by formula (A1) in the hydroxygallium phthalocyanine crystalline particles of the pigment, which was estimated by $^{1}$H-NMR analysis, was 0.6% by mass relative to the mass of the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 11

An electrophotographic photosensitive member of Photosensitive Member Production Example 11 was produced in the same manner as in Photosensitive Member Production Example 8, except that the thickness of the charge generating layer was changed from 150 nm to 130 nm.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 12

An electrophotographic photosensitive member of Photosensitive Member Production Example 12 was produced in the same manner as in Photosensitive Member Production Example 8, except that the thickness of the charge generating layer was changed from 150 nm to 170 nm.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 13

An electrophotographic photosensitive member of Photosensitive Member Production Example 13 was produced in the same manner as in Photosensitive Member Production Example 8, except that the thickness of the charge generating layer was changed from 150 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 14

An electrophotographic photosensitive member of Photosensitive Member Production Example 14 was produced in the same manner as in Photosensitive Member Production Example 8, except that the step of forming the charge generating layer by dipping of a coating liquid using the hydroxygallium phthalocyanine pigment subjected to the milling operation was changed as below.

In a sand mill K-800 (manufactured by Aimex, disk diameter: 70 mm, 5 disks) with cooling water of 18° C. were dispersed 18 parts of the hydroxygallium phthalocyanine pigment subjected to the milling operation in Photosensitive Member Production Example 8, 12 parts of a polyvinyl butyral S-LEC BX-1 (produced by Sekisui Chemical), and 190 parts of cyclohexanone in each other with 482 parts of glass beads of 0.9 mm in diameter for 4 hours. This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 190 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 15

An electrophotographic photosensitive member of Photosensitive Member Production Example 15 was produced in the same manner as in Photosensitive Member Production Example 8, except that the step of forming the charge generating layer by dipping of a coating liquid using the hydroxygallium phthalocyanine pigment subjected to the milling operation was changed as below.

In a sand mill K-800 (manufactured by Aimex, disk diameter: 70 mm, 5 disks) with cooling water of 18° C. were dispersed 22.5 parts of the hydroxygallium phthalocyanine pigment subjected to the milling operation in Photosensitive Member Production Example 8, 7.5 parts of a polyvinyl butyral S-LEC BX-1 (produced by Sekisui Chemical), and 190 parts of cyclohexanone in each other with 482 parts of glass beads of 0.9 mm in diameter for 4 hours. This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 150 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 16

An electrophotographic photosensitive member of Photosensitive Member Production Example 16 was produced in the same manner as in Photosensitive Member Production Example 15, except that the thickness of the charge generating layer was changed from 150 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 17

An electrophotographic photosensitive member of Photosensitive Member Production Example 17 was produced in the same manner as in Photosensitive Member Production Example 8, except that the step of forming the charge generating layer by dipping of a coating liquid using the hydroxygallium phthalocyanine pigment subjected to the milling operation was changed as below.

In a sand mill K-800 (manufactured by Aimex, disk diameter: 70 mm, 5 disks) with cooling water of 18° C. were dispersed 23.3 parts of the hydroxygallium phthalocyanine pigment subjected to the milling operation in Photosensitive Member Production Example 8, 6.7 parts of a polyvinyl butyral S-LEC BX-1 (produced by Sekisui Chemical), and 190 parts of cyclohexanone in each other with 482 parts of glass beads of 0.9 mm in diameter for 4 hours. This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 150 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 18

An electrophotographic photosensitive member of Photosensitive Member Production Example 18 was produced in the same manner as in Photosensitive Member Production Example 17, except that the thickness of the charge generating layer was changed from 150 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 19

An electrophotographic photosensitive member of Photosensitive Member Production Example 19 was produced in the same manner as in Photosensitive Member Production Example 8, except that the step of forming the charge generating layer by dipping of a coating liquid using the hydroxygallium phthalocyanine pigment subjected to the milling operation was changed as below.

In a sand mill K-800 (manufactured by Aimex, disk diameter: 70 mm, 5 disks) with cooling water of 18° C. were dispersed 24 parts of the hydroxygallium phthalocyanine pigment subjected to the milling operation in Photosensitive Member Production Example 8, 6 parts of a polyvinyl butyral S-LEC BX-1 (produced by Sekisui Chemical), and 190 parts of cyclohexanone in each other with 482 parts of glass beads of 0.9 mm in diameter for 4 hours. This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 150 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 20

An electrophotographic photosensitive member of Photosensitive Member Production Example 20 was produced in the same manner as in Photosensitive Member Production Example 19, except that the thickness of the charge generating layer was changed from 150 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 21

An electrophotographic photosensitive member of Photosensitive Member Production Example 21 was produced in the same manner as in Photosensitive Member Production Example 8, except that the thickness of the charge transport layer was changed from 15 μm to 11 μm.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 22

An electrophotographic photosensitive member of Photosensitive Member Production Example 22 was produced in the same manner as in Photosensitive Member Production Example 8, except that the thickness of the charge transport layer was changed from 15 μm to 13 μm.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 23

An electrophotographic photosensitive member of Photosensitive Member Production Example 23 was produced in the same manner as in Photosensitive Member Production Example 8, except that the thickness of the charge transport layer was changed from 15 μm to 17 μm.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 24

An electrophotographic photosensitive member of Photosensitive Member Production Example 24 was produced in the same manner as in Photosensitive Member Production Example 8, except that the thickness of the charge transport layer was changed from 15 μm to 20 μm.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 25

An electrophotographic photosensitive member of Photosensitive Member Production Example 25 was produced in the same manner as in Photosensitive Member Production Example 8, except that the thickness of the charge transport layer was changed from 15 μm to 23 μm.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 26

An electrophotographic photosensitive member of Photosensitive Member Production Example 26 was produced in the same manner as in Photosensitive Member Production Example 8, except that the thickness of the charge transport layer was changed from 15 μm to 27 μm.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 27

An electrophotographic photosensitive member of Photosensitive Member Production Example 27 was produced in the same manner as in Photosensitive Member Production Example 4, except that the first milling operation in the process for producing the hydroxygallium phthalocyanine pigment was changed as below.

In the first milling operation, 1 part of the hydroxygallium phthalocyanine pigment produced in Synthesis Example 3 and 9 parts of N-methylformamide F0059 (manufactured by Tokyo Chemical Industry) were subjected to milling for 30 hours with 15 parts of glass beads of 0.9 mm in diameter by using a sand mill machine K-800 (manufactured by Aimex, disk diameter: 70 mm, 5 disks) with cooling water of 18° C. This operation was performed under the condition where the disks were rotated at 800 rpm. The liquid subjected to the milling operation was filtered through a filter (N-NO. 125T, pore size: 133 μm, manufactured by NBC Meshtec) to remove the glass beads. The resulting liquid was further subjected to milling (second milling operation) at room temperature (23° C.) for 1,000 hours by using a ball mill machine. This operation was performed in the standard bottle PS-6 (manufactured by Hakuyo Glass) under the condition where the bottle was rotated at a speed of 120 rpm. In this operation, media, such as glass beads, were not used. After adding 30 parts of N-methylformamide to the resulting liquid, the mixture was filtered, and the filtration product remaining on the filter was sufficiently washed with tetrahydrofuran. Then, the resulting filtration product was vacuum-dried to yield 0.44 part of a hydroxygallium phthalocyanine pigment. The crystallite correlation length r of the resulting pigment, which was estimated from the peak at 7.5°±0.2° that was the strongest of the peaks in the CuKα X-ray diffraction spectrum, was 31 nm. The content of the amide compound (N-methylformamide) represented by formula (A1) in the hydroxygallium phthalocyanine crystalline particles, which was estimated by $^{1}$H-NMR analysis, was 1.5% by mass relative to the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 28

An electrophotographic photosensitive member of Photosensitive Member Production Example 28 was produced in the same manner as in Photosensitive Member Production Example 27, except that the time for the second milling operation using the ball mill machine was changed from 1,000 hours to 2,000 hours. The content of the amide compound (N-methylformamide) represented by formula (A1) in the hydroxygallium phthalocyanine crystalline particles of the pigment, which was estimated by $^{1}$H-NMR analysis, was 1.3% by mass relative to the mass of the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 29

An electrophotographic photosensitive member of Photosensitive Member Production Example 29 was produced in the same manner as in Photosensitive Member Production Example 27, except that the second milling operation in the process for producing the hydroxygallium phthalocyanine pigment was changed as below.

In the first milling operation, 1 part of the hydroxygallium phthalocyanine pigment produced in Synthesis Example 3 and 9 parts of N-methylformamide F0059 (manufactured by Tokyo Chemical Industry) were subjected to milling for 30 hours with 15 parts of glass beads of 0.9 mm in diameter by using a sand mill machine K-800 (manufactured by Aimex, disk diameter: 70 mm, 5 disks) with cooling water of 18° C. This operation was performed under the condition where the disks were rotated at 800 rpm. The resulting liquid was further subjected to milling (second milling operation) at room temperature (23° C.) for 100 hours by using a ball mill machine. For this operation, the liquid subjected to the milling operation using the sand mill machine was removed together with the glass beads to a container, and the container was rotated at a speed of 120 rpm. Hence, both the first and the second milling operation were performed with the same glass beads. This container used for this operation was the standard bottle PS-6 (manufactured by Hakuyo Glass). The liquid subjected to this operation was filtered through a filter (N-NO. 125T, pore size: 133 μm, manufactured by NBC Meshtec) to remove the glass beads. After adding 30 parts of N-methylformamide to the resulting liquid, the mixture was filtered, and the filtration product remaining on the filter was sufficiently washed with tetrahydrofuran. Then, the resulting filtration product was vacuum-dried to yield 0.45 part of a hydroxygallium phthalocyanine pigment. The crystallite correlation length r of the resulting pigment, which was estimated from the peak at 7.5°±0.2° that was the strongest of the peaks in the CuKα X-ray diffraction spectrum, was 27 nm. The content of the amide compound (N-methylformamide) represented by formula (A1) in the hydroxygallium phthalocyanine crystalline particles, which was estimated by $^{1}$H-NMR analysis, was 1.7% by mass relative to the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 30

An electrophotographic photosensitive member of Photosensitive Member Production Example 30 was produced in the same manner as in Photosensitive Member Production Example 29, except that the time for the second milling operation using the ball mill machine was changed from 100 hours to 300 hours. The content of the amide compound (N-methylformamide) represented by formula (A1) in the hydroxygallium phthalocyanine crystalline particles of the pigment, which was estimated by $^{1}$H-NMR analysis, was 1.3% by mass relative to the mass of the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 31

An electrophotographic photosensitive member of Photosensitive Member Production Example 31 was produced in the same manner as in Photosensitive Member Production Example 29, except that the time for the second milling operation using the ball mill machine was changed from 100 hours to 1,000 hours. The content of the amide compound (N-methylformamide) represented by formula (A1) in the hydroxygallium phthalocyanine crystalline particles of the pigment, which was estimated by $^{1}$H-NMR analysis, was 0.8% by mass relative to the mass of the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 32

An electrophotographic photosensitive member of Photosensitive Member Production Example 32 was produced in the same manner as in Photosensitive Member Production Example 29, except that the time for the second milling operation using the ball mill machine was changed from 100 hours to 2,000 hours. The content of the amide compound (N-methylformamide) represented by formula (A1) in the hydroxygallium phthalocyanine crystalline particles of the pigment, which was estimated by $^{1}$H-NMR analysis, was 0.6% by mass relative to the mass of the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 33

An electrophotographic photosensitive member of Photosensitive Member Production Example 33 was produced in the same manner as in Photosensitive Member Production Example 1, except that the second milling operation in the process for producing the hydroxygallium phthalocyanine pigment was changed as below.

In the first milling operation, 0.5 part of the hydroxygallium phthalocyanine pigment produced in Synthesis Example 3 and 9.5 parts of N-methylformamide F0059 (produced by Tokyo Chemical Industry) were subjected to milling with 15 parts of glass beads of 0.9 mm in diameter with a paint shaker (manufactured by Toyo Seiki) at room temperature (23° C.) for 6 hours. For this operation, a standard bottle PS-6 (manufactured by Hakuyo Glass) was used as the container. The liquid subjected to the milling operation was filtered through a filter (N-NO. 125T, pore size: 133 μm, manufactured by NBC Meshtec) to remove the glass beads. The resulting liquid was further subjected to milling (second milling operation) with a magnetic stirrer at room temperature (23° C.) for 100 hours. This operation was performed in the standard bottle PS-6 (manufactured by Hakuyo Glass) under the condition where the stirring bar was rotated at a speed of 1,500 rpm. In this operation, media, such as glass beads, were not used. After adding 30 parts of N-methylformamide to the resulting liquid, the mixture was filtered, and the filtration product remaining on the filter was sufficiently washed with tetrahydrofuran. Then, the resulting filtration product was vacuum-dried to yield 0.46 part of a hydroxygallium phthalocyanine pigment. The crystallite correlation length r of the resulting pigment, which was estimated from the peak at 7.5°±0.2° that was the strongest of the peaks in the CuKα X-ray diffraction spectrum, was 34 nm. The content of the amide compound (N-methylformamide) represented by formula (A1) in the hydroxygallium phthalocyanine crystalline particles, which was estimated by $^{1}$H-NMR analysis, was 2.7% by mass relative to the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 34

An electrophotographic photosensitive member of Photosensitive Member Production Example 34 was produced in the same manner as in Photosensitive Member Production Example 33, except that the time for the second milling operation using the magnetic stirrer was changed from 100 hours to 300 hours. The content of the amide compound (N-methylformamide) represented by formula (A1) in the hydroxygallium phthalocyanine crystalline particles of the pigment, which was estimated by $^{1}$H-NMR analysis, was 2.5% by mass relative to the mass of the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 35

An electrophotographic photosensitive member of Photosensitive Member Production Example 35 was produced in the same manner as in Photosensitive Member Production Example 1, except that the second milling operation in the process for producing the hydroxygallium phthalocyanine pigment was changed as below.

In the first milling operation, 0.5 part of the hydroxygallium phthalocyanine pigment produced in Synthesis Example 3 and 9.5 parts of N-methylformamide F0059 (produced by Tokyo Chemical Industry) were subjected to milling with 15 parts of glass beads of 0.9 mm in diameter with a paint shaker (manufactured by Toyo Seiki) at room temperature (23° C.) for 6 hours. For this operation, a standard bottle PS-6 (manufactured by Hakuyo Glass) was used as the container. The liquid subjected to the milling operation was filtered through a filter (N-NO. 125T, pore size: 133 μm, manufactured by NBC Meshtec) to remove the glass beads. The resulting liquid was further subjected to milling (second milling operation) with an ultrasonic disperser UT-205 (manufactured by Sharp) at room temperature (23° C.) for 10 hours. For this operation, a standard bottle PS-6 (manufactured by Hakuyo Glass) was used as the container, and the power of the ultrasonic disperser was 100%. In this operation, media, such as glass beads, were not used. After adding 30 parts of N-methylformamide to the resulting liquid, the mixture was filtered, and the filtration product remaining on the filter was sufficiently washed with tetrahydrofuran. Then, the resulting filtration product was vacuum-dried to yield 0.46 part of a hydroxygallium phthalocyanine pigment. The crystallite correlation length r of the resulting pigment, which was estimated from the peak at 7.5°±0.2° that was the strongest of the peaks in the CuKα X-ray diffraction spectrum, was 29 nm. The content of the amide compound (N-methylformamide) represented by formula (A1) in the hydroxygallium phthalocyanine crystalline particles, which was estimated by 1H-NMR analysis, was 2.9% by mass relative to the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 36

An electrophotographic photosensitive member of Photosensitive Member Production Example 36 was produced in the same manner as in Photosensitive Member Production Example 35, except that the time for the second milling operation using the ultrasonic disperser was changed from 10 hours to 30 hours. The content of the amide compound (N-methylformamide) represented by formula (A1) in the hydroxygallium phthalocyanine crystalline particles of the pigment, which was estimated by $^{1}$H-NMR analysis, was 2.7% by mass relative to the mass of the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 37

An electrophotographic photosensitive member of Photosensitive Member Production Example 37 was produced in the same manner as in Photosensitive Member Production Example 1, except that the process for producing the hydroxygallium phthalocyanine pigment was changed as below.

In a sand mill K-800 (manufactured by Aimex, disk diameter: 70 mm, 5 disks) with cooling water of 18° C., 1 part of the hydroxygallium phthalocyanine pigment produced in Synthesis Example 3 and 9 parts of N-methylformamide F0059 (manufactured by Tokyo Chemical Industry) were subjected to milling for 70 hours with 15 parts of glass beads of 0.9 mm in diameter. This operation was performed under the condition where the disks were rotated at 400 rpm.

After adding 30 parts of N-methylformamide to the resulting liquid, the mixture was filtered, and the filtration product remaining on the filter was sufficiently washed with tetrahydrofuran. Then, the resulting filtration product was vacuum-dried to yield 0.45 part of a hydroxygallium phthalocyanine pigment.

The resulting pigment was exhibited peaks at Bragg angles 2θ of 7.5°±0.2°, 9.9°±0.2°, 16.2°±0.2°, 18.6°±0.2°, 25.2°±0.2°, and 28.3°±0.2° in the CuKα X-ray diffraction spectrum thereof (FIG. 2). The crystallite correlation length r, which was estimated from the peak at 7.5°±0.2° that was the strongest of the peaks in the range of 5° to 35°, was 27 nm. The content of the amide compound (N-methylformamide) represented by formula (A1) in the hydroxygallium phthalocyanine crystalline particles, which was estimated by $^{1}$H-NMR analysis, was 1.5% by mass relative to the hydroxygallium phthalocyanine.

An SEM micrograph of the thus produced hydroxygallium phthalocyanine pigment in the charge generating layer is shown in FIG. 1. Also, the physical properties of the phthalocyanine pigment, the charge generating layer, and the electrophotographic photosensitive member that were produced as just described were shown in Table 1.

Photosensitive Member Production Example 38

An electrophotographic photosensitive member of Photosensitive Member Production Example 38 was produced in the same manner as in Photosensitive Member Production Example 37, except that the time for the milling operation using the sand mill was changed from 70 hours to 100 hours. The content of the amide compound (N-methylformamide) represented by formula (A1) in the hydroxygallium phthalocyanine crystalline particles of the pigment, which was estimated by $^{1}$H-NMR analysis, was 0.9% by mass relative to the mass of the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 39

An electrophotographic photosensitive member of Photosensitive Member Production Example 39 was produced in the same manner as in Photosensitive Member Production Example 37, except that the thickness of the charge generating layer was changed from 150 nm to 130 nm.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 40

An electrophotographic photosensitive member of Photosensitive Member Production Example 40 was produced in the same manner as in Photosensitive Member Production Example 37, except that the thickness of the charge generating layer was changed from 150 nm to 170 nm.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 41

An electrophotographic photosensitive member of Photosensitive Member Production Example 41 was produced in the same manner as in Photosensitive Member Production Example 37, except that the thickness of the charge generating layer was changed from 150 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 42

An electrophotographic photosensitive member of Photosensitive Member Production Example 42 was produced in the same manner as in Photosensitive Member Production Example 37, except that the step of forming the charge generating layer by dipping of a coating liquid using the hydroxygallium phthalocyanine pigment subjected to the milling operation was changed as below.

In a sand mill K-800 (manufactured by Aimex, disk diameter: 70 mm, 5 disks) were dispersed 18 parts of the hydroxygallium phthalocyanine pigment subjected to the milling operation in Photosensitive Member Production Example 37, 12 parts of a polyvinyl butyral S-LEC BX-1 (produced by Sekisui Chemical), and 190 parts of cyclohexanone in each other with 482 parts of glass beads of 0.9 mm in diameter for 4 hours with cooling water of 18° C. This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 190 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 43

An electrophotographic photosensitive member of Photosensitive Member Production Example 43 was produced in the same manner as in Photosensitive Member Production Example 37, except that the step of forming the charge generating layer by dipping of a coating liquid using the hydroxygallium phthalocyanine pigment subjected to the milling operation was changed as below.

In a sand mill K-800 (manufactured by Aimex, disk diameter: 70 mm, 5 disks) were dispersed 22.5 parts of the hydroxygallium phthalocyanine pigment subjected to the milling operation in Photosensitive Member Production Example 37, 7.5 parts of a polyvinyl butyral S-LEC BX-1 (produced by Sekisui Chemical), and 190 parts of cyclohexanone in each other with 482 parts of glass beads of 0.9 mm in diameter for 4 hours with cooling water of 18° C.

This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 150 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 44

An electrophotographic photosensitive member of Photosensitive Member Production Example 44 was produced in the same manner as in Photosensitive Member Production Example 43, except that the thickness of the charge generating layer was changed from 150 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 45

An electrophotographic photosensitive member of Photosensitive Member Production Example 45 was produced in the same manner as in Photosensitive Member Production Example 37, except that the step of forming the charge generating layer by dipping of a coating liquid using the hydroxygallium phthalocyanine pigment subjected to the milling operation was changed as below.

In a sand mill K-800 (manufactured by Aimex, disk diameter: 70 mm, 5 disks) were dispersed 23.3 parts of the hydroxygallium phthalocyanine pigment subjected to the milling operation in Photosensitive Member Production Example 37, 6.7 parts of a polyvinyl butyral S-LEC BX-1 (produced by Sekisui Chemical), and 190 parts of cyclohexanone in each other with 482 parts of glass beads of 0.9 mm in diameter for 4 hours with cooling water of 18° C. This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 150 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 46

An electrophotographic photosensitive member of Photosensitive Member Production Example 46 was produced in the same manner as in Photosensitive Member Production Example 45, except that the thickness of the charge generating layer was changed from 150 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 47

An electrophotographic photosensitive member of Photosensitive Member Production Example 47 was produced in the same manner as in Photosensitive Member Production Example 37, except that the step of forming the charge generating layer by dipping of a coating liquid using the hydroxygallium phthalocyanine pigment subjected to the milling operation was changed as below.

In a sand mill K-800 (manufactured by Aimex, disk diameter: 70 mm, 5 disks) were dispersed 24 parts of the hydroxygallium phthalocyanine pigment subjected to the milling operation in Photosensitive Member Production Example 37, 6 parts of a polyvinyl butyral S-LEC BX-1 (produced by Sekisui Chemical), and 190 parts of cyclohexanone in each other with 482 parts of glass beads of 0.9 mm in diameter for 4 hours with cooling water of 18° C. This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 150 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 48

An electrophotographic photosensitive member of Photosensitive Member Production Example 48 was produced in the same manner as in Photosensitive Member Production Example 47, except that the thickness of the charge generating layer was changed from 150 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 49

An electrophotographic photosensitive member of Photosensitive Member Production Example 49 was produced in the same manner as in Photosensitive Member Production Example 37, except that the thickness of the charge transport layer was changed from 15 μm to 11 μm.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 50

An electrophotographic photosensitive member of Photosensitive Member Production Example 50 was produced in the same manner as in Photosensitive Member Production Example 37, except that the thickness of the charge transport layer was changed from 15 μm to 13 μm.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 51

An electrophotographic photosensitive member of Photosensitive Member Production Example 51 was produced in the same manner as in Photosensitive Member Production Example 37, except that the thickness of the charge transport layer was changed from 15 μm to 17 μm.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 52

An electrophotographic photosensitive member of Photosensitive Member Production Example 52 was produced in the same manner as in Photosensitive Member Production Example 37, except that the thickness of the charge transport layer was changed from 15 μm to 20 μm.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 53

An electrophotographic photosensitive member of Photosensitive Member Production Example 53 was produced in the same manner as in Photosensitive Member Production Example 37, except that the thickness of the charge transport layer was changed from 15 μm to 23 μm.

The physical properties of the phthalocyanine pigment, the charge generating layer, and the electrophotographic photosensitive member that were produced as just described were determined in the same manner as in Photosensitive Member Production Example 1, and the results are shown in Table 1.

Photosensitive Member Production Example 54

An electrophotographic photosensitive member of Photosensitive Member Production Example 54 was produced in the same manner as in Photosensitive Member Production Example 37, except that the thickness of the charge transport layer was changed from 15 μm to 27 μm.

The physical properties of the phthalocyanine pigment, the charge generating layer, and the electrophotographic photosensitive member that were produced as just described were determined in the same manner as in Photosensitive Member Production Example 1, and the results are shown in Table 1.

TABLE 1

Physical Properties of Phthalocyanine Pigments and Photosensitive Members

| Photosensitive Member Production Example No. | Pigment | Crystallite correlation length r [nm] | Crystalline particle size R [nm] | k = r/R | Charge generating layer thickness d [nm] | Volume ratio P of charge generating material | Absorption coefficient α [$nm^{-1}$] | Charge transport layer thickness [μm] | $\Phi_i \cdot \Psi_i$ |
|---|---|---|---|---|---|---|---|---|---|
| Photosensitive Member Production Example 1 | HOGaPc | 31 | 125 | 0.25 | 150 | 0.58 | 0.0055 | 15 | 0.34 |
| Photosensitive Member Production Example 2 | HOGaPc | 31 | 118 | 0.26 | 150 | 0.58 | 0.0055 | 15 | 0.35 |
| Photosensitive Member Production Example 3 | HOGaPc | 34 | 111 | 0.30 | 150 | 0.58 | 0.0055 | 15 | 0.36 |
| Photosensitive Member Production Example 4 | HOGaPc | 34 | 105 | 0.32 | 150 | 0.58 | 0.0055 | 15 | 0.37 |
| Photosensitive Member Production Example 5 | HOGaPc | 36 | 102 | 0.35 | 150 | 0.58 | 0.0055 | 15 | 0.37 |
| Photosensitive Member Production Example 6 | HOGaPc | 27 | 121 | 0.22 | 150 | 0.58 | 0.0055 | 15 | 0.32 |
| Photosensitive Member Production Example 7 | HOGaPc | 29 | 110 | 0.26 | 150 | 0.58 | 0.0055 | 15 | 0.34 |
| Photosensitive Member Production Example 8 | HOGaPc | 29 | 93 | 0.31 | 150 | 0.58 | 0.0055 | 15 | 0.37 |
| Photosensitive Member Production Example 9 | HOGaPc | 31 | 83 | 0.38 | 150 | 0.58 | 0.0055 | 15 | 0.38 |
| Photosensitive Member Production Example 10 | HOGaPc | 34 | 81 | 0.41 | 150 | 0.58 | 0.0055 | 15 | 0.38 |
| Photosensitive Member Production Example 11 | HOGaPc | 29 | 93 | 0.31 | 130 | 0.58 | 0.0055 | 15 | 0.32 |
| Photosensitive Member Production Example 12 | HOGaPc | 29 | 93 | 0.31 | 170 | 0.58 | 0.0055 | 15 | 0.41 |
| Photosensitive Member Production Example 13 | HOGaPc | 29 | 93 | 0.31 | 190 | 0.58 | 0.0055 | 15 | 0.44 |
| Photosensitive Member Production Example 14 | HOGaPc | 29 | 93 | 0.31 | 190 | 0.51 | 0.0049 | 15 | 0.36 |
| Photosensitive Member Production Example 15 | HOGaPc | 29 | 93 | 0.31 | 150 | 0.67 | 0.0064 | 15 | 0.45 |
| Photosensitive Member Production Example 16 | HOGaPc | 29 | 93 | 0.31 | 190 | 0.67 | 0.0064 | 15 | 0.54 |
| Photosensitive Member Production Example 17 | HOGaPc | 29 | 93 | 0.31 | 150 | 0.71 | 0.0068 | 15 | 0.48 |
| Photosensitive Member Production Example 18 | HOGaPc | 29 | 93 | 0.31 | 190 | 0.71 | 0.0068 | 15 | 0.58 |
| Photosensitive Member Production Example 19 | HOGaPc | 29 | 93 | 0.31 | 150 | 0.73 | 0.0070 | 15 | 0.51 |
| Photosensitive Member Production Example 20 | HOGaPc | 29 | 93 | 0.31 | 190 | 0.73 | 0.0070 | 15 | 0.61 |
| Photosensitive Member Production Example 21 | HOGaPc | 29 | 93 | 0.31 | 150 | 0.58 | 0.0055 | 11 | 0.37 |
| Photosensitive Member Production Example 22 | HOGaPc | 29 | 93 | 0.31 | 150 | 0.58 | 0.0055 | 13 | 0.37 |
| Photosensitive Member Production Example 23 | HOGaPc | 29 | 93 | 0.31 | 150 | 0.58 | 0.0055 | 17 | 0.37 |
| Photosensitive Member Production Example 24 | HOGaPc | 29 | 93 | 0.31 | 150 | 0.58 | 0.0055 | 20 | 0.37 |

TABLE 1-continued

Physical Properties of Phthalocyanine Pigments and Photosensitive Members

| Photosensitive Member Production Example No. | Pigment | Crystallite correlation length r [nm] | Crystalline particle size R [nm] | k = r/R | Charge generating layer thickness d [nm] | Volume ratio P of charge generating material | Absorption coefficient α [$nm^{-1}$] | Charge transport layer thickness [μm] | $\Phi_i \cdot \Psi_i$ |
|---|---|---|---|---|---|---|---|---|---|
| Photosensitive Member Production Example 25 | HOGaPc | 29 | 93 | 0.31 | 150 | 0.58 | 0.0055 | 23 | 0.37 |
| Photosensitive Member Production Example 26 | HOGaPc | 29 | 93 | 0.31 | 150 | 0.58 | 0.0055 | 27 | 0.37 |
| Photosensitive Member Production Example 27 | HOGaPc | 31 | 111 | 0.28 | 150 | 0.58 | 0.0055 | 15 | 0.34 |
| Photosensitive Member Production Example 28 | HOGaPc | 34 | 110 | 0.31 | 150 | 0.58 | 0.0055 | 15 | 0.36 |
| Photosensitive Member Production Example 29 | HOGaPc | 27 | 115 | 0.23 | 150 | 0.58 | 0.0055 | 15 | 0.32 |
| Photosensitive Member Production Example 30 | HOGaPc | 29 | 95 | 0.31 | 150 | 0.58 | 0.0055 | 15 | 0.35 |
| Photosensitive Member Production Example 31 | HOGaPc | 31 | 87 | 0.36 | 150 | 0.58 | 0.0055 | 15 | 0.35 |
| Photosensitive Member Production Example 32 | HOGaPc | 34 | 84 | 0.40 | 150 | 0.58 | 0.0055 | 15 | 0.37 |
| Photosensitive Member Production Example 33 | HOGaPc | 34 | 125 | 0.27 | 150 | 0.58 | 0.0055 | 15 | 0.34 |
| Photosensitive Member Production Example 34 | HOGaPc | 34 | 122 | 0.28 | 150 | 0.58 | 0.0055 | 15 | 0.34 |
| Photosensitive Member Production Example 35 | HOGaPc | 29 | 137 | 0.21 | 150 | 0.58 | 0.0055 | 15 | 0.32 |
| Photosensitive Member Production Example 36 | HOGaPc | 29 | 134 | 0.22 | 150 | 0.58 | 0.0055 | 15 | 0.32 |
| Photosensitive Member Production Example 37 | HOGaPc | 27 | 122 | 0.22 | 150 | 0.58 | 0.0055 | 15 | 0.34 |
| Photosensitive Member Production Example 38 | HOGaPc | 27 | 143 | 0.19 | 150 | 0.58 | 0.0055 | 15 | 0.33 |
| Photosensitive Member Production Example 39 | HOGaPc | 27 | 122 | 0.22 | 130 | 0.58 | 0.0055 | 15 | 0.32 |
| Photosensitive Member Production Example 40 | HOGaPc | 27 | 122 | 0.22 | 170 | 0.58 | 0.0055 | 15 | 0.38 |
| Photosensitive Member Production Example 41 | HOGaPc | 27 | 122 | 0.22 | 190 | 0.58 | 0.0055 | 15 | 0.42 |
| Photosensitive Member Production Example 42 | HOGaPc | 27 | 122 | 0.22 | 190 | 0.51 | 0.0049 | 15 | 0.34 |
| Photosensitive Member Production Example 43 | HOGaPc | 27 | 122 | 0.22 | 150 | 0.67 | 0.0064 | 15 | 0.43 |
| Photosensitive Member Production Example 44 | HOGaPc | 27 | 122 | 0.22 | 190 | 0.67 | 0.0064 | 15 | 0.52 |
| Photosensitive Member Production Example 45 | HOGaPc | 27 | 122 | 0.22 | 150 | 0.71 | 0.0068 | 15 | 0.46 |
| Photosensitive Member Production Example 46 | HOGaPc | 27 | 122 | 0.22 | 190 | 0.71 | 0.0068 | 15 | 0.56 |
| Photosensitive Member Production Example 47 | HOGaPc | 27 | 122 | 0.22 | 150 | 0.73 | 0.0070 | 15 | 0.49 |
| Photosensitive Member Production Example 48 | HOGaPc | 27 | 122 | 0.22 | 190 | 0.73 | 0.0070 | 15 | 0.59 |
| Photosensitive Member Production Example 49 | HOGaPc | 27 | 122 | 0.22 | 150 | 0.58 | 0.0055 | 11 | 0.34 |
| Photosensitive Member Production Example 50 | HOGaPc | 27 | 122 | 0.22 | 150 | 0.58 | 0.0055 | 13 | 0.34 |
| Photosensitive Member Production Example 51 | HOGaPc | 27 | 122 | 0.22 | 150 | 0.58 | 0.0055 | 17 | 0.34 |
| Photosensitive Member Production Example 52 | HOGaPc | 27 | 122 | 0.22 | 150 | 0.58 | 0.0055 | 20 | 0.34 |
| Photosensitive Member Production Example 53 | HOGaPc | 27 | 122 | 0.22 | 150 | 0.58 | 0.0055 | 23 | 0.34 |
| Photosensitive Member Production Example 54 | HOGaPc | 27 | 122 | 0.22 | 150 | 0.58 | 0.0055 | 27 | 0.34 |

Photosensitive Member Production Example 55

An electrophotographic photosensitive member of Photosensitive Member Production Example 55 was produced in the same manner as in Photosensitive Member Production Example 1, except that the step of forming the charge generating layer was changed as below.

In the first milling operation, 0.5 part of the hydroxygallium phthalocyanine pigment produced in Synthesis Example 3 and 9.5 parts of N,N-dimethylformamide D0722 (produced by Tokyo Chemical Industry) were subjected to milling with 15 parts of glass beads of 0.9 mm in diameter with a paint shaker (manufactured by Toyo Seiki) at room temperature (23° C.) for 6 hours. For this operation, a standard bottle PS-6 (manufactured by Hakuyo Glass) was used as the container. The liquid subjected to the milling operation was filtered through a filter (N-NO. 125T, pore size: 133 μm, manufactured by NBC Meshtec) to remove the glass beads. The resulting liquid was further subjected to milling (second milling operation) at room temperature (23° C.) for 1,000 hours by using a ball mill machine. This operation was performed in the standard bottle PS-6 (manufactured by Hakuyo Glass) under the condition where the bottle was rotated at a speed of 120 rpm. In this operation, media, such as glass beads, were not used. After adding 30 parts of N,N-dimethylformamide to the resulting liquid, the mixture was filtered, and the filtration product remaining on the filter was sufficiently washed with tetrahydrofuran. Then, the resulting filtration product was vacuum-dried to yield 0.47 part of a hydroxygallium phthalocyanine pigment. The crystallite correlation length r of the resulting pigment, which was estimated from the peak at 7.5°±0.2° that was the strongest of the peaks in the CuKα X-ray diffraction spectrum, was 36 nm.

Subsequently, 20 parts of the hydroxygallium phthalocyanine pigment subjected to the above-described milling operation, 10 parts of a polyvinyl butyral S-LEC BX-1 (produced by Sekisui Chemical), and 190 parts of cyclohexanone were dispersed in each other with 482 parts of glass beads of 0.9 mm in diameter in a sand mill K-800 (manufactured by Aimex, disk diameter: 70 mm, 5 disks) for 4 hours with cooling water of 18° C. This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 170 nm-thick charge generating layer.

The hydroxygallium phthalocyanine pigment had a specific gravity of 1.6, and polyvinyl butyral used as the binder resin had a specific gravity of 1.1. Therefore, the ratio P of the volume of the charge generating material to the total volume of the charge generating layer was calculated to be 0.58. The volume average particle size R of the hydroxygallium phthalocyanine pigment in the charge generating layer, which was estimated from the particle size distribution obtained using the SEM micrograph, was 148 nm. From the crystallite correlation length r and the volume average particle diameter R, parameter k (=r/R) was 0.24. For satisfying P·d/R>1, the thickness d [nm] of the charge generating layer is required to satisfy the relationship d>256. Accordingly, charge generating layers having five respective thicknesses of 260, 300, 350, 400, and 450 were formed on a PET film (polyethylene terephthalate film), and the light transmittance of these charge generating layers was measured with a goniometer, together with a simple PET film sample for correction. The absorption coefficient $\alpha$ calculated from the measurement results was $\alpha$=0.0042 [$nm^{-1}$].

Also, $\Phi_i$ was determined for each particle by substituting the diameter $R_i$ [nm] of each particle in the particle size distribution estimated from the SEM micrograph and k=0.24 into equation (E1), and $\Psi_i$ was determined for each particle by substituting the diameter $R_i$ [nm] of each particle, the above absorption coefficient $\alpha$=0.0042 [$nm^{-1}$], the thickness d=170 [nm], and the ratio P=0.58 of the volume of the charge generating material to the total volume of the charge generating layer into equation (E2). From these results, the volume average of the products of $\Phi_i$ and $\Psi_i$ in the particle size distribution calculated by equation (E15) was 0.33.

The physical properties of the phthalocyanine pigment, the charge generating layer, and the electrophotographic photosensitive member that were produced as just described were shown in Table 2.

Photosensitive Member Production Example 56

An electrophotographic photosensitive member of Photosensitive Member Production Example 56 was produced in the same manner as in Photosensitive Member Production Example 55, except that the time for the second milling operation using the ball mill machine was changed from 1,000 hours to 2,000 hours.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 57

An electrophotographic photosensitive member of Photosensitive Member Production Example 57 was produced in the same manner as in Photosensitive Member Production Example 55, except that the second milling operation in the process for producing the hydroxygallium phthalocyanine pigment was changed as below.

In the first milling operation, 0.5 part of the hydroxygallium phthalocyanine pigment produced in Synthesis Example 3 and 9.5 parts of N,N-dimethylformamide D0722 (produced by Tokyo Chemical Industry) were subjected to milling with 15 parts of glass beads of 0.9 mm in diameter with a paint shaker (manufactured by Toyo Seiki) at room temperature (23° C.) for 6 hours. For this operation, a standard bottle PS-6 (manufactured by Hakuyo Glass) was used as the container. The resulting liquid was further subjected to milling (second milling operation) at room temperature (23° C.) for 300 hours by using a ball mill machine. For this operation, the container was set to the ball mill machine as it was without removing the contents therefrom, and the container was rotated at a speed of 120 rpm. Hence, both the first and the second milling operation were performed with the same glass beads. The liquid subjected to this operation was filtered through a filter (N-NO. 125T, pore size: 133 μm, manufactured by NBC Meshtec) to remove the glass beads. After adding 30 parts of N,N-dimethylformamide to the resulting liquid, the mixture was filtered, and the filtration product remaining on the filter was sufficiently washed with tetrahydrofuran. Then, the resulting filtration product was vacuum-dried to yield 0.47 part of a hydroxygallium phthalocyanine pigment. The crystallite correlation length r of the resulting pigment, which was estimated from the peak at 7.5°±0.2° that was the strongest of the peaks in the CuK$\alpha$ X-ray diffraction spectrum, was 36 nm.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 58

An electrophotographic photosensitive member of Photosensitive Member Production Example 58 was produced in the same manner as in Photosensitive Member Production Example 57, except that the time for the second milling operation using the ball mill machine was changed from 300 hours to 1,000 hours.

The physical properties of the phthalocyanine pigment, the charge generating layer, and the electrophotographic photosensitive member that where produced as just described were determined in the same manner as in Photosensitive Member Production Example 1, and the results are shown in Table 2.

Photosensitive Member Production Example 59

An electrophotographic photosensitive member of Photosensitive Member Production Example 59 was produced in the same manner as in Photosensitive Member Production Example 57, except that the time for the second milling operation using the ball mill machine was changed from 300 hours to 2,000 hours.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 60

An electrophotographic photosensitive member of Photosensitive Member Production Example 60 was produced in the same manner as in Photosensitive Member Production Example 59, except that the thickness of the charge generating layer was changed from 170 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 61

An electrophotographic photosensitive member of Photosensitive Member Production Example 61 was produced in the same manner as in Photosensitive Member Production Example 59, except that the step of forming the charge generating layer by dipping of a coating liquid using the hydroxygallium phthalocyanine pigment subjected to the milling operation was changed as below.

In a sand mill K-800 (manufactured by Aimex, disk diameter: 70 mm, 5 disks) were dispersed 22.5 parts of the hydroxygallium phthalocyanine pigment subjected to the milling operation in Photosensitive Member Production Example 59, 7.5 parts of a polyvinyl butyral S-LEC BX-1 (produced by Sekisui Chemical), and 190 parts of cyclohexanone in each other with 482 parts of glass beads of 0.9 mm in diameter for 4 hours with cooling water of 18° C. This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 170 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 62

An electrophotographic photosensitive member of Photosensitive Member Production Example 62 was produced in the same manner as in Photosensitive Member Production Example 61, except that the thickness of the charge generating layer was changed from 170 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 63

An electrophotographic photosensitive member of Photosensitive Member Production Example 63 was produced in the same manner as in Photosensitive Member Production Example 59, except that the step of forming the charge generating layer by dipping of a coating liquid using the hydroxygallium phthalocyanine pigment subjected to the milling operation was changed as below.

In a sand mill K-800 (manufactured by Aimex, disk diameter: 70 mm, 5 disks) were dispersed 23.3 parts of the hydroxygallium phthalocyanine pigment subjected to the milling operation in Photosensitive Member Production Example 59, 6.7 parts of a polyvinyl butyral S-LEC BX-1 (produced by Sekisui Chemical), and 190 parts of cyclohexanone in each other with 482 parts of glass beads of 0.9 mm in diameter for 4 hours with cooling water of 18° C. This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 170 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 64

An electrophotographic photosensitive member of Photosensitive Member Production Example 64 was produced in the same manner as in Photosensitive Member Production Example 63, except that the thickness of the charge generating layer was changed from 170 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 65

An electrophotographic photosensitive member of Photosensitive Member Production Example 65 was produced in the same manner as in Photosensitive Member Production Example 59, except that the step of forming the charge generating layer by dipping of a coating liquid using the hydroxygallium phthalocyanine pigment subjected to the milling operation was changed as below.

In a sand mill K-800 (manufactured by Aimex, disk diameter: 70 mm, 5 disks) were dispersed 24 parts of the hydroxygallium phthalocyanine pigment subjected to the milling operation in Photosensitive Member Production Example 59, 6 parts of a polyvinyl butyral S-LEC BX-1 (produced by Sekisui Chemical), and 190 parts of cyclohexanone in each other with 482 parts of glass beads of 0.9 mm in diameter for 4 hours with cooling water of 18° C. This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 170 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 66

An electrophotographic photosensitive member of Photosensitive Member Production Example 66 was produced in the same manner as in Photosensitive Member Production Example 65, except that the thickness of the charge generating layer was changed from 170 nm to 190 nm.

The physical properties of the phthalocyanine pigment, the charge generating layer, and the electrophotographic photosensitive member that were produced as just described and were determined in the same manner as in Photosensitive Member Production Example 1, and the results are shown in Table 2.

Photosensitive Member Production Example 67

An electrophotographic photosensitive member of Photosensitive Member Production Example 67 was produced in the same manner as in Photosensitive Member Production Example 59, except that the thickness of the charge transport layer was changed from 15 μm to 11 μm.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 68

An electrophotographic photosensitive member of Photosensitive Member Production Example 68 was produced in the same manner as in Photosensitive Member Production Example 59, except that the thickness of the charge transport layer was changed from 15 μm to 13 μm.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 69

An electrophotographic photosensitive member of Photosensitive Member Production Example 69 was produced in the same manner as in Photosensitive Member Production Example 59, except that the thickness of the charge transport layer was changed from 15 μm to 17 μm.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 70

An electrophotographic photosensitive member of Photosensitive Member Production Example 70 was produced in the same manner as in Photosensitive Member Production Example 59, except that the thickness of the charge transport layer was changed from 15 μm to 20 μm.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 71

An electrophotographic photosensitive member of Photosensitive Member Production Example 71 was produced in the same manner as in Photosensitive Member Production Example 59, except that the thickness of the charge transport layer was changed from 15 μm to 23 μm.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 72

An electrophotographic photosensitive member of Photosensitive Member Production Example 72 was produced in the same manner as in Photosensitive Member Production Example 59, except that the thickness of the charge transport layer was changed from 15 μm to 27 μm.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 73

An electrophotographic photosensitive member of Photosensitive Member Production Example 73 was produced in the same manner as in Photosensitive Member Production Example 1, except that the step of forming the charge generating layer was changed as below.

In the first milling operation, 0.5 part of the hydroxygallium phthalocyanine pigment produced in Synthesis Example 3 and 9.5 parts of dimethyl sulfoxide D0798 (manufactured by Tokyo Chemical Industry) were subjected to milling with 15 parts of glass beads of 0.9 mm in diameter with a paint shaker (manufactured by Toyo Seiki) at room temperature (23° C.) for 6 hours. For this operation, a standard bottle PS-6 (manufactured by Hakuyo Glass) was used as the container. The resulting liquid was further subjected to milling (second milling operation) at room temperature (23° C.) for 2,000 hours by using a ball mill machine. For this operation, the container was set to the ball mill machine as it was without removing the contents therefrom, and the container was rotated at a speed of 120 rpm. Hence, both the first and the second milling operation were performed with the same glass beads. The liquid subjected to this operation was filtered through a filter (N-NO. 125T, pore size: 133 μm, manufactured by NBC Meshtec) to remove the glass beads. After adding 30 parts of dimethyl sulfoxide to the resulting liquid, the mixture was filtered, and the filtration product remaining on the filter was sufficiently washed with tetrahydrofuran. Then, the resulting filtration product was vacuum-dried to yield 0.45 part of a hydroxygallium phthalocyanine pigment. The crystallite correlation length r of the resulting pigment, which was estimated from the peak at 7.5°±0.2° that was the strongest of the peaks in the CuKα X-ray diffraction spectrum, was 36 nm.

Subsequently, 20 parts of the hydroxygallium phthalocyanine pigment subjected to the above-described milling operation, 10 parts of a polyvinyl butyral S-LEC BX-1 (produced by Sekisui Chemical), and 190 parts of cyclohexanone were dispersed in each other with 482 parts of glass beads of 0.9 mm in diameter in a sand mill K-800 (manufactured by Aimex, disk diameter: 70 mm, 5 disks) for 4 hours with cooling water of 18° C. This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 170 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 74

An electrophotographic photosensitive member of Photosensitive Member Production Example 74 was produced in the same manner as in Photosensitive Member Production Example 1, except that the step of forming the charge generating layer was changed as below.

In the first milling operation, 0.5 part of the chlorogallium phthalocyanine pigment produced in Synthesis Example 4 and 10 parts of N,N-dimethylformamide D0722 (produced by Tokyo Chemical Industry) were subjected to milling with 15 parts of glass beads of 0.9 mm in diameter with a paint shaker (manufactured by Toyo Seiki) at room temperature (23° C.) for 1 hour. For this operation, a standard bottle PS-6 (manufactured by Hakuyo Glass) was used as the container. The liquid subjected to the milling operation was filtered through a filter (N-NO. 125T, pore size: 133 μm, manufactured by NBC Meshtec) to remove the glass beads. The resulting liquid was further subjected to milling (second milling operation) at room temperature (23° C.) for 100 hours by using a ball mill machine. This operation was performed in the standard bottle PS-6 (manufactured by Hakuyo Glass) under the condition where the bottle was rotated at a speed of 120 rpm. In this operation, media, such as glass beads, were not used. After adding 30 parts of N,N-dimethylformamide to the resulting liquid, the mixture was filtered, and the filtration product remaining on the filter was sufficiently washed with tetrahydrofuran. Then, the washed filtration product was vacuum-dried to yield 0.46 part of a chlorogallium phthalocyanine pigment.

The resulting pigment was exhibited peaks at Bragg angles 2θ of 7.4°±0.2°, 16.6°±0.2°, 25.5°±0.2°, and 28.3°±0.2° in the CuKα X-ray diffraction spectrum thereof. The crystallite correlation length r, which was estimated from the peak at 7.4° that was the strongest of the peaks in the range of 5° to 35°, was 34 nm.

Subsequently, 30 parts of the chlorogallium phthalocyanine pigment subjected to the above-described milling operation, 10 parts of a polyvinyl butyral S-LEC BX-1 (produced by Sekisui Chemical), and 253 parts of cyclohexanone were dispersed in each other with 643 parts of glass beads of 0.9 mm in diameter in a sand mill K-800 (manufactured by Aimex, disk diameter: 70 mm, 5 disks) for 4 hours with cooling water of 18° C. This operation was performed under the condition where the disks were rotated at 1,800 rpm. To the resulting dispersion liquid were added 592 parts of cyclohexanone and 845 parts of ethyl acetate to yield a coating liquid for forming a charge generating layer. This coating liquid was applied to the surface of the undercoat layer by dipping. The resulting coating film was heated to dry at 100° C. for 10 minutes to yield a 170 nm-thick charge generating layer.

The chlorogallium phthalocyanine pigment had a specific gravity of 1.6, and polyvinyl butyral used as the binder resin had a specific gravity of 1.1. Therefore, the ratio P of the volume of the charge generating material to the total volume of the charge generating layer was calculated to be 0.67. The volume average particle size R of the chlorogallium phthalocyanine pigment in the charge generating layer, which was estimated from the particle size distribution obtained using the SEM micrograph, was 123 nm. From the crystallite correlation length r and the volume average particle diameter R, parameter k (=r/R) was 0.27. For satisfying P·d/R>1, the thickness d [nm] of the charge generating layer is required to satisfy the relationship d>184. Accordingly, charge generating layers having five respective thicknesses of 200, 250, 300, 350, and 400 were formed on a PET film (polyethylene terephthalate film), and the light transmittance of these charge generating layers was measured with a goniometer, together with a simple PET film sample for correction. The absorption coefficient α calculated from the measurement results was $\alpha=0.0050$ [$nm^{-1}$].

Also, $\Phi_i$ was determined for each particle by substituting the diameter $R_i$[nm] of each particle in the particle size distribution estimated from the SEM micrograph and k=0.27 into equation (E1), and $\Psi_i$ was determined for each particle by substituting the diameter $R_i$ [nm] of each particle, the above absorption coefficient $\alpha=0.0050$ [$nm^{-1}$], the thickness d=170 [nm], and the ratio P=0.67 of the volume of the charge generating material to the total volume of the charge generating layer into equation (E2). From these results, the volume average of the products of $\Phi_i$ and $\Psi_i$ in the particle size distribution calculated by equation (E15) was 0.33.

The physical properties of the phthalocyanine pigment, the charge generating layer, and the electrophotographic photosensitive member that were produced as just described were shown in Table 2.

Photosensitive Member Production Example 75

An electrophotographic photosensitive member of Photosensitive Member Production Example 75 was produced in the same manner as in Photosensitive Member Production Example 74, except that the time for the second milling operation using the ball mill machine was changed from 100 hours to 300 hours.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 76

An electrophotographic photosensitive member of Photosensitive Member Production Example 76 was produced in the same manner as in Photosensitive Member Production Example 74, except that the second milling operation in the process for producing the chlorogallium phthalocyanine pigment was changed as below.

In the first milling operation, 0.5 part of the chlorogallium phthalocyanine pigment produced in Synthesis Example 4 and 10 parts of N,N-dimethylformamide D0722 (produced by Tokyo Chemical Industry) were subjected to milling with 15 parts of glass beads of 0.9 mm in diameter with a paint shaker (manufactured by Toyo Seiki) at room temperature (23° C.) for 1 hour. For this operation, a standard bottle PS-6 (manufactured by Hakuyo Glass) was used as the container. The resulting liquid was further subjected to milling (second milling operation) at room temperature (23° C.) for 20 hours by using a ball mill machine. For this operation, the container was set to the ball mill machine as it was without removing the contents therefrom, and the container was rotated at a speed of 120 rpm. Hence, both the first and the second milling operation were performed with the same glass beads. The liquid subjected to this operation was filtered through a filter (N-NO. 125T, pore size: 133 μm, manufactured by NBC Meshtec) to remove the glass beads. After adding 30 parts of N,N-dimethylformamide to the resulting liquid, the mixture was filtered, and the filtration product remaining on the filter was sufficiently washed with tetrahydrofuran. Then, the washed filtration product was vacuum-dried to yield 0.47 part of a chlorogallium phthalocyanine pigment. The crystallite correlation length r of the resulting pigment, which was estimated from the peak at 7.4° that was the strongest of the peaks in the CuKα X-ray diffraction spectrum, was 31 nm.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 77

An electrophotographic photosensitive member of Photosensitive Member Production Example 77 was produced in the same manner as in Photosensitive Member Production Example 76, except that the time for the second milling operation using the ball mill machine was changed from 20 hours to 40 hours.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 78

An electrophotographic photosensitive member of Photosensitive Member Production Example 78 was produced in the same manner as in Photosensitive Member Production Example 76, except that the time for the second milling operation using the ball mill machine was changed from 20 hours to 100 hours.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 79

An electrophotographic photosensitive member of Photosensitive Member Production Example 79 was produced in the same manner as in Photosensitive Member Production Example 76, except that the time for the second milling operation using the ball mill machine was changed from 20 hours to 300 hours.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 80

An electrophotographic photosensitive member of Photosensitive Member Production Example 80 was produced in the same manner as in Photosensitive Member Production Example 74, except that the second milling operation in the process for producing the chlorogallium phthalocyanine pigment was changed as below.

In the first milling operation, 0.5 part of the chlorogallium phthalocyanine pigment produced in Synthesis Example 4 and 10 parts of N,N-dimethylformamide D0722 (produced by Tokyo Chemical Industry) were subjected to milling with 15 parts of glass beads of 0.9 mm in diameter with a paint shaker (manufactured by Toyo Seiki) at room temperature (23° C.) for 1 hour. For this operation, a standard bottle PS-6 (manufactured by Hakuyo Glass) was used as the container. The liquid subjected to the milling operation was filtered through a filter (N-NO. 125T, pore size: 133 μm, manufactured by NBC Meshtec) to remove the glass beads. The resulting liquid was further subjected to milling (second milling operation) with a magnetic stirrer at room temperature (23° C.) for 40 hours. This operation was performed in the standard bottle PS-6 (manufactured by Hakuyo Glass) under the condition where the stirring bar was rotated at a speed of 1,500 rpm. In this operation, media, such as glass beads, were not used. After adding 30 parts of N,N-dimethylformamide to the resulting liquid, the mixture was filtered, and the filtration product remaining on the filter was sufficiently washed with tetrahydrofuran. Then, the washed filtration product was vacuum-dried to yield 0.47 part of a chlorogallium phthalocyanine pigment. The crystallite correlation length r of the resulting pigment, which was estimated from the peak at 7.4° that was the strongest of the peaks in the CuKα X-ray diffraction spectrum, was 29 nm.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 81

An electrophotographic photosensitive member of Photosensitive Member Production Example 81 was produced in the same manner as in Photosensitive Member Production Example 74, except that the second milling operation in the process for producing the chlorogallium phthalocyanine pigment was changed as below.

In the first milling operation, 0.5 part of the chlorogallium phthalocyanine pigment produced in Synthesis Example 4 and 10 parts of N,N-dimethylformamide D0722 (produced by Tokyo Chemical Industry) were subjected to milling with 15 parts of glass beads of 0.9 mm in diameter with a paint shaker (manufactured by Toyo Seiki) at room temperature (23° C.) for 1 hour. For this operation, a standard bottle PS-6 (manufactured by Hakuyo Glass) was used as the container. The liquid subjected to the milling operation was filtered through a filter (N-NO. 125T, pore size: 133 μm, manufactured by NBC Meshtec) to remove the glass beads. The resulting liquid was further subjected to milling (second milling operation) with an ultrasonic disperser UT-205 (manufactured by Sharp) at room temperature (23° C.) for 5 hours. For this operation, a standard bottle PS-6 (manufactured by Hakuyo Glass) was used as the container, and the power of the ultrasonic disperser was 100%. In this operation, media, such as glass beads, were not used. After adding 30 parts of N,N-dimethylformamide to the resulting liquid, the mixture was filtered, and the filtration product remaining on the filter was sufficiently washed with tetrahydrofuran. Then, the washed filtration product was vacuum-dried to yield 0.46 part of a chlorogallium phthalocyanine pigment. The crystallite correlation length r of the resulting pigment, which was estimated from the peak at 7.4° that was the strongest of the peaks in the CuKα X-ray diffraction spectrum, was 31 nm.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 82

An electrophotographic photosensitive member of Photosensitive Member Production Example 82 was produced in the same manner as in Photosensitive Member Production Example 81, except that the thickness of the charge generating layer was changed from 170 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 83

An electrophotographic photosensitive member of Photosensitive Member Production Example 83 was produced in the same manner as in Photosensitive Member Production Example 81, except that the step of forming the charge generating layer by dipping of a coating liquid using the chlorogallium phthalocyanine pigment subjected to the milling operation was changed as below.

In a sand mill K-800 (manufactured by Aimex, disk diameter: 70 mm, 5 disks) were dispersed 26.7 parts of the chlorogallium phthalocyanine pigment subjected to the milling operation in Photosensitive Member Production Example 81, 13.3 parts of a polyvinyl butyral S-LEC BX-1 (produced by Sekisui Chemical), and 253 parts of cyclohexanone in each other with 643 parts of glass beads of 0.9 mm in diameter for 4 hours with cooling water of 18° C. This operation was performed under the condition where the disks were rotated at 1,800 rpm. To the resulting dispersion liquid were added 592 parts of cyclohexanone and 845 parts of ethyl acetate to yield a coating liquid for forming a charge generating layer. This coating liquid was applied to the surface of the undercoat layer by dipping. The resulting coating film was heated to dry at 100° C. for 10 minutes to yield a 190 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 84

An electrophotographic photosensitive member of Photosensitive Member Production Example 84 was produced in the same manner as in Photosensitive Member Production Example 81, except that the step of forming the charge generating layer by dipping of a coating liquid using the chlorogallium phthalocyanine pigment subjected to the milling operation was changed as below.

In a sand mill K-800 (manufactured by Aimex, disk diameter: 70 mm, 5 disks) were dispersed 31.1 parts of the chlorogallium phthalocyanine pigment subjected to the milling operation in Photosensitive Member Production Example 81, 8.9 parts of a polyvinyl butyral S-LEC BX-1 (produced by Sekisui Chemical), and 253 parts of cyclohexanone in each other with 643 parts of glass beads of 0.9 mm in diameter for 4 hours with cooling water of 18° C. This operation was performed under the condition where the disks were rotated at 1,800 rpm. To the resulting dispersion liquid were added 592 parts of cyclohexanone and 845 parts of ethyl acetate to yield a coating liquid for forming a charge generating layer. This coating liquid was applied to the surface of the undercoat layer by dipping. The resulting coating film was heated to dry at 100° C. for 10 minutes to yield a 170 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 85

An electrophotographic photosensitive member of Photosensitive Member Production Example 85 was produced in the same manner as in Photosensitive Member Production Example 84, except that the thickness of the charge generating layer was changed from 170 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 86

An electrophotographic photosensitive member of Photosensitive Member Production Example 86 was produced in the same manner as in Photosensitive Member Production Example 81, except that the step of forming the charge generating layer by dipping of a coating liquid using the chlorogallium phthalocyanine pigment subjected to the milling operation was changed as below.

In a sand mill K-800 (manufactured by Aimex, disk diameter: 70 mm, 5 disks) were dispersed 32 parts of the chlorogallium phthalocyanine pigment subjected to the milling operation in Photosensitive Member Production Example 81, 8 parts of a polyvinyl butyral S-LEC BX-1 (produced by Sekisui Chemical), and 253 parts of cyclohexanone in each other with 643 parts of glass beads of 0.9 mm in diameter for 4 hours with cooling water of 18° C. This operation was performed under the condition where the disks were rotated at 1,800 rpm. To the resulting dispersion liquid were added 592 parts of cyclohexanone and 845 parts of ethyl acetate to yield a coating liquid for forming a charge generating layer. This coating liquid was applied to the surface of the undercoat layer by dipping. The resulting coating film was heated to dry at 100° C. for 10 minutes to yield a 170 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 87

An electrophotographic photosensitive member of Photosensitive Member Production Example 87 was produced in the same manner as in Photosensitive Member Production Example 86, except that the thickness of the charge generating layer was changed from 170 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 88

An electrophotographic photosensitive member of Photosensitive Member Production Example 88 was produced in the same manner as in Photosensitive Member Production Example 81, except that the thickness of the charge transport layer was changed from 15 μm to 11 μm.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 89

An electrophotographic photosensitive member of Photosensitive Member Production Example 89 was produced in the same manner as in Photosensitive Member Production Example 81, except that the thickness of the charge transport layer was changed from 15 μm to 13 μm.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 90

An electrophotographic photosensitive member of Photosensitive Member Production Example 90 was produced in the same manner as in Photosensitive Member Production Example 81, except that the thickness of the charge transport layer was changed from 15 μm to 17 μm.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 91

An electrophotographic photosensitive member of Photosensitive Member Production Example 91 was produced in the same manner as in Photosensitive Member Production Example 81, except that the thickness of the charge transport layer was changed from 15 μm to 20 μm.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 92

An electrophotographic photosensitive member of Photosensitive Member Production Example 92 was produced in the same manner as in Photosensitive Member Production Example 81, except that the thickness of the charge transport layer was changed from 15 μm to 23 μm.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 93

An electrophotographic photosensitive member of Photosensitive Member Production Example 93 was produced in the same manner as in Photosensitive Member Production Example 81, except that the thickness of the charge transport layer was changed from 15 μm to 27 μm.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 94

An electrophotographic photosensitive member of Photosensitive Member Production Example 94 was produced in the same manner as in Photosensitive Member Production Example 74, except that the step of forming the charge generating layer was changed as below.

In the first milling operation, 0.5 part of the chlorogallium phthalocyanine pigment produced in Synthesis Example 4 and 10 parts of N-methylformamide F0059 (produced by Tokyo Chemical Industry) were subjected to milling with 15 parts of glass beads of 0.9 mm in diameter with a paint shaker (manufactured by Toyo Seiki) at room temperature (23° C.) for 1 hour. For this operation, a standard bottle PS-6 (manufactured by Hakuyo Glass) was used as the container. The liquid subjected to the milling operation was filtered through a filter (N-NO. 125T, pore size: 133 μm, manufactured by NBC Meshtec) to remove the glass beads. The resulting liquid was further subjected to milling (second milling operation) at room temperature (23° C.) for 300 hours by using a ball mill machine. This operation was performed in the standard bottle PS-6 (manufactured by Hakuyo Glass) under the condition where the bottle was rotated at a speed of 120 rpm. In this operation, media, such as glass beads, were not used. After adding 30 parts of N-methylformamide to the resulting liquid, the mixture was filtered, and the filtration product remaining on the filter was sufficiently washed with tetrahydrofuran. Then, the washed filtration product was vacuum-dried to yield 0.45 part of a chlorogallium phthalocyanine pigment. The crystallite correlation length r of the resulting pigment, which was estimated from the peak at 7.4° that was the strongest of the peaks in the CuKα X-ray diffraction spectrum, was 31 nm.

Subsequently, 30 parts of the chlorogallium phthalocyanine pigment subjected to the above-described milling operation, 10 parts of a polyvinyl butyral S-LEC BX-1 (produced by Sekisui Chemical), and 253 parts of cyclohexanone were dispersed in each other with 643 parts of glass beads of 0.9 mm in diameter in a sand mill K-800 (manufactured by Aimex, disk diameter: 70 mm, 5 disks) for 4 hours with cooling water of 18° C. This operation was performed under the condition where the disks were rotated at 1,800 rpm. To the resulting dispersion liquid were added 592 parts of cyclohexanone and 845 parts of ethyl acetate to yield a coating liquid for forming a charge generating layer. This coating liquid was applied to the surface of the undercoat layer by dipping. The resulting coating film was heated to dry at 100° C. for 10 minutes to yield a 170 nm-thick charge generating layer.

The chlorogallium phthalocyanine pigment had a specific gravity of 1.6, and polyvinyl butyral used as the binder resin had a specific gravity of 1.1. Therefore, the ratio P of the volume of the charge generating material to the total volume of the charge generating layer was calculated to be 0.67. The volume average particle size R of the chlorogallium phthalocyanine pigment in the charge generating layer, which was estimated from the particle size distribution obtained using the SEM micrograph, was 135 nm. From the crystallite correlation length r and the volume average particle diameter R, parameter k (=r/R) was 0.23. For satisfying $P \cdot d/R>1$, the thickness d [nm] of the charge generating layer is required to satisfy the relationship d>201. Accordingly, charge generating layers having five respective thicknesses of 220, 250, 300, 350, and 400 were formed on a PET film (polyethylene terephthalate film), and the light transmittance of these charge generating layers was measured with a goniometer, together with a simple PET film sample for correction. The absorption coefficient $\alpha$ calculated from the measurement results was $\alpha=0.0050$ [$nm^{-1}$].

Also, $\Phi_i$ was determined for each particle by substituting the diameter $R_i$[nm] of each particle in the particle size distribution estimated from the SEM micrograph and k=0.23 into equation (E1), and $\Psi_i$ was determined for each particle by substituting the diameter $R_i$ [nm] of each particle, the above absorption coefficient $\alpha=0.0050$ [$nm^{-1}$], the thickness d=170 [nm], and the ratio P=0.67 of the volume of the charge generating material to the total volume of the charge generating layer into equation (E2). From these results, the volume average of the products of $\Phi_i$ and $\Psi_i$ in the particle size distribution calculated by equation (E15) was 0.32.

The physical properties of the phthalocyanine pigment, the charge generating layer, and the electrophotographic photosensitive member that were produced as just described were shown in Table 2.

Photosensitive Member Production Example 95

An electrophotographic photosensitive member of Photosensitive Member Production Example 95 was produced in the same manner as in Photosensitive Member Production Example 94, except that the second milling operation in the process for producing the chlorogallium phthalocyanine pigment was changed as below.

In the first milling operation, 0.5 part of the chlorogallium phthalocyanine pigment produced in Synthesis Example 4 and 10 parts of N-methylformamide F0059 (produced by Tokyo Chemical Industry) were subjected to milling with 15 parts of glass beads of 0.9 mm in diameter with a paint shaker (manufactured by Toyo Seiki) at room temperature (23° C.) for 1 hour. For this operation, a standard bottle PS-6 (manufactured by Hakuyo Glass) was used as the container. The resulting liquid was further subjected to milling (second milling operation) at room temperature (23° C.) for 300 hours by using a ball mill machine. For this operation, the container was set to the ball mill machine as it was without removing the contents therefrom, and the container was rotated at a speed of 120 rpm. Hence, both the first and the second milling operation were performed with the same glass beads. The liquid subjected to this operation was filtered through a filter (N-NO. 125T, pore size: 133 μm, manufactured by NBC Meshtec) to remove the glass beads. After adding 30 parts of N-methylformamide to the resulting liquid, the mixture was filtered, and the filtration product remaining on the filter was sufficiently washed with tetrahydrofuran. Then, the washed filtration product was vacuum-dried to yield 0.45 part of a chlorogallium phthalocyanine pigment. The crystallite correlation length r of the resulting pigment, which was estimated from the peak at 7.4° that was the strongest of the peaks in the CuKα X-ray diffraction spectrum, was 34 nm.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 96

An electrophotographic photosensitive member of Photosensitive Member Production Example 96 was produced in the same manner as in Photosensitive Member Production Example 74, except that the process for producing the chlorogallium phthalocyanine pigment was changed as below.

In the first milling operation, 0.5 part of the chlorogallium phthalocyanine pigment produced in Synthesis Example 4 and 10 parts of dimethyl sulfoxide D0798 (manufactured by Tokyo Chemical Industry) were subjected to milling with 15 parts of glass beads of 0.9 mm in diameter with a paint shaker (manufactured by Toyo Seiki) at room temperature (23° C.) for 1 hour. For this operation, a standard bottle PS-6 (manufactured by Hakuyo Glass) was used as the container. The liquid subjected to the milling operation was filtered through a filter (N-NO. 125T, pore size: 133 μm, manufactured by NBC Meshtec) to remove the glass beads. The resulting liquid was further subjected to milling (second milling operation) at room temperature (23° C.) for 300 hours by using a ball mill machine. This operation was performed in the standard bottle PS-6 (manufactured by Hakuyo Glass) under the condition where the bottle was rotated at a speed of 120 rpm. In this operation, media, such as glass beads, were not used. After adding 30 parts of dimethyl sulfoxide to the resulting liquid, the mixture was filtered, and the filtration product remaining on the filter was sufficiently washed with tetrahydrofuran. Then, the washed filtration product was vacuum-dried to yield 0.44 part of a chlorogallium phthalocyanine pigment. The crystallite correlation length r of the resulting pigment, which was estimated from the peak at 7.4° that was the strongest of the peaks in the CuKα X-ray diffraction spectrum, was 31 nm.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 97

An electrophotographic photosensitive member of Photosensitive Member Production Example 97 was produced in the same manner as in Photosensitive Member Production Example 96, except that the second milling operation in the process for producing the chlorogallium phthalocyanine pigment was changed as below.

In the first milling operation, 0.5 part of the chlorogallium phthalocyanine pigment produced in Synthesis Example 4 and 10 parts of dimethyl sulfoxide D0798 (manufactured by Tokyo Chemical Industry) were subjected to milling with 15 parts of glass beads of 0.9 mm in diameter with a paint shaker (manufactured by Toyo Seiki) at room temperature (23° C.) for 1 hour. For this operation, a standard bottle PS-6 (manufactured by Hakuyo Glass) was used as the container. The resulting liquid was further subjected to milling (second milling operation) at room temperature (23° C.) for 40 hours by using a ball mill machine. For this operation, the container was set to the ball mill machine as it was without removing the contents therefrom, and the container was rotated at a speed of 120 rpm. Hence, both the first and the second milling operation were performed with the same glass beads. After adding 30 parts of dimethyl sulfoxide to the resulting liquid, the mixture was filtered, and the filtration product remaining on the filter was sufficiently washed with tetrahydrofuran. Then, the washed filtration product was vacuum-dried to yield 0.46 part of a chlorogallium phthalocyanine pigment. The crystallite correlation length r of the resulting pigment, which was estimated from the peak at 7.4° that was the strongest of the peaks in the CuKα X-ray diffraction spectrum, was 31 nm.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 98

An electrophotographic photosensitive member of Photosensitive Member Production Example 98 was produced in the same manner as in Photosensitive Member Production Example 97, except that the time for the second milling operation using the ball mill machine was changed from 40 hours to 100 hours.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 99

An electrophotographic photosensitive member of Photosensitive Member Production Example 99 was produced in the same manner as in Photosensitive Member Production Example 97, except that the time for the second milling operation using the ball mill machine was changed from 40 hours to 300 hours.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 100

An electrophotographic photosensitive member of Photosensitive Member Production Example 100 was produced in the same manner as in Photosensitive Member Production Example 1, except that the step of forming the charge generating layer was changed as below.

In the first milling operation, 0.5 part of the titanyl phthalocyanine pigment produced in Synthesis Example 5 and 10 parts of tetrahydrofuran were subjected to milling with 15 parts of glass beads of 0.9 mm in diameter with a paint shaker (manufactured by Toyo Seiki) at room temperature (23° C.) for 3 hours. For this operation, a standard bottle PS-6 (manufactured by Hakuyo Glass) was used as the container. The liquid subjected to the milling operation was filtered through a filter (N-NO. 125T, pore size: 133 μm, manufactured by NBC Meshtec) to remove the glass beads. The resulting liquid was further subjected to milling (second milling operation) at room temperature (23° C.) for 300 hours by using a ball mill machine. This operation was performed in the standard bottle PS-6 (manufactured by Hakuyo Glass) under the condition where the bottle was rotated at a speed of 120 rpm. In this operation, media, such as glass beads, were not used. After adding 30 parts of tetrahydrofuran to the resulting liquid, the mixture was filtered, and the filtration product remaining on the filter was sufficiently washed with methanol and water. Then, the washed filtration product was vacuum-dried to yield 0.44 part of a titanyl phthalocyanine pigment.

The resulting pigment was exhibited a peak at a Bragg angle 2θ of 27.2°±0.2° in the CuKα X-ray diffraction spectrum thereof. The crystallite correlation length r, which was estimated from the peak at 27.2°±0.2° that was the strongest of the peaks in the range of 5° to 35°, was 36 nm.

Subsequently, 12 parts of the titanyl phthalocyanine pigment subjected to the above-described milling operation, 10 parts of a polyvinyl butyral S-LEC BX-1 (produced by Sekisui Chemical), and 139 parts of cyclohexanone were dispersed in each other with 354 parts of glass beads of 0.9 mm in diameter in a sand mill K-800 (manufactured by Aimex, disk diameter: 70 mm, 5 disks) for 4 hours with cooling water of 18° C. This operation was performed under the condition where the disks were rotated at 1,800 rpm. To the resulting dispersion liquid were added 326 parts of cyclohexanone and 465 parts of ethyl acetate to yield a coating liquid for forming a charge generating layer. This coating liquid was applied to the surface of the undercoat layer by dipping. The resulting coating film was heated to dry at 100° C. for 10 minutes to yield a 150 nm-thick charge generating layer.

The titanyl phthalocyanine pigment had a specific gravity of 1.6, and polyvinyl butyral used as the binder resin had a specific gravity of 1.1. Therefore, the ratio P of the volume of the charge generating material to the total volume of the charge generating layer was calculated to be 0.45. Also, the volume average particle size R of the titanyl phthalocyanine pigment in the charge generating layer, which was estimated from the particle size distribution obtained using the SEM micrograph, was 158 nm. From the crystallite correlation length r and the volume average particle diameter R, parameter k (=r/R) was 0.23. For satisfying $P \cdot d/R > 1$, the thickness d [nm] of the charge generating layer is required to satisfy the relationship $d > 351$. Accordingly, charge generating layers having five respective thicknesses of 370, 400, 450, 500, and 550 were formed on a PET film (polyethylene terephthalate film), and the light transmittance of these charge generating layers was measured with a goniometer, together with a simple PET film sample for correction. The absorption coefficient α calculated from the measurement results was $\alpha = 0.0066$ [$nm^{-1}$].

Also, $\Phi_i$ was determined for each particle by substituting the diameter $R_i$[nm] of each particle in the particle size distribution estimated from the SEM micrograph and k=0.23 into equation (E1), and $\Psi_i$ was determined for each particle by substituting the diameter $R_i$ [nm] of each particle, the above absorption coefficient $\alpha$=0.0066 [$nm^{-1}$], the thickness d=150 [nm], and the ratio P=0.45 of the volume of the charge generating material to the total volume of the charge generating layer into equation (E2). From these results, the volume average of the products of $\Phi_i$ and $\Psi_i$ in the particle size distribution calculated by equation (E15) was 0.32.

The physical properties of the phthalocyanine pigment, the charge generating layer, and the electrophotographic photosensitive member that were produced as just described were shown in Table 2.

Photosensitive Member Production Example 101

An electrophotographic photosensitive member of Photosensitive Member Production Example 101 was produced in the same manner as in Photosensitive Member Production Example 100, except that the time for the second milling operation using the ball mill machine was changed from 300 hours to 1,000 hours.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 102

An electrophotographic photosensitive member of Photosensitive Member Production Example 102 was produced in the same manner as in Photosensitive Member Production Example 100, except that the second milling operation in the process for producing the titanyl phthalocyanine pigment was changed as below.

In the first milling operation, 0.5 part of the titanyl phthalocyanine pigment produced in Synthesis Example 5 and 10 parts of tetrahydrofuran were subjected to milling with 15 parts of glass beads of 0.9 mm in diameter with a paint shaker (manufactured by Toyo Seiki) at room temperature (23° C.) for 3 hours. For this operation, a standard bottle PS-6 (manufactured by Hakuyo Glass) was used as the container. The resulting liquid was further subjected to milling (second milling operation) at room temperature (23° C.) for 300 hours by using a ball mill machine. For this operation, the container was set to the ball mill machine as it was without removing the contents therefrom, and the container was rotated at a speed of 120 rpm. Hence, both the first and the second milling operation were performed with the same glass beads. After adding 30 parts of tetrahydrofuran to the resulting liquid, the mixture was filtered, and the filtration product remaining on the filter was sufficiently washed with methanol and water. Then, the washed filtration product was vacuum-dried to yield 0.45 part of a titanyl phthalocyanine pigment. The crystallite correlation length r of the resulting pigment, which was estimated from the peak at 27.2°±0.2° that was the strongest of the peaks in the CuK$\alpha$ X-ray diffraction spectrum, was 36 nm.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 103

An electrophotographic photosensitive member of Photosensitive Member Production Example 103 was produced in the same manner as in Photosensitive Member Production Example 102, except that the time for the second milling operation using the ball mill machine was changed from 300 hours to 1,000 hours.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 104

An electrophotographic photosensitive member of Photosensitive Member Production Example 104 was produced in the same manner as in Photosensitive Member Production Example 100, except that the process for producing the titanyl phthalocyanine pigment was changed as below.

In the first milling operation, 0.5 part of the titanyl phthalocyanine pigment produced in Synthesis Example 5 and 10 parts of n-butyl ether were subjected to milling with 15 parts of glass beads of 0.9 mm in diameter with a paint shaker (manufactured by Toyo Seiki) at room temperature (23° C.) for 3 hours. For this operation, a standard bottle PS-6 (manufactured by Hakuyo Glass) was used as the container. The liquid subjected to the milling operation was filtered through a filter (N-NO. 125T, pore size: 133 μm, manufactured by NBC Meshtec) to remove the glass beads. The resulting liquid was further subjected to milling (second milling operation) at room temperature (23° C.) for 1,000 hours by using a ball mill machine. This operation was performed in the standard bottle PS-6 (manufactured by Hakuyo Glass) under the condition where the bottle was rotated at a speed of 120 rpm. In this operation, media, such as glass beads, were not used. After adding 30 parts of n-butyl ether to the resulting liquid, the mixture was filtered, and the filtration product remaining on the filter was sufficiently washed with methanol and water. Then, the washed filtration product was vacuum-dried to yield 0.44 part of a titanyl phthalocyanine pigment. The crystallite correlation length r of the resulting pigment, which was estimated from the peak at 27.2°±0.2° that was the strongest of the peaks in the CuK$\alpha$ X-ray diffraction spectrum, was 36 nm.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 105

An electrophotographic photosensitive member of Photosensitive Member Production Example 105 was produced in the same manner as in Photosensitive Member Production Example 104, except that the second milling operation in the process for producing the titanyl phthalocyanine pigment was changed as below.

In the first milling operation, 0.5 part of the titanyl phthalocyanine pigment produced in Synthesis Example 5 and 10 parts of n-butyl ether were subjected to milling with 15 parts of glass beads of 0.9 mm in diameter with a paint shaker (manufactured by Toyo Seiki) at room temperature (23° C.) for 3 hours. For this operation, a standard bottle PS-6 (manufactured by Hakuyo Glass) was used as the container. The resulting liquid was further subjected to milling (second milling operation) at room temperature (23° C.) for 300 hours by using a ball mill machine. For this operation, the container was set to the ball mill machine as it was without removing the contents therefrom, and the container was rotated at a speed of 120 rpm. Hence, both the first and the second milling operation were performed with the same glass beads.

The liquid subjected to this operation was filtered through a filter (N-NO. 125T, pore size: 133 μm, manufactured by NBC Meshtec) to remove the glass beads. After adding 30 parts of n-butyl ether to the resulting liquid, the mixture was filtered, and the filtration product remaining on the filter was sufficiently washed with methanol and water. Then, the washed filtration product was vacuum-dried to yield 0.44 part of a titanyl phthalocyanine pigment. The crystallite correlation length r of the resulting pigment, which was estimated from the peak at 27.2°±0.2° that was the strongest of the peaks in the CuKα X-ray diffraction spectrum, was 36 nm.

The physical properties of the phthalocyanine pigment, the charge generating layer, and the electrophotographic photosensitive member that were produced as just described were determined in the same manner as in Photosensitive Member Production Example 1, and the results are shown in Table 2.

Photosensitive Member Production Example 106

An electrophotographic photosensitive member of Photosensitive Member Production Example 106 was produced in the same manner as in Photosensitive Member Production Example 105, except that the time for the second milling operation using the ball mill machine was changed from 300 hours to 1,000 hours.

The physical properties of the phthalocyanine pigment, the charge generating layer, and the electrophotographic photosensitive member that were produced as just described were determined in the same manner as in Photosensitive Member Production Example 1, and the results are shown in Table 2.

TABLE 2

Physical Properties of Phthalocyanine Pigments and Photosensitive Members

| Photosensitive Member Production Example No. | Pigment | Crystallite correlation length r [nm] | Crystalline particle size R [nm] | k = r/R | Charge generating layer thickness d [nm] | Volume ratio P of charge generating material | Absorption coefficient α [$nm^{-1}$] | Charge transport layer thickness [μm] | $\Phi_i \cdot \Psi_i$ |
|---|---|---|---|---|---|---|---|---|---|
| Photosensitive Member Production Example 55 | HOGaPc | 36 | 148 | 0.24 | 170 | 0.58 | 0.0042 | 15 | 0.33 |
| Photosensitive Member Production Example 58 | HOGaPc | 36 | 147 | 0.25 | 170 | 0.58 | 0.0042 | 15 | 0.33 |
| Photosensitive Member Production Example 57 | HOGaPc | 36 | 143 | 0.25 | 170 | 0.58 | 0.0042 | 15 | 0.33 |
| Photosensitive Member Production Example 58 | HOGaPc | 36 | 140 | 0.26 | 170 | 0.58 | 0.0042 | 15 | 0.33 |
| Photosensitive Member Production Example 59 | HOGaPc | 39 | 136 | 0.28 | 170 | 0.58 | 0.0042 | 15 | 0.34 |
| Photosensitive Member Production Example 60 | HOGaPc | 39 | 136 | 0.28 | 190 | 0.58 | 0.0055 | 15 | 0.37 |
| Photosensitive Member Production Example 61 | HOGaPc | 39 | 136 | 0.28 | 170 | 0.67 | 0.0048 | 15 | 0.43 |
| Photosensitive Member Production Example 62 | HOGaPc | 39 | 136 | 0.28 | 190 | 0.67 | 0.0048 | 15 | 0.47 |
| Photosensitive Member Production Example 63 | HOGaPc | 39 | 136 | 0.28 | 170 | 0.71 | 0.0051 | 15 | 0.46 |
| Photosensitive Member Production Example 64 | HOGaPc | 39 | 136 | 0.28 | 190 | 0.71 | 0.0051 | 15 | 0.50 |
| Photosensitive Member Production Example 65 | HOGaPc | 39 | 136 | 0.28 | 170 | 0.73 | 0.0053 | 15 | 0.49 |
| Photosensitive Member Production Example 66 | HOGaPc | 39 | 136 | 0.28 | 190 | 0.73 | 0.0053 | 15 | 0.53 |
| Photosensitive Member Production Example 67 | HOGaPc | 39 | 136 | 0.28 | 170 | 0.58 | 0.0042 | 11 | 0.34 |
| Photosensitive Member Production Example 68 | HOGaPc | 39 | 136 | 0.28 | 170 | 0.58 | 0.0042 | 13 | 0.34 |
| Photosensitive Member Production Example 69 | HOGaPc | 39 | 136 | 0.28 | 170 | 0.58 | 0.0042 | 17 | 0.34 |
| Photosensitive Member Production Example 70 | HOGaPc | 39 | 136 | 0.28 | 170 | 0.58 | 0.0042 | 20 | 0.34 |
| Photosensitive Member Production Example 71 | HOGaPc | 39 | 136 | 0.28 | 170 | 0.58 | 0.0042 | 23 | 0.34 |
| Photosensitive Member Production Example 72 | HOGaPc | 39 | 136 | 0.28 | 170 | 0.58 | 0.0042 | 27 | 0.34 |
| Photosensitive Member Production Example 73 | HOGaPc | 36 | 151 | 0.24 | 170 | 0.58 | 0.0042 | 15 | 0.33 |
| Photosensitive Member Production Example 74 | ClGaPc | 34 | 123 | 0.27 | 170 | 0.67 | 0.0050 | 15 | 0.33 |
| Photosensitive Member Production Example 75 | ClGaPc | 34 | 120 | 0.28 | 170 | 0.67 | 0.0050 | 15 | 0.33 |
| Photosensitive Member Production Example 76 | ClGaPc | 31 | 127 | 0.25 | 170 | 0.67 | 0.0050 | 15 | 0.32 |
| Photosensitive Member Production Example 77 | ClGaPc | 34 | 124 | 0.27 | 170 | 0.67 | 0.0050 | 15 | 0.32 |
| Photosensitive Member Production Example 78 | ClGaPc | 36 | 120 | 0.30 | 170 | 0.67 | 0.0050 | 15 | 0.33 |
| Photosensitive Member Production Example 79 | ClGaPc | 36 | 118 | 0.31 | 170 | 0.67 | 0.0050 | 15 | 0.34 |
| Photosensitive Member Production Example 80 | ClGaPc | 29 | 130 | 0.22 | 170 | 0.67 | 0.0050 | 15 | 0.32 |
| Photosensitive Member Production Example 81 | ClGaPc | 31 | 127 | 0.25 | 170 | 0.67 | 0.0050 | 15 | 0.32 |
| Photosensitive Member Production Example 82 | ClGaPc | 31 | 127 | 0.25 | 190 | 0.67 | 0.0050 | 15 | 0.36 |
| Photosensitive Member Production Example 83 | ClGaPc | 31 | 127 | 0.25 | 190 | 0.58 | 0.0050 | 15 | 0.32 |
| Photosensitive Member Production Example 84 | ClGaPc | 31 | 127 | 0.25 | 170 | 0.71 | 0.0050 | 15 | 0.34 |
| Photosensitive Member Production Example 85 | ClGaPc | 31 | 127 | 0.25 | 190 | 0.71 | 0.0050 | 15 | 0.38 |
| Photosensitive Member Production Example 86 | ClGaPc | 31 | 127 | 0.25 | 170 | 0.73 | 0.0050 | 15 | 0.36 |
| Photosensitive Member Production Example 87 | ClGaPc | 31 | 127 | 0.25 | 190 | 0.73 | 0.0050 | 15 | 0.40 |
| Photosensitive Member Production Example 88 | ClGaPc | 31 | 127 | 0.25 | 170 | 0.67 | 0.0050 | 11 | 0.32 |
| Photosensitive Member Production Example 89 | ClGaPc | 31 | 127 | 0.25 | 170 | 0.67 | 0.0050 | 13 | 0.32 |
| Photosensitive Member Production Example 90 | ClGaPc | 31 | 127 | 0.25 | 170 | 0.67 | 0.0050 | 17 | 0.32 |
| Photosensitive Member Production Example 91 | ClGaPc | 31 | 127 | 0.25 | 170 | 0.67 | 0.0050 | 20 | 0.32 |
| Photosensitive Member Production Example 92 | ClGaPc | 31 | 127 | 0.25 | 170 | 0.67 | 0.0050 | 23 | 0.32 |
| Photosensitive Member Production Example 93 | ClGaPc | 31 | 127 | 0.25 | 170 | 0.67 | 0.0050 | 27 | 0.32 |
| Photosensitive Member Production Example 94 | ClGaPc | 31 | 135 | 0.23 | 170 | 0.67 | 0.0050 | 15 | 0.32 |

TABLE 2-continued

Physical Properties of Phthalocyanine Pigments and Photosensitive Members

| Photosensitive Member Production Example No. | Pigment | Crystallite correlation length r [nm] | Crystalline particle size R [nm] | k = r/R | Charge generating layer thickness d [nm] | Volume ratio P of charge generating material | Absorption coefficient α [$nm^{-1}$] | Charge transport layer thickness [μm] | $\Phi_i \cdot \Psi_i$ |
|---|---|---|---|---|---|---|---|---|---|
| Photosensitive Member Production Example 95 | ClGaPc | 34 | 131 | 0.26 | 170 | 0.67 | 0.0050 | 15 | 0.32 |
| Photosensitive Member Production Example 96 | ClGaPc | 31 | 131 | 0.24 | 170 | 0.67 | 0.0050 | 15 | 0.32 |
| Photosensitive Member Production Example 97 | ClGaPc | 31 | 133 | 0.23 | 170 | 0.67 | 0.0050 | 15 | 0.32 |
| Photosensitive Member Production Example 98 | ClGaPc | 34 | 130 | 0.26 | 170 | 0.67 | 0.0050 | 15 | 0.33 |
| Photosensitive Member Production Example 99 | ClGaPc | 34 | 122 | 0.28 | 170 | 0.67 | 0.0050 | 15 | 0.34 |
| Photosensitive Member Production Example 100 | TiOPc | 36 | 158 | 0.23 | 150 | 0.45 | 0.0066 | 15 | 0.32 |
| Photosensitive Member Production Example 101 | TiOPc | 36 | 154 | 0.23 | 150 | 0.45 | 0.0066 | 15 | 0.33 |
| Photosensitive Member Production Example 102 | TiOPc | 36 | 146 | 0.25 | 150 | 0.45 | 0.0066 | 15 | 0.33 |
| Photosensitive Member Production Example 103 | TiOPc | 39 | 141 | 0.27 | 150 | 0.45 | 0.0066 | 15 | 0.33 |
| Photosensitive Member Production Example 104 | TiOPc | 36 | 154 | 0.23 | 150 | 0.45 | 0.0066 | 15 | 0.32 |
| Photosensitive Member Production Example 105 | TiOPc | 36 | 148 | 0.24 | 150 | 0.45 | 0.0066 | 15 | 0.32 |
| Photosensitive Member Production Example 106 | TiOPc | 39 | 144 | 0.27 | 150 | 0.45 | 0.0066 | 15 | 0.32 |

Photosensitive Member Production Example 107

An electrophotographic photosensitive member of Photosensitive Member Production Example 107 was produced in the same manner as in Photosensitive Member Production Example 5, except that the step of forming the charge generating layer was changed as below.

In a centrifugation container, 25 parts of the hydroxygallium phthalocyanine pigment subjected to the milling operation in Photosensitive Member Production Example 5, 5 parts of a polyvinyl butyral S-LEC BX-1 (produced by Sekisui Chemical), and 190 parts of cyclohexanone were subjected to centrifugation for 30 minutes with a high-speed refrigerated centrifuge himac CR22G (manufactured by Hitachi Koki) set at 18° C. For this operation, a rotor R14A (manufactured by Hitachi Koki) was used at a minimum acceleration/deceleration time and a rotational speed of 1,800 rpm. After the centrifugation, the supernatant was immediately collected into another centrifugation container. The solution, or supernatant, was centrifuged again in the same manner as above except that the rotational speed was changed to 8,000 rpm. After removing the supernatant, the rest of the solution was immediately collected into a sample bottle. The weight ratio of the hydroxygallium phthalocyanine pigment to the polyvinyl butyral in the resulting solution was measured by $^1$H-NMR. Also, the solids content in the solution was determined by drying the solids in the solution for 30 minutes in a dryer set at 150° C. and measuring the difference between the weights before and after the drying.

Subsequently, polyvinyl butyral S-LEC BX-1 (produced by Sekisui Chemical) and cyclohexanone were added to the solution collected by centrifugation so that the ratio of the hydroxygallium phthalocyanine pigment, the polyvinyl butyral and the cyclohexanone would be 20:10:190. In a sand mill K-800 (manufactured by Aimex, disk diameter: 70 mm, 5 disks), 220 parts of this mixture was subjected to dispersion with 482 parts of glass beads of 0.9 mm in diameter for 4 hours with cooling water of 18° C. This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 150 nm-thick charge generating layer.

The hydroxygallium phthalocyanine pigment had a specific gravity of 1.6, and polyvinyl butyral used as the binder resin had a specific gravity of 1.1. Therefore, the ratio P of the volume of the charge generating material to the total volume of the charge generating layer was calculated to be 0.58. The volume average particle size R of the hydroxygallium phthalocyanine pigment in the charge generating layer, which was estimated from the particle size distribution obtained using the SEM micrograph, was 100 nm. From the crystallite correlation length r and the volume average particle diameter R, parameter k (=r/R) was 0.35. For satisfying $P \cdot d/R > 1$, the thickness d [nm] of the charge generating layer is required to satisfy the relationship $d > 172$. Accordingly, charge generating layers having five respective thicknesses of 200, 250, 300, 350, and 400 were formed on a PET film (polyethylene terephthalate film), and the light transmittance of these charge generating layers was measured with a goniometer, together with a simple PET film sample for correction. The absorption coefficient α calculated from the measurement results was $\alpha = 0.0055$ [$nm^{-1}$].

Also, $\Phi_i$ was determined for each particle by substituting the diameter $R_i$ [nm] of each particle in the particle size distribution estimated from the SEM micrograph and k=0.35 into equation (E1), and $\Psi_i$ was determined for each particle by substituting the diameter $R_i$ [nm] of each particle, the above absorption coefficient $\alpha = 0.0055$ [$nm^{-1}$], the thickness d=150 [nm], and the ratio P=0.58 of the volume of the charge generating material to the total volume of the charge generating layer into equation (E2). From these results, the volume average of the products of $\Phi_i$ and $\Psi_i$ in the particle size distribution calculated by equation (E15) was 0.41.

The physical properties of the phthalocyanine pigment, the charge generating layer, and the electrophotographic photosensitive member that were produced as just described were shown in Table 3.

Photosensitive Member Production Example 108

An electrophotographic photosensitive member of Photosensitive Member Production Example 108 was produced in the same manner as in Photosensitive Member Production Example 107, except that the hydroxygallium phthalocyanine pigment subjected to the milling operation in Photosensitive Member Production Example 5 was replaced with the hydroxygallium phthalocyanine pigment subjected to the milling operation in Photosensitive Member Production Example 8 before the centrifugation in Photosensitive Member Production Example 107.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 109

An electrophotographic photosensitive member of Photosensitive Member Production Example 109 was produced in the same manner as in Photosensitive Member Production Example 107, except that the hydroxygallium phthalocyanine pigment subjected to the milling operation in Photosensitive Member Production Example 5 was replaced with the hydroxygallium phthalocyanine pigment subjected to the milling operation in Photosensitive Member Production Example 37 before the centrifugation in Photosensitive Member Production Example 107.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 110

An electrophotographic photosensitive member of Photosensitive Member Production Example 110 was produced in the same manner as in Photosensitive Member Production Example 109, except that the thickness of the charge generating layer was changed from 150 nm to 130 nm.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 111

An electrophotographic photosensitive member of Photosensitive Member Production Example 111 was produced in the same manner as in Photosensitive Member Production Example 109, except that the thickness of the charge generating layer was changed from 150 nm to 170 nm.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 112

An electrophotographic photosensitive member of Photosensitive Member Production Example 112 was produced in the same manner as in Photosensitive Member Production Example 109, except that the thickness of the charge generating layer was changed from 150 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 113

An electrophotographic photosensitive member of Photosensitive Member Production Example 113 was produced in the same manner as in Photosensitive Member Production Example 109, except that the step of forming the charge generating layer by dipping of a coating liquid using the hydroxygallium phthalocyanine pigment subjected to the milling operation was changed as below.

Polyvinyl butyral S-LEC BX-1 (produced by Sekisui Chemical) and cyclohexanone were added to the solution obtained by the centrifugation performed as in Photosensitive Member Production Example 109 so that the ratio of the hydroxygallium phthalocyanine pigment, the polyvinyl butyral and the cyclohexanone would be 18:12:190. In a sand mill K-800 (manufactured by Aimex, disk diameter: 70 mm, 5 disks), 220 parts of this mixture was subjected to dispersion with 482 parts of glass beads of 0.9 mm in diameter for 4 hours with cooling water of 18° C. This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 150 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 114

An electrophotographic photosensitive member of Photosensitive Member Production Example 114 was produced in the same manner as in Photosensitive Member Production Example 113, except that the thickness of the charge generating layer was changed from 150 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 115

An electrophotographic photosensitive member of Photosensitive Member Production Example 115 was produced in the same manner as in Photosensitive Member Production Example 109, except that the step of forming the charge generating layer by dipping of a coating liquid using the hydroxygallium phthalocyanine pigment subjected to the milling operation was changed as below.

Polyvinyl butyral S-LEC BX-1 (produced by Sekisui Chemical) and cyclohexanone were added to the solution obtained by the centrifugation performed as in Photosensitive Member Production Example 109 so that the ratio of the hydroxygallium phthalocyanine pigment, the polyvinyl butyral and the cyclohexanone would be 22.5:7.5:190. In a sand mill K-800 (manufactured by Aimex, disk diameter: 70 mm, 5 disks), 220 parts of this mixture was subjected to dispersion with 482 parts of glass beads of 0.9 mm in diameter for 4 hours with cooling water of 18° C. This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 150 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 116

An electrophotographic photosensitive member of Photosensitive Member Production Example 116 was produced in the same manner as in Photosensitive Member Production Example 115, except that the thickness of the charge generating layer was changed from 150 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 117

An electrophotographic photosensitive member of Photosensitive Member Production Example 117 was produced in the same manner as in Photosensitive Member Production Example 109, except that the step of forming the charge generating layer by dipping of a coating liquid using the hydroxygallium phthalocyanine pigment subjected to the milling operation was changed as below.

Polyvinyl butyral S-LEC BX-1 (produced by Sekisui Chemical) and cyclohexanone were added to the solution obtained by the centrifugation performed as in Photosensitive Member Production Example 109 so that the ratio of the hydroxygallium phthalocyanine pigment, the polyvinyl butyral and the cyclohexanone would be 23.3:6.7:190. In a sand mill K-800 (manufactured by Aimex, disk diameter: 70 mm, 5 disks), 220 parts of this mixture was subjected to dispersion with 482 parts of glass beads of 0.9 mm in diameter for 4 hours with cooling water of 18° C. This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 150 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 118

An electrophotographic photosensitive member of Photosensitive Member Production Example 118 was produced in the same manner as in Photosensitive Member Production Example 117, except that the thickness of the charge generating layer was changed from 150 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 119

An electrophotographic photosensitive member of Photosensitive Member Production Example 119 was produced in the same manner as in Photosensitive Member Production Example 109, except that the step of forming the charge generating layer by dipping of a coating liquid using the hydroxygallium phthalocyanine pigment subjected to the milling operation was changed as below.

Polyvinyl butyral S-LEC BX-1 (produced by Sekisui Chemical) and cyclohexanone were added to the solution obtained by the centrifugation performed as in Photosensitive Member Production Example 109 so that the ratio of the hydroxygallium phthalocyanine pigment, the polyvinyl butyral and the cyclohexanone would be 24:6:190. In a sand mill K-800 (manufactured by Aimex, disk diameter: 70 mm, 5 disks), 220 parts of this mixture was subjected to dispersion with 482 parts of glass beads of 0.9 mm in diameter for 4 hours with cooling water of 18° C. This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 150 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 120

An electrophotographic photosensitive member of Photosensitive Member Production Example 120 was produced in the same manner as in Photosensitive Member Production Example 119, except that the thickness of the charge generating layer was changed from 150 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 121

An electrophotographic photosensitive member of Photosensitive Member Production Example 121 was produced in the same manner as in Photosensitive Member Production Example 109, except that the thickness of the charge transport layer was changed from 15 μm to 11 μm.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 122

An electrophotographic photosensitive member of Photosensitive Member Production Example 122 was produced in the same manner as in Photosensitive Member Production Example 109, except that the thickness of the charge transport layer was changed from 15 μm to 13 μm.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 123

An electrophotographic photosensitive member of Photosensitive Member Production Example 123 was produced in the same manner as in Photosensitive Member Production Example 109, except that the thickness of the charge transport layer was changed from 15 μm to 17 μm.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 124

An electrophotographic photosensitive member of Photosensitive Member Production Example 124 was produced in the same manner as in Photosensitive Member Production Example 109, except that the thickness of the charge transport layer was changed from 15 μm to 20 μm.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 125

An electrophotographic photosensitive member of Photosensitive Member Production Example 125 was produced in the same manner as in Photosensitive Member Production Example 109, except that the thickness of the charge transport layer was changed from 15 μm to 23 μm.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 126

An electrophotographic photosensitive member of Photosensitive Member Production Example 126 was produced in the same manner as in Photosensitive Member Production Example 109, except that the thickness of the charge transport layer was changed from 15 μm to 27 μm.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 127

An electrophotographic photosensitive member of Photosensitive Member Production Example 127 was produced in the same manner as in Photosensitive Member Production Example 107, except that the hydroxygallium phthalocyanine pigment subjected to the milling operation in Photosensitive Member Production Example 5 was replaced with the hydroxygallium phthalocyanine pigment subjected to the milling operation in Photosensitive Member Production Example 59 before the centrifugation in Photosensitive Member Production Example 107.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 128

An electrophotographic photosensitive member of Photosensitive Member Production Example 128 was produced in the same manner as in Photosensitive Member Production Example 81, except that the step of forming the charge generating layer was changed as below.

In a centrifugation container, 25 parts of the chlorogallium phthalocyanine pigment subjected to the milling operation in Photosensitive Member Production Example 81, 5 parts of a polyvinyl butyral S-LEC BX-1 (produced by Sekisui Chemical), and 190 parts of cyclohexanone were subjected to centrifugation for 30 minutes with a high-speed refrigerated centrifuge himac CR22G (manufactured by Hitachi Koki) set at 18° C. For this operation, a rotor R14A (manufactured by Hitachi Koki) was used at a minimum acceleration/deceleration time and a rotational speed of 1,800 rpm. After the centrifugation, the supernatant was immediately collected into another centrifugation container. The thus obtained solution was centrifuged again in the same manner as above except that the rotational speed was changed to 8,000 rpm. After removing the supernatant, the rest of the solution was immediately collected into a sample bottle. The weight ratio of the chlorogallium phthalocyanine pigment to the polyvinyl butyral in the resulting solution was measured by $^{1}$H-NMR. Also, the solids content in the solution was determined by drying the solids in the solution for 30 minutes in a dryer set at 150° C. and measuring the difference between the weights before and after the drying.

Subsequently, polyvinyl butyral S-LEC BX-1 (produced by Sekisui Chemical) and cyclohexanone were added to the solution collected by centrifugation so that the ratio of the chlorogallium phthalocyanine pigment, the polyvinyl butyral and the cyclohexanone would be 30:10:253. In a sand mill K-800 (manufactured by Aimex, disk diameter: 70 mm, 5 disks), 293 parts of this mixture was subjected to dispersion with 643 parts of glass beads of 0.9 mm in diameter for 4 hours with cooling water of 18° C. This operation was performed under the condition where the disks were rotated at 1,800 rpm. To the resulting dispersion liquid were added 592 parts of cyclohexanone and 845 parts of ethyl acetate to yield a coating liquid for forming a charge generating layer. This coating liquid was applied to the surface of the undercoat layer by dipping. The resulting coating film was heated to dry at 100° C. for 10 minutes to yield a 170 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 129

An electrophotographic photosensitive member of Photosensitive Member Production Example 129 was produced in the same manner as in Photosensitive Member Production Example 107, except that the hydroxygallium phthalocyanine pigment subjected to the milling operation in Photosensitive Member Production Example 5 was replaced with the following hydroxygallium phthalocyanine pigment before the centrifugation in Photosensitive Member Production Example 107.

Using a ball mill machine, 0.5 part of the hydroxygallium phthalocyanine pigment produced in Synthesis Example 3 and 9.5 parts of N-methylformamide F0059 (manufactured by Tokyo Chemical Industry) were subjected to milling at room temperature (23° C.) for 140 hours. This operation was performed in the standard bottle PS-6 (manufactured by Hakuyo Glass) under the condition where the bottle was rotated at a speed of 120 rpm. In this operation, media, such as glass beads, were not used. After adding 30 parts of N-methylformamide to the resulting liquid, the mixture was filtered, and the filtration product remaining on the filter was sufficiently washed with tetrahydrofuran. Then, the resulting filtration product was vacuum-dried to yield 0.45 part of a hydroxygallium phthalocyanine pigment.

The resulting pigment before centrifugation was exhibited peaks at Bragg angles 2θ of 7.5°±0.2°, 9.9°±0.2°, 16.2°±0.2°, 18.6°±0.2°, 25.2°±0.2°, and 28.3°±0.2° in the CuKα X-ray diffraction spectrum thereof. The crystallite correlation length r, which was estimated from the peak at 7.5°±0.2° that was the strongest of the peaks in the range of 5° to 35°, was 30 nm. The content of the amide compound (N-methylformamide) represented by formula (A1) in the hydroxygallium phthalocyanine crystalline particles, which was estimated by $^{1}$H-NMR analysis, was 2.7% by mass relative to the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 130

An electrophotographic photosensitive member of Photosensitive Member Production Example 130 was produced in the same manner as in Photosensitive Member Production Example 107, except that the hydroxygallium phthalocyanine pigment subjected to the milling operation in Photosensitive Member Production Example 5 was replaced with the following hydroxygallium phthalocyanine pigment before the centrifugation in Photosensitive Member Production Example 107.

Using a ball mill machine, 0.5 part of the hydroxygallium phthalocyanine pigment produced in Synthesis Example 3 and 9.5 parts of N-methylformamide F0059 (manufactured by Tokyo Chemical Industry) were subjected to milling with 15 parts of glass beads of 0.9 mm in diameter at room temperature (23° C.) for 100 hours. This operation was performed in the standard bottle PS-6 (manufactured by Hakuyo Glass) under the condition where the bottle was rotated at a speed of 60 rpm. The liquid subjected to this operation was filtered through a filter (N-NO. 125T, pore size: 133 μm, manufactured by NBC Meshtec) to remove the glass beads. After adding 30 parts of N-methylformamide to the resulting liquid, the mixture was filtered, and the filtration product remaining on the filter was sufficiently washed with tetrahydrofuran. Then, the resulting filtration product was vacuum-dried to yield 0.45 part of a hydroxygallium phthalocyanine pigment.

The resulting pigment before centrifugation was exhibited peaks at Bragg angles 2θ of 7.5°±0.2°, 9.9°±0.2°, 16.2°±0.2°, 18.6°±0.2°, 25.2°±0.2°, and 28.3°±0.2° in the CuKα X-ray diffraction spectrum thereof. The crystallite correlation length r, which was estimated from the peak at 7.5°±0.2° that was the strongest of the peaks in the range of 5° to 35°, was 24 nm. The content of the amide compound (N-methylformamide) represented by formula (A1) in the hydroxygallium phthalocyanine crystalline particles, which was estimated by $^{1}$H-NMR analysis, was 2.1% by mass relative to the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 131

An electrophotographic photosensitive member of Photosensitive Member Production Example 131 was produced in the same manner as in Photosensitive Member Production Example 107, except that the hydroxygallium phthalocyanine pigment subjected to the milling operation in Photosensitive Member Production Example 5 was replaced with the following hydroxygallium phthalocyanine pigment before the centrifugation in Photosensitive Member Production Example 107.

In a sand mill K-800 (manufactured by Aimex, disk diameter: 70 mm, 5 disks) with cooling water of 18° C., 1 part of the hydroxygallium phthalocyanine pigment produced in Synthesis Example 3 and 9 parts of N-methylformamide F0059 (manufactured by Tokyo Chemical Industry) were subjected to milling for 10 hours with 15 parts of glass beads of 0.9 mm in diameter. This operation was performed under the condition where the disks were rotated at 400 rpm. After adding 30 parts of N-methylformamide to the resulting liquid, the mixture was filtered, and the filtration product remaining on the filter was sufficiently washed with tetrahydrofuran. Then, the resulting filtration product was vacuum-dried to yield 0.46 part of a hydroxygallium phthalocyanine pigment.

The resulting pigment before centrifugation was exhibited peaks at Bragg angles 2θ of 7.5°±0.2°, 9.9°±0.2°, 16.2°±0.2°, 18.6°±0.2°, 25.2°±0.2°, and 28.3°±0.2° in the CuKα X-ray diffraction spectrum thereof. The crystallite correlation length r, which was estimated from the peak at 7.5°±0.2° that was the strongest of the peaks in the range of 5° to 35°, was 28 nm. The content of the amide compound (N-methylformamide) represented by formula (A1) in the hydroxygallium phthalocyanine crystalline particles, which was estimated by $^1$H-NMR analysis, was 2.7% by mass relative to the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 132

An electrophotographic photosensitive member of Photosensitive Member Production Example 132 was produced in the same manner as in Photosensitive Member Production Example 107, except that the hydroxygallium phthalocyanine pigment subjected to the milling operation in Photosensitive Member Production Example 5 was replaced with the following hydroxygallium phthalocyanine pigment before the centrifugation in Photosensitive Member Production Example 107.

Using a ball mill machine, 0.5 part of the hydroxygallium phthalocyanine pigment produced in Synthesis Example 3 and 9.5 parts of N,N-dimethylformamide D0722 (manufactured by Tokyo Chemical Industry) were subjected to milling with 15 parts of glass beads of 0.9 mm in diameter at room temperature (23° C.) for 100 hours. This operation was performed in the standard bottle PS-6 (manufactured by Hakuyo Glass) under the condition where the bottle was rotated at a speed of 60 rpm. The liquid subjected to this operation was filtered through a filter (N-NO. 125T, pore size: 133 μm, manufactured by NBC Meshtec) to remove the glass beads. After adding 30 parts of N,N-dimethylformamide to the resulting liquid, the mixture was filtered, and the filtration product remaining on the filter was sufficiently washed with tetrahydrofuran. Then, the resulting filtration product was vacuum-dried to yield 0.48 part of a hydroxygallium phthalocyanine pigment.

The resulting pigment before centrifugation was exhibited peaks at Bragg angles 2θ of 7.5°±0.2°, 9.9°±0.2°, 16.2°±0.2°, 18.6°±0.2°, 25.2°±0.2°, and 28.3°±0.2° in the CuKα X-ray diffraction spectrum thereof. The crystallite correlation length r, which was estimated from the peak at 7.5°±0.2° that was the strongest of the peaks in the range of 5° to 35°, was 24 nm.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 133

An electrophotographic photosensitive member of Photosensitive Member Production Example 133 was produced in the same manner as in Photosensitive Member Production Example 107, except that the hydroxygallium phthalocyanine pigment subjected to the milling operation in Photosensitive Member Production Example 5 was replaced with the following hydroxygallium phthalocyanine pigment before the centrifugation in Photosensitive Member Production Example 107.

In a sand mill K-800 (manufactured by Aimex, disk diameter: 70 mm, 5 disks) with cooling water of 18° C., 1 part of the hydroxygallium phthalocyanine pigment produced in Synthesis Example 3 and 9 parts of N,N-dimethylformamide D0722 (manufactured by Tokyo Chemical Industry) were subjected to milling for 30 hours with 15 parts of glass beads of 0.9 mm in diameter. This operation was performed under the condition where the disks were rotated at 600 rpm. The liquid subjected to this operation was filtered through a filter (N-NO. 125T, pore size: 133 μm, manufactured by NBC Meshtec) to remove the glass beads. After adding 30 parts of N,N-dimethylformamide to the resulting liquid, the mixture was filtered, and the filtration product remaining on the filter was sufficiently washed with tetrahydrofuran. Then, the resulting filtration product was vacuum-dried to yield 0.45 part of a hydroxygallium phthalocyanine pigment.

The resulting pigment before centrifugation was exhibited peaks at Bragg angles 2θ of 7.5°±0.2°, 9.9°±0.2°, 16.2°±0.2°, 18.6°±0.2°, 25.2°±0.2°, and 28.3°±0.2° in the CuKα X-ray diffraction spectrum thereof. The crystallite correlation length r, which was estimated from the peak at 7.5°±0.2° that was the strongest of the peaks in the range of 5° to 35°, was 25 nm.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 134

An electrophotographic photosensitive member of Photosensitive Member Production Example 134 was produced in the same manner as in Photosensitive Member Production Example 128, except that the chlorogallium phthalocyanine pigment subjected to the milling operation in Photosensitive Member Production Example 81 was replaced with the following chlorogallium phthalocyanine pigment before the centrifugation in Photosensitive Member Production Example 128.

With a paint shaker (manufactured by Toyo Seiki), 0.5 part of the chlorogallium phthalocyanine pigment produced in Synthesis Example 4 and 10 parts of N,N-dimethylformamide D0722 (produced by Tokyo Chemical Industry) were subjected to milling with 15 parts of glass beads of 0.9 mm in diameter at room temperature (23° C.) for 50 hours. For this operation, a standard bottle PS-6 (manufactured by Hakuyo Glass) was used as the container. The liquid subjected to this operation was filtered through a filter (N-NO. 125T, pore size: 133 μm, manufactured by NBC Meshtec) to remove the glass beads. After adding 30 parts of N,N-dimethylformamide to the resulting liquid, the mixture was filtered, and the filtration product remaining on the filter was sufficiently washed with tetrahydrofuran. Then, the washed filtration product was vacuum-dried to yield 0.47 part of a chlorogallium phthalocyanine pigment.

The resulting pigment before centrifugation was exhibited peaks at Bragg angles 2θ of 7.4°±0.2°, 16.6°±0.2°, 25.5°±0.2°, and 28.3°±0.2° in the CuKα X-ray diffraction spectrum thereof. The crystallite correlation length r, which was estimated from the peak at 7.4° that was the strongest of the peaks in the range of 5° to 35°, was 16 nm.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 135

An electrophotographic photosensitive member of Photosensitive Member Production Example 135 was produced in the same manner as in Photosensitive Member Production Example 100, except that the step of forming the charge generating layer was changed as below.

In a sand mill K-800 (manufactured by Aimex, disk diameter: 70 mm, 5 disks) with cooling water of 18° C., 0.5 part of the titanyl phthalocyanine pigment produced in Synthesis Example 5 and 10 parts of tetrahydrofuran were subjected to milling for 48 hours with 15 parts of glass beads of 0.9 mm in diameter. This operation was performed under the condition where the disks were rotated at 500 rpm. The liquid subjected to this operation was filtered through a filter (N-NO. 125T, pore size: 133 μm, manufactured by NBC Meshtec) to remove the glass beads. After adding 30 parts of tetrahydrofuran to the resulting liquid, the mixture was filtered, and the filtration product remaining on the filter was sufficiently washed with methanol and water. Then, the washed filtration product was vacuum-dried to yield 0.46 part of a titanyl phthalocyanine pigment.

The resulting pigment was exhibited a peak at a Bragg angle 2θ of 27.2°±0.2° in the CuKα X-ray diffraction spectrum thereof. The crystallite correlation length r, which was estimated from the peak at 27.2°±0.2° that was the strongest of the peaks in the range of 5° to 35°, was 34 nm.

In a centrifugation container, 25 parts of the resulting titanyl phthalocyanine pigment, 5 parts of a polyvinyl butyral S-LEC BX-1 (produced by Sekisui Chemical), and 190 parts of cyclohexanone were subjected to centrifugation for 30 minutes with a high-speed refrigerated centrifuge himac CR22G (manufactured by Hitachi Koki) set at 18° C. For this operation, a rotor R14A (manufactured by Hitachi Koki) was used at a minimum acceleration/deceleration time and a rotational speed of 1,800 rpm. After the centrifugation, the supernatant was immediately collected into another centrifugation container. The solution, or supernatant, was centrifuged again in the same manner as above except that the rotational speed was changed to 8,000 rpm. After removing the supernatant, the rest of the solution was immediately collected into a sample bottle. The weight ratio of the titanyl phthalocyanine pigment to the polyvinyl butyral in the resulting solution was measured by $^{1}$H-NMR. Also, the solids content in the solution was determined by drying the solids in the solution for 30 minutes in a dryer set at 150° C. and measuring the difference between the weights before and after the drying.

Subsequently, polyvinyl butyral S-LEC BX-1 (produced by Sekisui Chemical) and cyclohexanone were added to the solution collected by centrifugation so that the ratio of the titanyl phthalocyanine pigment, the polyvinyl butyral and the cyclohexanone would be 12:10:139. In a sand mill K-800 (manufactured by Aimex, disk diameter: 70 mm, 5 disks), 161 parts of this mixture was subjected to dispersion with 354 parts of glass beads of 0.9 mm in diameter for 4 hours with cooling water of 18° C. This operation was performed under the condition where the disks were rotated at 1,800 rpm. To the resulting dispersion liquid were added 326 parts of cyclohexanone and 465 parts of ethyl acetate to yield a coating liquid for forming a charge generating layer. This coating liquid was applied to the surface of the undercoat layer by dipping. The resulting coating film was heated to dry at 100° C. for 10 minutes to yield a 150 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 136

An electrophotographic photosensitive member of Photosensitive Member Production Example 136 was produced in the same manner as in Photosensitive Member Production Example 107, except that the hydroxygallium phthalocyanine pigment subjected to the milling operation in Photosensitive Member Production Example 5 was replaced with the following hydroxygallium phthalocyanine pigment before the centrifugation in Photosensitive Member Production Example 107.

Using a ball mill machine, 0.5 part of the hydroxygallium phthalocyanine pigment produced in Synthesis Example 3 and 9.5 parts of acetone were subjected to milling at room temperature (23° C.) for 40 hours. This operation was performed in the standard bottle PS-6 (manufactured by Hakuyo Glass) under the condition where the bottle was rotated at a speed of 120 rpm. In this operation, media, such as glass beads, were not used. After adding 30 parts of acetone to the resulting liquid, the mixture was filtered, and the filtration product remaining on the filter was sufficiently washed with tetrahydrofuran. Then, the resulting filtration product was vacuum-dried to yield 0.43 part of a hydroxygallium phthalocyanine pigment.

The resulting pigment before centrifugation was exhibited peaks at Bragg angles 2θ of 7.5°±0.2°, 9.9°±0.2°, 16.2°±0.2°, 18.6°±0.2°, 25.2°±0.2°, and 28.3°±0.2° in the CuKα X-ray diffraction spectrum thereof. The crystallite correlation length r, which was estimated from the peak at 7.5°±0.2° that was the strongest of the peaks in the range of 5° to 35°, was 189 nm.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 137

An electrophotographic photosensitive member of Photosensitive Member Production Example 137 was produced in the same manner as in Photosensitive Member Production Example 1, except that the process for producing the hydroxygallium phthalocyanine pigment was changed as below.

Using a ball mill machine, 0.5 part of the hydroxygallium phthalocyanine pigment produced in Synthesis Example 3 and 9.5 parts of N-methylformamide F0059 (manufactured by Tokyo Chemical Industry) were subjected to milling at room temperature (23° C.) for 10 hours. This operation was performed in the standard bottle PS-6 (manufactured by Hakuyo Glass) under the condition where the bottle was rotated at a speed of 120 rpm. In this operation, media, such as glass beads, were not used. After adding 30 parts of N-methylformamide to the resulting liquid, the mixture was filtered, and the filtration product remaining on the filter was sufficiently washed with tetrahydrofuran. Then, the resulting filtration product was vacuum-dried to yield 0.46 part of a hydroxygallium phthalocyanine pigment.

The resulting pigment was exhibited peaks at Bragg angles 2θ of 7.5°±0.2°, 9.9°±0.2°, 16.2°±0.2°, 18.6°±0.2°, 25.2°±0.2°, and 28.3°±0.2° in the CuKα X-ray diffraction spectrum thereof. The crystallite correlation length r, which was estimated from the peak at 7.5°±0.2° that was the strongest of the peaks in the range of 5° to 35°, was 23 nm. The content of the amide compound (N-methylformamide) represented by formula (A1) in the hydroxygallium phthalocyanine crystalline particles, which was estimated by $^{1}$H-NMR analysis, was 3.1% by mass relative to the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 138

An electrophotographic photosensitive member of Photosensitive Member Production Example 138 was produced in the same manner as in Photosensitive Member Production Example 137, except that the time for the milling operation using the ball mill machine was changed from 10 hours to 20 hours. The content of the amide compound (N-methylformamide) represented by formula (A1) in the hydroxygallium phthalocyanine crystalline particles of the pigment, which was estimated by $^{1}$H-NMR analysis, was 3.0% by mass relative to the mass of the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 139

An electrophotographic photosensitive member of Photosensitive Member Production Example 139 was produced in the same manner as in Photosensitive Member Production Example 137, except that the time for the milling operation using the ball mill machine was changed from 10 hours to 30 hours. The content of the amide compound (N-methylformamide) represented by formula (A1) in the hydroxygallium phthalocyanine crystalline particles of the pigment, which was estimated by $^{1}$H-NMR analysis, was 2.8% by mass relative to the mass of the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 140

An electrophotographic photosensitive member of Photosensitive Member Production Example 140 was produced in the same manner as in Photosensitive Member Production Example 137, except that the time for the milling operation using the ball mill machine was changed from 10 hours to 40 hours. The content of the amide compound (N-methylformamide) represented by formula (A1) in the hydroxygallium phthalocyanine crystalline particles of the pigment, which was estimated by $^{1}$H-NMR analysis, was 2.8% by mass relative to the mass of the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 141

An electrophotographic photosensitive member of Photosensitive Member Production Example 141 was produced in the same manner as in Photosensitive Member Production Example 137, except that the time for the milling operation using the ball mill machine was changed from 10 hours to 100 hours. The content of the amide compound (N-methylformamide) represented by formula (A1) in the hydroxygallium phthalocyanine crystalline particles of the pigment, which was estimated by $^{1}$H-NMR analysis, was 2.7% by mass relative to the mass of the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 142

An electrophotographic photosensitive member of Photosensitive Member Production Example 142 was produced in the same manner as in Photosensitive Member Production Example 129, except that the centrifugation was not performed. The content of the amide compound (N-methylformamide) represented by formula (A1) in the hydroxygallium phthalocyanine crystalline particles of the pigment, which was estimated by $^{1}$H-NMR analysis, was 2.7% by mass relative to the mass of the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 143

An electrophotographic photosensitive member of Photosensitive Member Production Example 143 was produced in the same manner as in Photosensitive Member Production Example 137, except that the time for the milling operation using the ball mill machine was changed from 10 hours to 300 hours. The content of the amide compound (N-methylformamide) represented by formula (A1) in the hydroxygallium phthalocyanine crystalline particles of the pigment, which was estimated by $^{1}$H-NMR analysis, was 2.6% by mass relative to the mass of the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 144

An electrophotographic photosensitive member of Photosensitive Member Production Example 144 was produced in the same manner as in Photosensitive Member Production Example 137, except that the time for the milling operation using the ball mill machine was changed from 10 hours to 500 hours. The content of the amide compound (N-methylformamide) represented by formula (A1) in the hydroxygallium phthalocyanine crystalline particles of the pigment, which was estimated by $^{1}$H-NMR analysis, was 2.5% by mass relative to the mass of the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 145

An electrophotographic photosensitive member of Photosensitive Member Production Example 145 was produced in the same manner as in Photosensitive Member Production Example 137, except that the time for the milling operation using the ball mill machine was changed from 10 hours to 1,000 hours. The content of the amide compound (N-methylformamide) represented by formula (A1) in the hydroxygallium phthalocyanine crystalline particles of the pigment, which was estimated by $^{1}$H-NMR analysis, was 2.5% by mass relative to the mass of the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 146

An electrophotographic photosensitive member of Photosensitive Member Production Example 146 was produced in the same manner as in Photosensitive Member Production Example 137, except that the time for the milling operation using the ball mill machine was changed from 10 hours to 2,000 hours. The content of the amide compound (N-methylformamide) represented by formula (A1) in the hydroxygallium phthalocyanine crystalline particles of the pigment, which was estimated by $^{1}$H-NMR analysis, was 2.4% by mass relative to the mass of the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 147

An electrophotographic photosensitive member of Photosensitive Member Production Example 147 was produced in the same manner as in Photosensitive Member Production Example 1, except that the process for producing the hydroxygallium phthalocyanine pigment was changed as below.

Using a paint shaker (manufactured by Toyo Seiki), 0.5 part of the hydroxygallium phthalocyanine pigment produced in Synthesis Example 3 and 9.5 parts of N-methylformamide F0059 (manufactured by Tokyo Chemical Industry) were subjected to milling with 15 parts of glass beads of 0.9 mm in diameter at room temperature (23° C.) for 20 hours. For this operation, a standard bottle PS-6 (manufactured by Hakuyo Glass) was used as the container. The liquid subjected to this operation was filtered through a filter (N-NO. 125T, pore size: 133 μm, manufactured by NBC Meshtec) to remove the glass beads. After adding 30 parts of N-methylformamide to the resulting liquid, the mixture was filtered, and the filtration product remaining on the filter was sufficiently washed with tetrahydrofuran. Then, the resulting filtration product was vacuum-dried to yield 0.46 part of a hydroxygallium phthalocyanine pigment.

The resulting pigment was exhibited peaks at Bragg angles 2θ of 7.5°±0.2°, 9.9°±0.2°, 16.2°±0.2°, 18.6°±0.2°, 25.2°±0.2°, and 28.3°±0.2° in the CuKα X-ray diffraction spectrum thereof. The crystallite correlation length r, which was estimated from the peak at 7.5°±0.2° that was the strongest of the peaks in the range of 5° to 35°, was 15 nm. The content of the amide compound (N-methylformamide) represented by formula (A1) in the hydroxygallium phthalocyanine crystalline particles, which was estimated by $^{1}$H-NMR analysis, was 1.9% by mass relative to the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 148

An electrophotographic photosensitive member of Photosensitive Member Production Example 148 was produced in the same manner as in Photosensitive Member Production Example 147, except that the time for the milling operation using the paint shaker was changed from 20 hours to 30 hours. The content of the amide compound (N-methylformamide) represented by formula (A1) in the hydroxygallium phthalocyanine crystalline particles of the pigment, which was estimated by $^{1}$H-NMR analysis, was 1.4% by mass relative to the mass of the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 149

An electrophotographic photosensitive member of Photosensitive Member Production Example 149 was produced in the same manner as in Photosensitive Member Production Example 1, except that the process for producing the hydroxygallium phthalocyanine pigment was changed as below.

Using a ball mill machine, 0.5 part of the hydroxygallium phthalocyanine pigment produced in Synthesis Example 3 and 9.5 parts of N-methylformamide F0059 (manufactured by Tokyo Chemical Industry) were subjected to milling with 15 parts of glass beads of 0.9 mm in diameter at room temperature (23° C.) for 5 hours. This operation was performed in the standard bottle PS-6 (manufactured by Hakuyo Glass) under the condition where the bottle was rotated at a speed of 60 rpm. The liquid subjected to this operation was filtered through a filter (N-NO. 125T, pore size: 133 μm, manufactured by NBC Meshtec) to remove the glass beads. After adding 30 parts of N-methylformamide to the resulting liquid, the mixture was filtered, and the filtration product remaining on the filter was sufficiently washed with tetrahydrofuran. Then, the resulting filtration product was vacuum-dried to yield 0.47 part of a hydroxygallium phthalocyanine pigment.

The crystallite correlation length r of the resulting pigment, which was estimated from the peak at 7.5°±0.2° that was the strongest of the peaks in the CuKα X-ray diffraction spectrum, was 23 nm. The content of the amide compound (N-methylformamide) represented by formula (A1) in the hydroxygallium phthalocyanine crystalline particles, which was estimated by $^{1}$H-NMR analysis, was 3.1% by mass relative to the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 150

An electrophotographic photosensitive member of Photosensitive Member Production Example 150 was produced in the same manner as in Photosensitive Member Production Example 149, except that the time for the milling operation using the ball mill machine was changed from 5 hours to 10 hours. The content of the amide compound (N-methylformamide) represented by formula (A1) in the hydroxygallium phthalocyanine crystalline particles of the pigment, which was estimated by $^{1}$H-NMR analysis, was 2.7% by mass relative to the mass of the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 151

An electrophotographic photosensitive member of Photosensitive Member Production Example 151 was produced in the same manner as in Photosensitive Member Production Example 149, except that the time for the milling operation using the ball mill machine was changed from 5 hours to 30 hours. The content of the amide compound (N-methylformamide) represented by formula (A1) in the hydroxygallium phthalocyanine crystalline particles of the pigment, which was estimated by $^{1}$H-NMR analysis, was 2.6% by mass relative to the mass of the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 152

An electrophotographic photosensitive member of Photosensitive Member Production Example 152 was produced in the same manner as in Photosensitive Member Production Example 130, except that the centrifugation was not performed. The content of the amide compound (N-methylformamide) represented by formula (A1) in the hydroxygallium phthalocyanine crystalline particles of the pigment, which was estimated by $^{1}$H-NMR analysis, was 2.1% by mass relative to the mass of the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 153

An electrophotographic photosensitive member of Photosensitive Member Production Example 153 was produced in the same manner as in Photosensitive Member Production Example 131, except that the centrifugation was not performed. The content of the amide compound (N-methylformamide) represented by formula (A1) in the hydroxygallium phthalocyanine crystalline particles of the pigment, which was estimated by $^{1}$H-NMR analysis, was 2.7% by mass relative to the mass of the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 154

An electrophotographic photosensitive member of Photosensitive Member Production Example 154 was produced in the same manner as in Photosensitive Member Production Example 37, except that the time for the milling operation using the sand mill was changed from 70 hours to 500 hours. The content of the amide compound (N-methylformamide) represented by formula (A1) in the hydroxygallium phthalocyanine crystalline particles of the pigment, which was estimated by $^{1}$H-NMR analysis, was 0.8% by mass relative to the mass of the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 155

An electrophotographic photosensitive member of Photosensitive Member Production Example 155 was produced in the same manner as in Photosensitive Member Production Example 1, except that the process for producing the hydroxygallium phthalocyanine pigment was changed as below.

Using a magnetic stirrer, 0.5 part of the hydroxygallium phthalocyanine pigment produced in Synthesis Example 3 and 9.5 parts of N-methylformamide F0059 (product code, manufactured by Tokyo Chemical Industry) were subjected to milling at room temperature (23° C.) for 1 hour. This operation was performed in the standard bottle PS-6 (manufactured by Hakuyo Glass) under the condition where the stirring bar was rotated at a speed of 1,500 rpm. After adding 30 parts of N-methylformamide to the resulting liquid, the mixture was filtered, and the filtration product remaining on the filter was sufficiently washed with tetrahydrofuran. Then, the resulting filtration product was vacuum-dried to yield 0.47 part of a hydroxygallium phthalocyanine pigment.

The crystallite correlation length r of the resulting pigment, which was estimated from the peak at 7.5°±0.2° that was the strongest of the peaks in the CuKα X-ray diffraction spectrum, was 23 nm. The content of the amide compound (N-methylformamide) represented by formula (A1) in the hydroxygallium phthalocyanine crystalline particles, which was estimated by $^{1}$H-NMR analysis, was 2.4% by mass relative to the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 156

An electrophotographic photosensitive member of Photosensitive Member Production Example 156 was produced in the same manner as in Photosensitive Member Production Example 155, except that the time for the milling operation using the magnetic stirrer was changed from 1 hour to 5 hours. The content of the amide compound (N-methylformamide) represented by formula (A1) in the hydroxygallium phthalocyanine crystalline particles of the pigment, which was estimated by $^{1}$H-NMR analysis, was 2.9% by mass relative to the mass of the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 157

An electrophotographic photosensitive member of Photosensitive Member Production Example 157 was produced in the same manner as in Photosensitive Member Production Example 155, except that the time for the milling operation using the magnetic stirrer was changed from 1 hour to 10 hours. The content of the amide compound (N-methylformamide) represented by formula (A1) in the hydroxygallium phthalocyanine crystalline particles of the pigment, which was estimated by $^{1}$H-NMR analysis, was 2.8% by mass relative to the mass of the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 158

An electrophotographic photosensitive member of Photosensitive Member Production Example 158 was produced in the same manner as in Photosensitive Member Production Example 1, except that the process for producing the hydroxygallium phthalocyanine pigment was changed as below.

Using an ultrasonic disperser UT-205 (manufactured by Sharp), 0.5 part of the hydroxygallium phthalocyanine pigment produced in Synthesis Example 3 and 9.5 parts of N-methylformamide F0059 (manufactured by Tokyo Chemical Industry) were subjected to milling at room temperature (23° C.) for 1 hour. For this operation, a standard bottle PS-6 (manufactured by Hakuyo Glass) was used as the container, and the power of the ultrasonic disperser was 100%. In this operation, media, such as glass beads, were not used. After adding 30 parts of N-methylformamide to the resulting liquid, the mixture was filtered, and the filtration product remaining on the filter was sufficiently washed with tetrahydrofuran. Then, the resulting filtration product was vacuum-dried to yield 0.47 part of a hydroxygallium phthalocyanine pigment.

The crystallite correlation length r of the resulting pigment, which was estimated from the peak at 7.5°±0.2° that was the strongest of the peaks in the CuKα X-ray diffraction spectrum, was 25 nm. The content of the amide compound (N-methylformamide) represented by formula (A1) in the hydroxygallium phthalocyanine crystalline particles, which was estimated by $^{1}$H-NMR analysis, was 2.7% by mass relative to the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 159

An electrophotographic photosensitive member of Photosensitive Member Production Example 159 was produced in the same manner as in Photosensitive Member Production Example 158, except that the time for the milling operation using the ultrasonic disperser was changed from 1 hour to 5 hours. The content of the amide compound (N-methylformamide) represented by formula (A1) in the hydroxygallium phthalocyanine crystalline particles of the pigment, which was estimated by $^{1}$H-NMR analysis, was 2.5% by mass relative to the mass of the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 160

An electrophotographic photosensitive member of Photosensitive Member Production Example 160 was produced in the same manner as in Photosensitive Member Production Example 158, except that the time for the milling operation using the ultrasonic disperser was changed from 1 hour to 10 hours. The content of the amide compound (N-methylformamide) represented by formula (A1) in the hydroxygallium phthalocyanine crystalline particles of the pigment, which was estimated by $^{1}$H-NMR analysis, was 2.3% by mass relative to the mass of the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 161

An electrophotographic photosensitive member of Photosensitive Member Production Example 161 was produced in the same manner as in Photosensitive Member Production Example 1, except that the first milling operation and the second milling operation were reversed as below.

In the first milling operation, 0.5 part of the hydroxygallium phthalocyanine pigment produced in Synthesis Example 3 and 9.5 parts of N-methylformamide F0059 (manufactured by Tokyo Chemical Industry) were subjected to milling at room temperature (23° C.) for 40 hours by using a ball mill machine. This operation was performed in the standard bottle PS-6 (manufactured by Hakuyo Glass) under the condition where the bottle was rotated at a speed of 120 rpm. In this operation, media, such as glass beads, were not used. The liquid thus subjected to the milling operation was further subjected to milling (second milling operation) with 15 parts of glass beads of 0.9 mm in diameter with a paint shaker (manufactured by Toyo Seiki) at room temperature (23° C.) for 6 hours. For this operation, the standard bottle PS-6 (manufactured by Hakuyo Glass) was used as it was without removing the contents therefrom. The liquid subjected to this operation was filtered through a filter (N-NO. 125T, pore size: 133 μm, manufactured by NBC Meshtec) to remove the glass beads. After adding 30 parts of N-methylformamide to the resulting liquid, the mixture was filtered, and the filtration product remaining on the filter was sufficiently washed with tetrahydrofuran. Then, the resulting filtration product was vacuum-dried to yield 0.46 part of a hydroxygallium phthalocyanine pigment.

The crystallite correlation length r of the resulting pigment, which was estimated from the peak at 7.5°±0.2° that was the strongest of the peaks in the CuKα X-ray diffraction spectrum, was 26 nm. The content of the amide compound (N-methylformamide) represented by formula (A1) in the hydroxygallium phthalocyanine crystalline particles, which was estimated by $^{1}$H-NMR analysis, was 2.2% by mass relative to the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 3.

Photosensitive Member Production Example 162

An electrophotographic photosensitive member of Photosensitive Member Production Example 162 was produced in the same manner as in Photosensitive Member Production Example 6, except that the first milling operation and the second milling operation were reversed as below.

In the first milling operation, 0.5 part of the hydroxygallium phthalocyanine pigment produced in Synthesis Example 3 and 9.5 parts of N-methylformamide F0059 (manufactured by Tokyo Chemical Industry) were subjected to milling with 15 parts of glass beads of 0.9 mm in diameter at room temperature (23° C.) for 40 hours by using a ball mill machine. This operation was performed in the standard bottle PS-6 (manufactured by Hakuyo Glass) under the condition where the bottle was rotated at a speed of 120 rpm. The mixture thus subjected to the milling operation was further subjected to milling (second milling operation) with a paint shaker (manufactured by Toyo Seiki) at room temperature (23° C.) for 6 hours. For this operation, the container was set to the paint shaker as it was without removing the contents therefrom. Hence, both the first and the second milling operation were performed with the same glass beads. The liquid subjected to this operation was filtered through a filter (N-NO. 125T, pore size: 133 μm, manufactured by NBC Meshtec) to remove the glass beads. After adding 30 parts of N-methylformamide to the resulting liquid, the mixture was filtered, and the filtration product remaining on the filter was sufficiently washed with tetrahydrofuran. Then, the resulting filtration product was vacuum-dried to yield 0.46 part of a hydroxygallium phthalocyanine pigment.

The crystallite correlation length r of the resulting pigment, which was estimated from the peak at 7.5°±0.2° that was the strongest of the peaks in the CuKα X-ray diffraction spectrum, was 25 nm. The content of the amide compound (N-methylformamide) represented by formula (A1) in the hydroxygallium phthalocyanine crystalline particles, which was estimated by $^{1}$H-NMR analysis, was 2.0% by mass relative to the hydroxygallium phthalocyanine.

The physical properties of the phthalocyanine pigment, the charge generating layer, and the electrophotographic photosensitive member that were produced as just described were determined in the same manner as in Photosensitive Member Production Example 1, and the results are shown in Table 3.

TABLE 3

Physical Properties of Phthalocyanine Pigments and Photosensitive Members

| Photosensitive Member Production Example No. | Pigment | Crystallite correlation length r [nm] | Crystalline particle size R [nm] | k = r/R | Charge generating layer thickness d [nm] | Volume ratio P of charge generating material | Absorption coefficient α [nm$^{-1}$] | Charge transport layer thickness [μm] | $\Phi_i \cdot \Psi_i$ |
|---|---|---|---|---|---|---|---|---|---|
| Photosensitive Member Production Example 107 | HOGaPc | 35 | 100 | 0.35 | 150 | 0.58 | 0.0055 | 15 | 0.41 |
| Photosensitive Member Production Example 108 | HOGaPc | 27 | 97 | 0.28 | 150 | 0.58 | 0.0055 | 15 | 0.39 |
| Photosensitive Member Production Example 109 | HOGaPc | 26 | 110 | 0.24 | 150 | 0.58 | 0.0055 | 15 | 0.37 |
| Photosensitive Member Production Example 110 | HOGaPc | 26 | 110 | 0.24 | 130 | 0.58 | 0.0055 | 15 | 0.33 |
| Photosensitive Member Production Example 111 | HOGaPc | 26 | 110 | 0.24 | 170 | 0.58 | 0.0055 | 15 | 0.41 |
| Photosensitive Member Production Example 112 | HOGaPc | 26 | 110 | 0.24 | 190 | 0.58 | 0.0055 | 15 | 0.45 |
| Photosensitive Member Production Example 113 | HOGaPc | 26 | 110 | 0.24 | 150 | 0.51 | 0.0049 | 15 | 0.32 |
| Photosensitive Member Production Example 114 | HOGaPc | 26 | 110 | 0.24 | 190 | 0.51 | 0.0049 | 15 | 0.37 |
| Photosensitive Member Production Example 115 | HOGaPc | 26 | 110 | 0.24 | 150 | 0.67 | 0.0064 | 15 | 0.49 |
| Photosensitive Member Production Example 116 | HOGaPc | 26 | 110 | 0.24 | 190 | 0.67 | 0.0064 | 15 | 0.56 |
| Photosensitive Member Production Example 117 | HOGaPc | 26 | 110 | 0.24 | 150 | 0.71 | 0.0068 | 15 | 0.50 |

TABLE 3-continued

Physical Properties of Phthalocyanine Pigments and Photosensitive Members

| Photosensitive Member Production Example No. | Pigment | Crystallite correlation length r [nm] | Crystalline particle size R [nm] | k = r/R | Charge generating layer thickness d [nm] | Volume ratio P of charge generating material | Absorption coefficient α [$nm^{-1}$] | Charge transport layer thickness [μm] | $\Phi_i \cdot \Psi_i$ |
|---|---|---|---|---|---|---|---|---|---|
| Photosensitive Member Production Example 118 | HOGaPc | 26 | 110 | 0.24 | 190 | 0.71 | 0.0068 | 15 | 0.60 |
| Photosensitive Member Production Example 119 | HOGaPc | 26 | 110 | 0.24 | 150 | 0.73 | 0.0070 | 15 | 0.53 |
| Photosensitive Member Production Example 120 | HOGaPc | 26 | 110 | 0.24 | 190 | 0.73 | 0.0070 | 15 | 0.63 |
| Photosensitive Member Production Example 121 | HOGaPc | 26 | 110 | 0.24 | 150 | 0.58 | 0.0055 | 11 | 0.37 |
| Photosensitive Member Production Example 122 | HOGaPc | 26 | 110 | 0.24 | 150 | 0.58 | 0.0055 | 13 | 0.37 |
| Photosensitive Member Production Example 123 | HOGaPc | 26 | 110 | 0.24 | 150 | 0.58 | 0.0055 | 17 | 0.37 |
| Photosensitive Member Production Example 124 | HOGaPc | 26 | 110 | 0.24 | 150 | 0.58 | 0.0055 | 20 | 0.37 |
| Photosensitive Member Production Example 125 | HOGaPc | 26 | 110 | 0.24 | 150 | 0.58 | 0.0055 | 23 | 0.37 |
| Photosensitive Member Production Example 126 | HOGaPc | 26 | 110 | 0.24 | 150 | 0.58 | 0.0055 | 27 | 0.37 |
| Photosensitive Member Production Example 127 | HOGaPc | 36 | 105 | 0.34 | 170 | 0.58 | 0.0042 | 15 | 0.37 |
| Photosensitive Member Production Example 128 | ClGaPc | 28 | 108 | 0.26 | 170 | 0.67 | 0.0050 | 15 | 0.38 |
| Photosensitive Member Production Example 129 | HOGaPc | 28 | 176 | 0.16 | 150 | 0.58 | 0.0055 | 15 | 0.36 |
| Photosensitive Member Production Example 130 | HOGaPc | 22 | 134 | 0.16 | 150 | 0.58 | 0.0055 | 15 | 0.33 |
| Photosensitive Member Production Example 131 | HOGaPc | 26 | 164 | 0.16 | 150 | 0.58 | 0.0055 | 15 | 0.36 |
| Photosensitive Member Production Example 132 | HOGaPc | 24 | 134 | 0.18 | 150 | 0.58 | 0.0042 | 15 | 0.32 |
| Photosensitive Member Production Example 133 | HOGaPc | 23 | 128 | 0.18 | 150 | 0.58 | 0.0042 | 15 | 0.32 |
| Photosensitive Member Production Example 134 | ClGaPc | 14 | 102 | 0.14 | 170 | 0.67 | 0.0050 | 15 | 0.33 |
| Photosensitive Member Production Example 135 | TiOPc | 30 | 184 | 0.16 | 150 | 0.45 | 0.0066 | 15 | 0.34 |
| Photosensitive Member Production Example 136 | HOGaPc | 104 | 234 | 0.44 | 150 | 0.58 | 0.0042 | 15 | 0.32 |
| Photosensitive Member Production Example 137 | HOGaPc | 23 | 241 | 0.10 | 150 | 0.58 | 0.0055 | 15 | 0.14 |
| Photosensitive Member Production Example 138 | HOGaPc | 25 | 242 | 0.10 | 150 | 0.58 | 0.0055 | 15 | 0.19 |
| Photosensitive Member Production Example 139 | HOGaPc | 25 | 244 | 0.10 | 150 | 0.58 | 0.0055 | 15 | 0.22 |
| Photosensitive Member Production Example 140 | HOGaPc | 27 | 245 | 0.11 | 150 | 0.58 | 0.0055 | 15 | 0.24 |
| Photosensitive Member Production Example 141 | HOGaPc | 27 | 247 | 0.11 | 150 | 0.58 | 0.0055 | 15 | 0.25 |
| Photosensitive Member Production Example 142 | HOGaPc | 30 | 248 | 0.12 | 150 | 0.58 | 0.0055 | 15 | 0.26 |
| Photosensitive Member Production Example 143 | HOGaPc | 29 | 282 | 0.10 | 150 | 0.58 | 0.0055 | 15 | 0.23 |
| Photosensitive Member Production Example 144 | HOGaPc | 29 | 353 | 0.08 | 150 | 0.58 | 0.0055 | 15 | 0.23 |
| Photosensitive Member Production Example 145 | HOGaPc | 31 | 382 | 0.08 | 150 | 0.58 | 0.0055 | 15 | 0.22 |
| Photosensitive Member Production Example 146 | HOGaPc | 34 | 403 | 0.08 | 150 | 0.58 | 0.0055 | 15 | 0.21 |
| Photosensitive Member Production Example 147 | HOGaPc | 15 | 115 | 0.13 | 150 | 0.58 | 0.0055 | 15 | 0.21 |
| Photosensitive Member Production Example 148 | HOGaPc | 15 | 109 | 0.13 | 150 | 0.58 | 0.0055 | 15 | 0.23 |
| Photosensitive Member Production Example 149 | HOGaPc | 23 | 163 | 0.14 | 150 | 0.58 | 0.0055 | 15 | 0.20 |
| Photosensitive Member Production Example 150 | HOGaPc | 23 | 164 | 0.14 | 150 | 0.58 | 0.0055 | 15 | 0.27 |
| Photosensitive Member Production Example 151 | HOGaPc | 24 | 159 | 0.15 | 150 | 0.58 | 0.0055 | 15 | 0.21 |
| Photosensitive Member Production Example 152 | HOGaPc | 24 | 153 | 0.16 | 150 | 0.58 | 0.0055 | 15 | 0.30 |
| Photosensitive Member Production Example 153 | HOGaPc | 28 | 181 | 0.15 | 150 | 0.58 | 0.0055 | 15 | 0.26 |
| Photosensitive Member Production Example 154 | HOGaPc | 27 | 174 | 0.15 | 150 | 0.58 | 0.0055 | 15 | 0.20 |
| Photosensitive Member Production Example 155 | HOGaPc | 23 | 214 | 0.11 | 150 | 0.58 | 0.0055 | 15 | 0.21 |
| Photosensitive Member Production Example 156 | HOGaPc | 25 | 205 | 0.12 | 150 | 0.58 | 0.0055 | 15 | 0.21 |
| Photosensitive Member Production Example 157 | HOGaPc | 25 | 201 | 0.12 | 150 | 0.58 | 0.0055 | 15 | 0.22 |
| Photosensitive Member Production Example 158 | HOGaPc | 25 | 220 | 0.11 | 150 | 0.58 | 0.0055 | 15 | 0.19 |
| Photosensitive Member Production Example 159 | HOGaPc | 25 | 210 | 0.12 | 150 | 0.58 | 0.0055 | 15 | 0.19 |
| Photosensitive Member Production Example 160 | HOGaPc | 25 | 202 | 0.12 | 150 | 0.58 | 0.0055 | 15 | 0.21 |
| Photosensitive Member Production Example 161 | HOGaPc | 26 | 211 | 0.12 | 150 | 0.58 | 0.0055 | 15 | 0.28 |
| Photosensitive Member Production Example 162 | HOGaPc | 25 | 171 | 0.15 | 150 | 0.58 | 0.0055 | 15 | 0.30 |

Photosensitive Member Production Example 163

An electrophotographic photosensitive member of Photosensitive Member Production Example 163 was produced in the same manner as in Photosensitive Member Production Example 132, except that the centrifugation was not performed.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 164

An electrophotographic photosensitive member of Photosensitive Member Production Example 164 was produced in the same manner as in Photosensitive Member Production Example 1, except that the process for producing the hydroxygallium phthalocyanine pigment was changed as below.

Using a ball mill machine, 0.5 part of the hydroxygallium phthalocyanine pigment produced in Synthesis Example 7 and 10 parts of N,N-dimethylformamide D0722 (manufactured by Tokyo Chemical Industry) were subjected to milling with 33 parts of glass beads of 0.3 mm in diameter at a temperature of 25° C. for 48 hours. This operation was performed in the standard bottle PS-6 (manufactured by Hakuyo Glass) under the condition where the bottle was rotated at a speed of 60 rpm. The liquid subjected to this operation was filtered through a filter (N-NO. 125T, pore size: 133 μm, manufactured by NBC Meshtec) to remove the glass beads. After adding 30 parts of N,N-dimethylformamide to the resulting liquid, the mixture was filtered, and the filtration product remaining on the filter was sufficiently washed with acetone. Then, the resulting filtration product was vacuum-dried to yield 0.46 part of a hydroxygallium phthalocyanine pigment.

The crystallite correlation length r of the resulting pigment, which was estimated from the peak at 7.5°±0.2° that was the strongest of the peaks in the CuKα X-ray diffraction spectrum, was 13 nm.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 165

An electrophotographic photosensitive member of Photosensitive Member Production Example 165 was produced in the same manner as in Photosensitive Member Production Example 164, except that the process for producing the hydroxygallium phthalocyanine pigment was changed as below.

Using a ball mill machine, 0.5 part of the hydroxygallium phthalocyanine pigment produced in Synthesis Example 7 and 7.5 parts of N,N-dimethylformamide D0722 (manufactured by Tokyo Chemical Industry) were subjected to milling with 29 parts of glass beads of 0.9 mm in diameter at a temperature of 25° C. for 48 hours. This operation was performed in the standard bottle PS-6 (manufactured by Hakuyo Glass) under the condition where the bottle was rotated at a speed of 60 rpm. The liquid subjected to this operation was filtered through a filter (N-NO. 125T, pore size: 133 μm, manufactured by NBC Meshtec) to remove the glass beads. After adding 30 parts of N,N-dimethylformamide to the resulting liquid, the mixture was filtered, and the filtration product remaining on the filter was sufficiently washed with acetone. Then, the resulting filtration product was vacuum-dried to yield 0.46 part of a hydroxygallium phthalocyanine pigment.

The crystallite correlation length r of the resulting pigment, which was estimated from the peak at 7.5°±0.2° that was the strongest of the peaks in the CuKα X-ray diffraction spectrum, was 13 nm.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 166

An electrophotographic photosensitive member of Photosensitive Member Production Example 166 was produced in the same manner as in Photosensitive Member Production Example 165, except that the time for the milling operation using the ball mill machine was changed from 48 hours to 96 hours.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 167

An electrophotographic photosensitive member of Photosensitive Member Production Example 167 was produced in the same manner as in Photosensitive Member Production Example 165, except that the time for the milling operation using the ball mill machine was changed from 48 hours to 192 hours.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 168

An electrophotographic photosensitive member of Photosensitive Member Production Example 168 was produced in the same manner as in Photosensitive Member Production Example 1, except that the process for producing the hydroxygallium phthalocyanine pigment was changed as below.

Using a ball mill machine, 0.5 part of the hydroxygallium phthalocyanine pigment produced in Synthesis Example 7 and 7.5 parts of N,N-dimethylformamide D0722 (manufactured by Tokyo Chemical Industry) were subjected to milling with 29 parts of glass beads of 1.0 mm in diameter at a temperature of 25° C. for 200 hours. This operation was performed in the standard bottle PS-6 (manufactured by Hakuyo Glass) under the condition where the bottle was rotated at a speed of 60 rpm. The liquid subjected to this operation was filtered through a filter (N-NO. 125T, pore size: 133 μm, manufactured by NBC Meshtec) to remove the glass beads. After adding 30 parts of N,N-dimethylformamide to the resulting liquid, the mixture was filtered through a ceramic filter having a pore size of 1.0 μm, and the filtration product remaining on the filter was washed with 25 parts of acetone. Then, the washed filtration product was dried in a light shield dryer at 80° C. for 24 hours and then vacuum-dried at 110° C. for 2 hours under a reduced pressure of −0.98 kPa to yield 0.46 part of a hydroxygallium phthalocyanine pigment.

The crystallite correlation length r of the resulting pigment, which was estimated from the peak at 7.5°±0.2° that was the strongest of the peaks in the CuKα X-ray diffraction spectrum, was 16 nm.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 169

An electrophotographic photosensitive member of Photosensitive Member Production Example 169 was produced in the same manner as in Photosensitive Member Production Example 165, except that 29 parts of the glass beads of 0.9 mm in diameter used in the process for producing the hydroxygallium phthalocyanine pigment was replaced with 29 parts of glass beads of 5.0 mm in diameter.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 170

An electrophotographic photosensitive member of Photosensitive Member Production Example 170 was produced in the same manner as in Photosensitive Member Production Example 1, except that the process for producing the hydroxygallium phthalocyanine pigment was changed as below.

Using a ball mill machine, 0.5 part of the hydroxygallium phthalocyanine pigment produced in Synthesis Example 8 and 7.5 parts of N,N-dimethylformamide D0722 (manufactured by Tokyo Chemical Industry) were subjected to milling with 29 parts of glass beads of 0.9 mm in diameter at a temperature of 25° C. for 24 hours. This operation was performed in the standard bottle PS-6 (manufactured by Hakuyo Glass) under the condition where the bottle was rotated at a speed of 60 rpm. The liquid subjected to this operation was filtered through a filter (N-NO. 125T, pore size: 133 μm, manufactured by NBC Meshtec) to remove the glass beads. After adding 30 parts of N,N-dimethylformamide to the resulting liquid, the mixture was filtered, and the filtration product remaining on the filter was sufficiently washed with n-butyl acetate. Then, the resulting filtration product was vacuum-dried to yield 0.45 part of a hydroxygallium phthalocyanine pigment.

The crystallite correlation length r of the resulting pigment, which was estimated from the peak at 7.5°±0.2° that was the strongest of the peaks in the CuKα X-ray diffraction spectrum, was 13 nm.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 171

An electrophotographic photosensitive member of Photosensitive Member Production Example 171 was produced in the same manner as in Photosensitive Member Production Example 170, except that 0.5 part of the hydroxygallium phthalocyanine pigment produced in Synthesis Example 8 was replaced with 0.5 part of the hydroxygallium phthalocyanine pigment produced in Synthesis Example 9.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 172

An electrophotographic photosensitive member of Photosensitive Member Production Example 172 was produced in the same manner as in Photosensitive Member Production Example 133, except that the centrifugation was not performed.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 173

An electrophotographic photosensitive member of Photosensitive Member Production Example 173 was produced in the same manner as in Photosensitive Member Production Example 1, except that the process for producing the hydroxygallium phthalocyanine pigment was changed as below.

Using a paint shaker (manufactured by Toyo Seiki), 0.5 part of the hydroxygallium phthalocyanine pigment produced in Synthesis Example 3 and 9.5 parts of N,N-dimethylformamide D0722 (produced by Tokyo Chemical Industry) were subjected to milling with 15 parts of glass beads of 0.9 mm in diameter at room temperature (23° C.) for 4 hours. For this operation, a standard bottle PS-6 (manufactured by Hakuyo Glass) was used as the container. The liquid subjected to this operation was filtered through a filter (N-NO. 125T, pore size: 133 μm, manufactured by NBC Meshtec) to remove the glass beads. After adding 30 parts of N,N-dimethylformamide to the resulting liquid, the mixture was filtered, and the filtration product remaining on the filter was sufficiently washed with tetrahydrofuran. Then, the resulting filtration product was vacuum-dried to yield 0.44 part of a hydroxygallium phthalocyanine pigment.

The crystallite correlation length r of the resulting pigment, which was estimated from the peak at 7.5°±0.2° that was the strongest of the peaks in the CuKα X-ray diffraction spectrum, was 18 nm.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 174

An electrophotographic photosensitive member of Photosensitive Member Production Example 174 was produced in the same manner as in Photosensitive Member Production Example 1, except that the process for producing the hydroxygallium phthalocyanine pigment was changed as below.

Using a ball mill machine, 0.5 part of the hydroxygallium phthalocyanine pigment produced in Synthesis Example 3 and 9.5 parts of dimethyl sulfoxide D0798 (manufactured by Tokyo Chemical Industry) were subjected to milling with 15 parts of glass beads of 0.9 mm in diameter at room temperature (23° C.) for 48 hours. This operation was performed in the standard bottle PS-6 (manufactured by Hakuyo Glass) under the condition where the bottle was rotated at a speed of 60 rpm. The liquid subjected to this operation was filtered through a filter (N-NO. 125T, pore size: 133 μm, manufactured by NBC Meshtec) to remove the glass beads. After adding 30 parts of dimethyl sulfoxide to the resulting liquid, the mixture was filtered, and the filtration product remaining on the filter was sufficiently washed with tetrahydrofuran. Then, the resulting filtration product was vacuum-dried to yield 0.44 part of a hydroxygallium phthalocyanine pigment.

The crystallite correlation length r of the resulting pigment, which was estimated from the peak at 7.5°±0.2° that was the strongest of the peaks in the CuKα X-ray diffraction spectrum, was 23 nm.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 175

An electrophotographic photosensitive member of Photosensitive Member Production Example 175 was produced in the same manner as in Photosensitive Member Production Example 174, except that the time for the milling operation using the ball mill machine was changed from 48 hours to 100 hours.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 176

An electrophotographic photosensitive member of Photosensitive Member Production Example 176 was produced in the same manner as in Photosensitive Member Production Example 174, except that the time for the milling operation using the ball mill machine was changed from 48 hours to 192 hours.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 177

An electrophotographic photosensitive member of Photosensitive Member Production Example 177 was produced in the same manner as in Photosensitive Member Production Example 1, except that the process for producing the hydroxygallium phthalocyanine pigment was changed as below.

In the first milling operation, 0.5 part of the hydroxygallium phthalocyanine pigment produced in Synthesis Example 7 and 8 parts of N,N-dimethylformamide D0722 (manufactured by Tokyo Chemical Industry) were subjected to milling at 30° C. for 24 hours by using a magnetic stirrer. This operation was performed in the standard bottle PS-6 (manufactured by Hakuyo Glass) under the condition where the stirring bar was rotated at a speed of 1,500 rpm. After adding 30 parts of N,N-dimethylformamide to the resulting liquid, the mixture was filtered, and the filtration product remaining on the filter was sufficiently washed with ion exchanged water. Then, the resulting filtration product was vacuum-dried to yield 0.45 part of a hydroxygallium phthalocyanine pigment. Subsequently, 0.5 part of the resulting hydroxygallium phthalocyanine pigment was subjected to milling (second milling operation) with 5 parts of zirconia beads of 5.0 mm in diameter at room temperature (23° C.) for 5 minutes by using a small vibration mill MB-0 (manufactured by Chuo Kakohki). For this operation, an alumina pot was used as the container. Thus, 0.48 part of a hydroxygallium phthalocyanine pigment was produced.

The crystallite correlation length r of the resulting pigment, which was estimated from the peak at 7.5°±0.2° that was the strongest of the peaks in the CuKα X-ray diffraction spectrum, was 21 nm.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 178

An electrophotographic photosensitive member of Photosensitive Member Production Example 178 was produced in the same manner as in Photosensitive Member Production Example 177, except that the time for the second milling operation using the small vibration mill was changed from 5 minutes to 20 minutes.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 179

An electrophotographic photosensitive member of Photosensitive Member Production Example 179 was produced in the same manner as in Photosensitive Member Production Example 177, except that the time for the second milling operation using the small vibration mill was changed from 5 minutes to 40 minutes.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 180

An electrophotographic photosensitive member of Photosensitive Member Production Example 180 was produced in the same manner as in Photosensitive Member Production Example 177, except that the time for the second milling operation using the small vibration mill was changed from 5 minutes to 1 hour.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 181

An electrophotographic photosensitive member of Photosensitive Member Production Example 181 was produced in the same manner as in Photosensitive Member Production Example 177, except that the time for the second milling operation using the small vibration mill was changed from 5 minutes to 2 hours.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 182

An electrophotographic photosensitive member of Photosensitive Member Production Example 182 was produced in the same manner as in Photosensitive Member Production Example 177, except that the second milling operation in the process for producing the hydroxygallium phthalocyanine pigment was changed as below.

In the first milling operation, 0.5 part of the hydroxygallium phthalocyanine pigment produced in Synthesis Example 7 and 8 parts of N,N-dimethylformamide D0722

(manufactured by Tokyo Chemical Industry) were subjected to milling at 30° C. for 24 hours by using a magnetic stirrer. This operation was performed in the standard bottle PS-6 (manufactured by Hakuyo Glass) under the condition where the stirring bar was rotated at a speed of 1,500 rpm. After adding 30 parts of N,N-dimethylformamide to the resulting liquid, the mixture was filtered, and the filtration product remaining on the filter was sufficiently washed with ion exchanged water. Then, the resulting filtration product was vacuum-dried to yield 0.45 part of a hydroxygallium phthalocyanine pigment. Subsequently, a slurry was prepared by mixing 0.5 part of the resulting hydroxygallium phthalocyanine pigment with 5 parts of ion exchanged water having an electrical conductivity of 0.1 μS/cm. The slurry was then subjected to milling (second milling operation) at room temperature (23° C.) for 5 minutes by using a microparticulation emulsification dispersion machine Ultimaizer (manufactured by Sugino Machine). This operation was performed at a pressure of 1,500 kg/cm$^2$ and an ejection rate of 350 mL/min. The resulting slurry was subjected to centrifugation to remove water and then vacuum-dried to yield 0.41 part of a hydroxygallium phthalocyanine pigment.

The crystallite correlation length r of the resulting pigment, which was estimated from the peak at 7.5°±0.2° that was the strongest of the peaks in the CuKα X-ray diffraction spectrum, was 20 nm.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 183

An electrophotographic photosensitive member of Photosensitive Member Production Example 183 was produced in the same manner as in Photosensitive Member Production Example 182, except that the time for the second milling operation using the small vibration mill was changed from 5 minutes to 20 minutes.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 184

An electrophotographic photosensitive member of Photosensitive Member Production Example 184 was produced in the same manner as in Photosensitive Member Production Example 182, except that the time for the second milling operation using the small vibration mill was changed from 5 minutes to 1 hour.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 185

An electrophotographic photosensitive member of Photosensitive Member Production Example 185 was produced in the same manner as in Photosensitive Member Production Example 134, except that the centrifugation was not performed.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 186

An electrophotographic photosensitive member of Photosensitive Member Production Example 186 was produced in the same manner as in Photosensitive Member Production Example 185, except that the time for the milling operation using the paint shaker was changed from 50 hours to 100 hours.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 187

An electrophotographic photosensitive member of Photosensitive Member Production Example 187 was produced in the same manner as in Photosensitive Member Production Example 74, except that the process for producing the chlorogallium phthalocyanine pigment was changed as below.

Using a ball mill machine, 0.5 part of the chlorogallium phthalocyanine pigment produced in Synthesis Example 4 and 10 parts of dimethyl sulfoxide D0798 (manufactured by Tokyo Chemical Industry) were subjected to milling with 15 parts of glass beads of 5.0 mm in diameter at room temperature (23° C.) for 24 hours. This operation was performed in the standard bottle PS-6 (manufactured by Hakuyo Glass) under the condition where the bottle was rotated at a speed of 120 rpm. The liquid subjected to this operation was filtered through a filter (N-NO. 125T, pore size: 133 μm, manufactured by NBC Meshtec) to remove the glass beads. After adding 30 parts of dimethyl sulfoxide to the resulting liquid, the mixture was filtered, and the filtration product remaining on the filter was sufficiently washed with tetrahydrofuran. Then, the washed filtration product was vacuum-dried to yield 0.46 part of a chlorogallium phthalocyanine pigment.

The crystallite correlation length r of the resulting pigment, which was estimated from the peak at 7.4° that was the strongest of the peaks in the CuKα X-ray diffraction spectrum, was 23 nm.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 188

An electrophotographic photosensitive member of Photosensitive Member Production Example 188 was produced in the same manner as in Photosensitive Member Production Example 74, except that the process for producing the chlorogallium phthalocyanine pigment was changed as below.

In the first milling operation, 0.5 part of the chlorogallium phthalocyanine pigment produced in Synthesis Example 6 was subjected to milling with 10 parts of alumina beads of 5.0 mm in diameter at room temperature (23° C.) for 180 hours by using a vibration mill MB-1 (manufactured by Chuo Kakohki). For this operation, an alumina pot was used as the container. Thus, 0.45 part of a chlorogallium phthalocyanine pigment was produced. Subsequently, 0.5 part of the resulting chlorogallium phthalocyanine pigment and 10 parts of dimethyl sulfoxide D0798 (manufactured by Tokyo Chemical Industry) were subjected to milling (second milling operation) with 29 parts of glass beads of 1.0 mm in diameter at 25° C. for 72 hours by using a ball mill machine. This operation was performed in the standard bottle PS-6 (manufactured by Hakuyo Glass) under the condition where the bottle was rotated at a speed of 60 rpm. The liquid subjected to this operation was filtered through a filter (N-NO. 125T, pore size: 133 μm, manufactured by NBC Meshtec) to remove the glass beads. After adding 30 parts of dimethyl sulfoxide to the resulting liquid, the mixture was filtered, and the filtration product remaining on the filter was sufficiently washed with acetone. Then, the washed filtration product was dried by heating at 80° C. for 24 hours under reduced pressure (vacuum) to yield 0.46 part of a chlorogallium phthalocyanine pigment.

The crystallite correlation length r of the resulting pigment, which was estimated from the peak at 7.4° that was the strongest of the peaks in the CuKα X-ray diffraction spectrum, was 13 nm.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 189

An electrophotographic photosensitive member of Photosensitive Member Production Example 189 was produced in the same manner as in Photosensitive Member Production Example 188, except that second milling operation using the ball mill machine, which was performed with 29 parts of glass beads of 1.0 mm in diameter for 72 hours in Photosensitive Member Production Example 188, was performed with 29 parts of glass beads of 1.5 mm in diameter for 96 hours.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 190

An electrophotographic photosensitive member of Photosensitive Member Production Example 190 was produced in the same manner as in Photosensitive Member Production Example 189, except that the time for the second milling operation using the ball mill machine was changed from 96 hours to 120 hours.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 191

An electrophotographic photosensitive member of Photosensitive Member Production Example 191 was produced in the same manner as in Photosensitive Member Production Example 188, except that second milling operation, which was performed with 10 parts of dimethyl sulfoxide and 29 parts of glass beads of 1.0 mm in diameter in the standard bottle PS-6 (manufactured by Hakuyo Glass) in Photosensitive Member Production Example 188, was performed with 13 parts of dimethyl sulfoxide and 37 parts of glass beads of 0.3 mm in diameter in a 110 mL stainless (SUS-304) pot (manufactured by Irie Shokai).

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 192

An electrophotographic photosensitive member of Photosensitive Member Production Example 192 was produced in the same manner as in Photosensitive Member Production Example 74, except that the process for producing the chlorogallium phthalocyanine pigment was changed as below.

In the first milling operation, 0.5 part of the chlorogallium phthalocyanine pigment produced in Synthesis Example 10 was subjected to milling with 10 parts of alumina beads of 5.0 mm in diameter at room temperature (23° C.) for 180 hours by using a vibration mill MB-1 (manufactured by Chuo Kakohki). For this operation, an alumina pot was used as the container. Thus, 0.45 part of a chlorogallium phthalocyanine pigment was produced. Subsequently, 0.5 part of the resulting chlorogallium phthalocyanine pigment and 50 parts of dimethyl sulfoxide D0798 (produced by Tokyo Chemical Industry) were subjected to milling (second milling operation) for 24 hours by using a stirring vessel equipped with a tilted stirring paddle and a baffle plate in a thermostatic bath of 20° C. This operation was performed under the condition where the stirring paddle was rotated at 250 rpm. After adding 30 parts of dimethyl sulfoxide to the resulting liquid, the mixture was filtered, and the filtration product remaining on the filter was sufficiently washed with ion exchanged water. Then, the washed filtration product was dried by heating at 80° C. for 24 hours under reduced pressure (vacuum) and heating at 150° C. for 5 hours under reduced pressure (vacuum) to yield 0.46 part of a chlorogallium phthalocyanine pigment.

The crystallite correlation length r of the resulting pigment, which was estimated from the peak at 7.4° that was the strongest of the peaks in the CuKα X-ray diffraction spectrum, was 17 nm.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 193

An electrophotographic photosensitive member of Photosensitive Member Production Example 193 was produced in the same manner as in Photosensitive Member Production Example 192, except that the temperature of the thermostatic bath used in the second milling operation was changed from 20° C. to 28° C.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 194

An electrophotographic photosensitive member of Photosensitive Member Production Example 194 was produced in the same manner as in Photosensitive Member Production Example 74, except that the process for producing the chlorogallium phthalocyanine pigment was changed as below.

In the first milling operation, 0.5 part of the chlorogallium phthalocyanine pigment produced in Synthesis Example 10 was subjected to milling with 10 parts of alumina beads of 5.0 mm in diameter at room temperature (23° C.) for 180 hours by using a vibration mill MB-1 (manufactured by Chuo Kakohki). For this operation, an alumina pot was used as the container. Thus, 0.45 part of a chlorogallium phthalocyanine pigment was produced. Subsequently, 0.5 part of the resulting chlorogallium phthalocyanine pigment and 50 parts of benzyl alcohol B2378 (produced by Tokyo Chemical Industry) were subjected to milling (second milling operation) for 24 hours by using a stirring vessel equipped with a tilted stirring paddle and a baffle plate in a thermostatic bath of 5° C. This operation was performed under the condition where the stirring paddle was rotated at 200 rpm. The resulting liquid was filtered through a monolith ceramic membrane filter (37 holes of 3 mm in diameter, manufactured by NGK) using ethyl acetate and then dried by heating at 80° C. for 24 hours under reduced pressure (vacuum) in a vibration fluidizing vacuum dryer VFD (manufactured by Mitsubishi Materials Techno). The resulting product was further dried by heating at 150° C. for 5 hours under reduced pressure (vacuum) to yield 0.47 part of a chlorogallium phthalocyanine pigment.

The crystallite correlation length r of the resulting pigment, which was estimated from the peak at 7.4° that was the strongest of the peaks in the CuKα X-ray diffraction spectrum, was 18 nm.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 195

An electrophotographic photosensitive member of Photosensitive Member Production Example 195 was produced in the same manner as in Photosensitive Member Production Example 100, except that the process for producing the titanyl phthalocyanine pigment was changed as below.

In a sand mill K-800 (manufactured by Aimex, disk diameter: 70 mm, 5 disks) with cooling water of 18° C., 0.5 part of the titanyl phthalocyanine pigment produced in Synthesis Example 5 and 10 parts of tetrahydrofuran were subjected to milling for 1 hour with 15 parts of glass beads of 0.9 mm in diameter. This operation was performed under the condition where the disks were rotated at 500 rpm. The liquid subjected to this operation was filtered through a filter (N-NO. 125T, pore size: 133 μm, manufactured by NBC Meshtec) to remove the glass beads. After adding 30 parts of tetrahydrofuran to the resulting liquid, the mixture was filtered, and the filtration product remaining on the filter was sufficiently washed with methanol and water. Then, the washed filtration product was vacuum-dried to yield 0.45 part of a titanyl phthalocyanine pigment.

The crystallite correlation length r of the resulting pigment, which was estimated from the peak at 27.2°±0.2° that was the strongest of the peaks in the CuKα X-ray diffraction spectrum, was 23 nm.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 196

An electrophotographic photosensitive member of Photosensitive Member Production Example 196 was produced in the same manner as in Photosensitive Member Production Example 195, except that the time for the milling operation using the sand mill was changed from 1 hour to 5 hours.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 197

An electrophotographic photosensitive member of Photosensitive Member Production Example 197 was produced in the same manner as in Photosensitive Member Production Example 195, except that the time for the milling operation using the sand mill was changed from 1 hour to 10 hours.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 198

An electrophotographic photosensitive member of Photosensitive Member Production Example 198 was produced in the same manner as in Photosensitive Member Production Example 195, except that the time for the milling operation using the sand mill was changed from 1 hour to 20 hours.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 199

An electrophotographic photosensitive member of Photosensitive Member Production Example 199 was produced in the same manner as in Photosensitive Member Production Example 135, except that the centrifugation was not performed.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 200

An electrophotographic photosensitive member of Photosensitive Member Production Example 200 was produced in the same manner as in Photosensitive Member Production Example 195, except that the time for the milling operation using the sand mill was changed from 1 hour to 100 hours.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 201

An electrophotographic photosensitive member of Photosensitive Member Production Example 201 was produced in the same manner as in Photosensitive Member Production Example 195, except that the time for the milling operation using the sand mill was changed from 1 hour to 300 hours.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 202

An electrophotographic photosensitive member of Photosensitive Member Production Example 202 was produced in the same manner as in Photosensitive Member Production Example 100, except that the process for producing the titanyl phthalocyanine pigment was changed as below.

In a sand mill K-800 (manufactured by Aimex, disk diameter: 70 mm, 5 disks) with cooling water of 18° C., 0.5 part of the titanyl phthalocyanine pigment produced in Synthesis Example 5 and 10 parts of n-butyl ether were subjected to milling for 20 hours with 15 parts of glass beads of 0.9 mm in diameter. This operation was performed under the condition where the disks were rotated at 500 rpm. The liquid subjected to this operation was filtered through a filter (N-NO. 125T, pore size: 133 μm, manufactured by NBC Meshtec) to remove the glass beads. After adding 30 parts of n-butyl ether to the resulting liquid, the mixture was filtered, and the filtration product remaining on the filter was sufficiently washed with methanol and water. Then, the washed filtration product was vacuum-dried to yield 0.45 part of a titanyl phthalocyanine pigment.

The crystallite correlation length r of the resulting pigment, which was estimated from the peak at 27.2°±0.2° that was the strongest of the peaks in the CuKα X-ray diffraction spectrum, was 27 nm.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 203

An electrophotographic photosensitive member of Photosensitive Member Production Example 203 was produced in the same manner as in Photosensitive Member Production Example 100, except that the step of forming the charge generating layer was changed as below.

In a sand mill K-800 (manufactured by Aimex, disk diameter: 70 mm, 5 disks) with cooling water of 18° C., 0.5 part of the titanyl phthalocyanine pigment produced in Synthesis Example 5 and 10 parts of tetrahydrofuran were subjected to milling for 48 hours with 15 parts of glass beads of 0.9 mm in diameter. This operation was performed under the condition where the disks were rotated at 500 rpm. The liquid subjected to this operation was filtered through a filter (N-NO. 125T, pore size: 133 μm, manufactured by NBC Meshtec) to remove the glass beads. After adding 30 parts of tetrahydrofuran to the resulting liquid, the mixture was filtered, and the filtration product remaining on the filter was sufficiently washed with methanol and water. Then, the washed filtration product was vacuum-dried to yield 0.45 part of a titanyl phthalocyanine pigment.

The crystallite correlation length r of the resulting pigment, which was estimated from the peak at 27.2°±0.2° that was the strongest of the peaks in the CuKα X-ray diffraction spectrum, was 34 nm.

Subsequently, 12 parts of the titanyl phthalocyanine pigment subjected to the above-described milling operation and 10 parts of a polyvinyl butyral S-LEC BX-1 (produced by Sekisui Chemical) were dispersed in 304 parts of 9:1 mixed solution of 1,2-dimethoxyethane and 4-methoxy-4-methyl-2-pentanone with 716 parts of zirconia beads of 0.03 mm in diameter for 60 minutes by using Ultra Apex Mill UAM-015 (mill capacity: about 0.15 L, manufactured by Kotobuki Industries) with cooling water of 10° C. This dispersing operation was performed at a rotor peripheral speed of 8 m/s and a flow rate of 10 kg/h. The liquid thus subjected to the milling operation was filtered through a filter (N-NO. 508S, pore size: 20 μm, manufactured by NBC Meshtec) to remove the zirconia beads. The materials in the resulting liquid were dispersed with an ultrasonic disperser UT-205 (manufactured by Sharp) at room temperature (23° C.) for 150 minutes. For this operation, a standard bottle PS-6 (manufactured by Hakuyo Glass) was used as the container, and the power of the ultrasonic disperser was 100%. In this operation, media, such as zirconia beads, were not used. Thus, a coating liquid for forming a charge generating layer was prepared. This coating liquid was applied to the surface of the undercoat layer by dipping. The resulting coating film was heated to dry at 100° C. for 10 minutes to yield a 150 nm-thick charge generating layer.

This charge generating layer was removed and powdered. The powder was agitated with an ultrasonic disperser and subjected to powder X-ray diffraction analysis. The crystallite correlation length r of the resulting pigment, which was estimated from the peak at 27.2°±0.2° that was the strongest of the peaks in the CuKα X-ray diffraction spectrum, was 23 nm. This result suggests that the crystallite correlation length of the phthalocyanine pigment in this case was reduced by the above-described dispersing operation.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 204

An electrophotographic photosensitive member of Photosensitive Member Production Example 204 was produced in the same manner as in Photosensitive Member Production Example 100, except that the step of forming the charge generating layer was changed as below.

In a sand mill K-800 (manufactured by Aimex, disk diameter: 70 mm, 5 disks) with cooling water of 18° C., 0.5 part of the titanyl phthalocyanine pigment produced in Synthesis Example 5 and 10 parts of tetrahydrofuran were subjected to milling for 20 hours with 15 parts of glass beads of 0.9 mm in diameter. This operation was performed under the condition where the disks were rotated at 500 rpm. The liquid subjected to this operation was filtered through a filter (N-NO. 125T, pore size: 133 μm, manufactured by NBC Meshtec) to remove the glass beads. After adding 30 parts of tetrahydrofuran to the resulting liquid, the mixture was filtered, and the filtration product remaining on the filter was sufficiently washed with methanol and water. Then, the washed filtration product was vacuum-dried to yield 0.45 part of a titanyl phthalocyanine pigment.

The crystallite correlation length r of the resulting pigment, which was estimated from the peak at 27.2°±0.2° that was the strongest of the peaks in the CuKα X-ray diffraction spectrum, was 31 nm.

Subsequently, 10 parts of the titanyl phthalocyanine pigment subjected to the above-described milling operation and 10 parts of a polyvinyl butyral S-LEC BM-1 (produced by Sekisui Chemical) were dispersed in 278 parts of cyclohexanone with 250 parts of glass beads of 0.5 mm in diameter at room temperature (23° C.) for 20 hours by using a ball mill machine. This operation was performed in the standard bottle PS-6 (manufactured by Hakuyo Glass) under the condition where the bottle was rotated at a speed of 200 rpm. Thus, a coating liquid for forming a charge generating layer was prepared. This coating liquid was applied to the surface of the undercoat layer by dipping. The resulting coating film was heated to dry at 100° C. for 10 minutes to yield a 150 nm-thick charge generating layer.

This charge generating layer was removed and powdered. The powder was agitated with an ultrasonic disperser and subjected to powder X-ray diffraction analysis. The crystallite correlation length r of the resulting pigment, which was estimated from the peak at 27.2°±0.2° that was the strongest of the peaks in the CuKα X-ray diffraction spectrum, was 27 nm. This result suggests that the crystallite correlation length of the phthalocyanine pigment in this case was reduced by the above-described dispersing operation.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 205

An electrophotographic photosensitive member of Photosensitive Member Production Example 205 was produced in the same manner as in Photosensitive Member Production Example 136, except that the centrifugation was not performed.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 206

An electrophotographic photosensitive member of Photosensitive Member Production Example 206 was produced in the same manner as in Photosensitive Member Production Example 205, except that the time for the milling operation using the ball mill machine was changed from 40 hours to 300 hours.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 207

An electrophotographic photosensitive member of Photosensitive Member Production Example 207 was produced in the same manner as in Photosensitive Member Production Example 1, except that the process for producing the hydroxygallium phthalocyanine pigment was changed as below.

In the first milling operation, 0.5 part of the hydroxygallium phthalocyanine pigment produced in Synthesis Example 3 and 9.5 parts of acetone were subjected to milling at room temperature (23° C.) for 40 hours by using a ball mill machine. This operation was performed in the standard bottle PS-6 (manufactured by Hakuyo Glass) under the condition where the bottle was rotated at a speed of 120 rpm. In this operation, media, such as glass beads, were not used. The liquid thus subjected to the milling operation was further subjected to milling (second milling operation) with 15 parts of glass beads of 0.9 mm in diameter with a paint shaker (manufactured by Toyo Seiki) at room temperature (23° C.) for 6 hours. For this operation, the standard bottle PS-6 (manufactured by Hakuyo Glass) was used as it was without removing the contents therefrom. The liquid subjected to this operation was filtered through a filter (N-NO. 125T, pore size: 133 μm, manufactured by NBC Meshtec) to remove the glass beads. After adding 30 parts of acetone to the resulting liquid, the mixture was filtered, and the filtration product remaining on the filter was sufficiently washed with tetrahydrofuran. Then, the resulting filtration product was vacuum-dried to yield 0.43 part of a hydroxygallium phthalocyanine pigment.

The crystallite correlation length r of the resulting pigment, which was estimated from the peak at 7.5°±0.2° that was the strongest of the peaks in the CuKα X-ray diffraction spectrum, was 53 nm.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 208

An electrophotographic photosensitive member of Photosensitive Member Production Example 208 was produced in the same manner as in Photosensitive Member Production Example 1, except that the process for producing the hydroxygallium phthalocyanine pigment was changed as below.

In the first milling operation, 0.5 part of the hydroxygallium phthalocyanine pigment produced in Synthesis Example 3 and 9.5 parts of acetone were subjected to milling with 15 parts of glass beads of 0.9 mm in diameter at room temperature (23° C.) for 24 hours by using a ball mill machine. This operation was performed in the standard bottle PS-6 (manufactured by Hakuyo Glass) under the condition where the bottle was rotated at a speed of 60 rpm. After adding 30 parts of acetone to the resulting liquid, the mixture was filtered, and the filtration product remaining on the filter was sufficiently washed with tetrahydrofuran. Then, the resulting filtration product was vacuum-dried to yield 0.43 part of a hydroxygallium phthalocyanine pigment. Subsequently, 0.5 part of the resulting hydroxygallium phthalocyanine pigment was subjected to milling (second milling operation) with 15 parts of glass beads of 0.9 mm in diameter with a paint shaker (manufactured by Toyo Seiki) at room temperature (23° C.) for 20 minutes. For this operation, a standard bottle PS-6 (manufactured by Hakuyo Glass) was used as the container. Thus, 0.48 part of a hydroxygallium phthalocyanine pigment was produced.

The crystallite correlation length r of the resulting pigment, which was estimated from the peak at 7.5°±0.2° that was the strongest of the peaks in the CuKα X-ray diffraction spectrum, was 77 nm.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 209

An electrophotographic photosensitive member of Photosensitive Member Production Example 209 was produced in the same manner as in Photosensitive Member Production Example 208, except that the acetone used in the process for producing the hydroxygallium phthalocyanine pigment was replaced with tetrahydrofuran.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 210

An electrophotographic photosensitive member of Photosensitive Member Production Example 210 was produced in the same manner as in Photosensitive Member Production Example 74, except that the process for producing the chlorogallium phthalocyanine pigment was changed as below.

Using a paint shaker (manufactured by Toyo Seiki), 0.5 part of the chlorogallium phthalocyanine pigment produced in Synthesis Example 1 was subjected to milling with 15 parts of glass beads of 0.9 mm in diameter at room temperature (23° C.) for 20 minutes. For this operation, a standard bottle PS-6 (manufactured by Hakuyo Glass) was used as the container. Thus, 0.47 part of a chlorogallium phthalocyanine pigment was produced.

The crystallite correlation length r of the resulting pigment, which was estimated from the peak at 7.4° that was the strongest of the peaks in the CuKα X-ray diffraction spectrum, was 100 nm.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 211

An electrophotographic photosensitive member of Photosensitive Member Production Example 211 was produced in the same manner as in Photosensitive Member Production Example 8, except that the thickness of the charge generating layer was changed from 150 nm to 100 nm.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 212

An electrophotographic photosensitive member of Photosensitive Member Production Example 212 was produced in the same manner as in Photosensitive Member Production Example 8, except that the step of forming the charge generating layer by dipping of a coating liquid using the hydroxygallium phthalocyanine pigment subjected to the milling operation was changed as below.

In a sand mill K-800 (manufactured by Aimex, disk diameter: 70 mm, 5 disks) were dispersed 7.5 parts of the hydroxygallium phthalocyanine pigment subjected to the milling operation in Photosensitive Member Production Example 8, 22.5 parts of a polyvinyl butyral S-LEC BX-1 (produced by Sekisui Chemical), and 190 parts of cyclohexanone in each other with 482 parts of glass beads of 0.9 mm in diameter for 4 hours with cooling water of 18° C. This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 150 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 213

An electrophotographic photosensitive member of Photosensitive Member Production Example 213 was produced in the same manner as in Photosensitive Member Production Example 212, except that the thickness of the charge generating layer was changed from 150 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 214

An electrophotographic photosensitive member of Photosensitive Member Production Example 214 was produced in the same manner as in Photosensitive Member Production Example 8, except that the step of forming the charge generating layer by dipping of a coating liquid using the hydroxygallium phthalocyanine pigment subjected to the milling operation was changed as below.

In a sand mill K-800 (manufactured by Aimex, disk diameter: 70 mm, 5 disks) were dispersed 10 parts of the hydroxygallium phthalocyanine pigment subjected to the milling operation in Photosensitive Member Production Example 8, 20 parts of a polyvinyl butyral S-LEC BX-1 (produced by Sekisui Chemical), and 190 parts of cyclohexanone in each other with 482 parts of glass beads of 0.9 mm in diameter for 4 hours with cooling water of 18° C. This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 150 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 215

An electrophotographic photosensitive member of Photosensitive Member Production Example 215 was produced in the same manner as in Photosensitive Member Production Example 214, except that the thickness of the charge generating layer was changed from 150 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 216

An electrophotographic photosensitive member of Photosensitive Member Production Example 216 was produced in the same manner as in Photosensitive Member Production Example 8, except that the step of forming the charge generating layer by dipping of a coating liquid using the hydroxygallium phthalocyanine pigment subjected to the milling operation was changed as below.

In a sand mill K-800 (manufactured by Aimex, disk diameter: 70 mm, 5 disks) were dispersed 12 parts of the hydroxygallium phthalocyanine pigment subjected to the milling operation in Photosensitive Member Production Example 8, 18 parts of a polyvinyl butyral S-LEC BX-1 (produced by Sekisui Chemical), and 190 parts of cyclohexanone in each other with 482 parts of glass beads of 0.9 mm in diameter for 4 hours with cooling water of 18° C. This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 150 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 217

An electrophotographic photosensitive member of Photosensitive Member Production Example 217 was produced in the same manner as in Photosensitive Member Production Example 216, except that the thickness of the charge generating layer was changed from 150 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 218

An electrophotographic photosensitive member of Photosensitive Member Production Example 218 was produced in the same manner as in Photosensitive Member Production Example 8, except that the step of forming the charge generating layer by dipping of a coating liquid using the hydroxygallium phthalocyanine pigment subjected to the milling operation was changed as below.

In a sand mill K-800 (manufactured by Aimex, disk diameter: 70 mm, 5 disks) were dispersed 13.3 parts of the hydroxygallium phthalocyanine pigment subjected to the milling operation in Photosensitive Member Production Example 8, 16.7 parts of a polyvinyl butyral S-LEC BX-1 (produced by Sekisui Chemical), and 190 parts of cyclohexanone in each other with 482 parts of glass beads of 0.9 mm in diameter for 4 hours with cooling water of 18° C. This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 150 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 219

An electrophotographic photosensitive member of Photosensitive Member Production Example 219 was produced in the same manner as in Photosensitive Member Production Example 218, except that the thickness of the charge generating layer was changed from 150 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 220

An electrophotographic photosensitive member of Photosensitive Member Production Example 220 was produced in the same manner as in Photosensitive Member Production Example 8, except that the step of forming the charge generating layer by dipping of a coating liquid using the hydroxygallium phthalocyanine pigment subjected to the milling operation was changed as below.

In a sand mill K-800 (manufactured by Aimex, disk diameter: 70 mm, 5 disks) were dispersed 15 parts of the hydroxygallium phthalocyanine pigment subjected to the milling operation in Photosensitive Member Production Example 8, 15 parts of a polyvinyl butyral S-LEC BX-1 (produced by Sekisui Chemical), and 190 parts of cyclohexanone in each other with 482 parts of glass beads of 0.9 mm in diameter for 4 hours with cooling water of 18° C. This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 150 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 221

An electrophotographic photosensitive member of Photosensitive Member Production Example 221 was produced in the same manner as in Photosensitive Member Production Example 220, except that the thickness of the charge generating layer was changed from 150 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 4.

Photosensitive Member Production Example 222

An electrophotographic photosensitive member of Photosensitive Member Production Example 222 was produced in the same manner as in Photosensitive Member Production Example 8, except that the step of forming the charge generating layer by dipping of a coating liquid using the hydroxygallium phthalocyanine pigment subjected to the milling operation was changed as below.

In a sand mill K-800 (manufactured by Aimex, disk diameter: 70 mm, 5 disks) were dispersed 18 parts of the hydroxygallium phthalocyanine pigment subjected to the milling operation in Photosensitive Member Production Example 8, 12 parts of a polyvinyl butyral S-LEC BX-1 (produced by Sekisui Chemical), and 190 parts of cyclohexanone in each other with 482 parts of glass beads of 0.9 mm in diameter for 4 hours with cooling water of 18° C. This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 150 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 4.

TABLE 4

Physical Properties of Phthalocyanine Pigments and Photosensitive Members

| Photosensitive Member Production Example No. | Pigment | Crystallite correlation length r [nm] | Crystalline particle size R [nm] | k = r/R | Charge generating layer thickness d [nm] | Volume ratio P of charge generating material | Absorption coefficient α [$nm^{-1}$] | Charge transport layer thickness [μm] | $\Phi_i \cdot \Psi_i$ |
|---|---|---|---|---|---|---|---|---|---|
| Photosensitive Member Production Example 163 | HOGaPc | 24 | 154 | 0.16 | 150 | 0.58 | 0.0042 | 15 | 0.30 |
| Photosensitive Member Production Example 164 | HOGaPc | 13 | 98 | 0.13 | 150 | 0.58 | 0.0042 | 15 | 0.26 |
| Photosensitive Member Production Example 165 | HOGaPc | 13 | 101 | 0.13 | 150 | 0.58 | 0.0042 | 15 | 0.25 |
| Photosensitive Member Production Example 166 | HOGaPc | 12 | 91 | 0.13 | 150 | 0.58 | 0.0042 | 15 | 0.27 |
| Photosensitive Member Production Example 167 | HOGaPc | 16 | 121 | 0.13 | 150 | 0.58 | 0.0042 | 15 | 0.28 |
| Photosensitive Member Production Example 168 | HOGaPc | 16 | 125 | 0.13 | 150 | 0.58 | 0.0042 | 15 | 0.29 |
| Photosensitive Member Production Example 169 | HOGaPc | 13 | 172 | 0.08 | 150 | 0.58 | 0.0042 | 15 | 0.21 |
| Photosensitive Member Production Example 170 | HOGaPc | 13 | 115 | 0.11 | 150 | 0.58 | 0.0042 | 15 | 0.22 |
| Photosensitive Member Production Example 171 | HOGaPc | 13 | 118 | 0.11 | 150 | 0.58 | 0.0042 | 15 | 0.21 |
| Photosensitive Member Production Example 172 | HOGaPc | 25 | 158 | 0.16 | 150 | 0.58 | 0.0042 | 15 | 0.30 |
| Photosensitive Member Production Example 173 | HOGaPc | 18 | 123 | 0.14 | 150 | 0.58 | 0.0042 | 15 | 0.25 |
| Photosensitive Member Production Example 174 | HOGaPc | 23 | 183 | 0.13 | 150 | 0.58 | 0.0042 | 15 | 0.24 |
| Photosensitive Member Production Example 175 | HOGaPc | 23 | 178 | 0.13 | 150 | 0.58 | 0.0042 | 15 | 0.26 |
| Photosensitive Member Production Example 176 | HOGaPc | 23 | 176 | 0.13 | 150 | 0.58 | 0.0042 | 15 | 0.25 |
| Photosensitive Member Production Example 177 | HOGaPc | 21 | 248 | 0.09 | 150 | 0.58 | 0.0042 | 15 | 0.15 |
| Photosensitive Member Production Example 178 | HOGaPc | 21 | 194 | 0.11 | 150 | 0.58 | 0.0042 | 15 | 0.19 |

TABLE 4-continued

Physical Properties of Phthalocyanine Pigments and Photosensitive Members

| Photosensitive Member Production Example No. | Pigment | Crystallite correlation length r [nm] | Crystalline particle size R [nm] | k = r/R | Charge generating layer thickness d [nm] | Volume ratio P of charge generating material | Absorption coefficient α [$nm^{-1}$] | Charge transport layer thickness [μm] | $\Phi_i \cdot \Psi_i$ |
|---|---|---|---|---|---|---|---|---|---|
| Photosensitive Member Production Example 179 | HOGaPc | 17 | 142 | 0.12 | 150 | 0.58 | 0.0042 | 15 | 0.22 |
| Photosensitive Member Production Example 180 | HOGaPc | 8 | 112 | 0.07 | 150 | 0.58 | 0.0042 | 15 | 0.17 |
| Photosensitive Member Production Example 181 | HOGaPc | 5 | 104 | 0.05 | 150 | 0.58 | 0.0042 | 15 | 0.14 |
| Photosensitive Member Production Example 182 | HOGaPc | 20 | 153 | 0.13 | 150 | 0.58 | 0.0042 | 15 | 0.25 |
| Photosensitive Member Production Example 183 | HOGaPc | 18 | 131 | 0.14 | 150 | 0.58 | 0.0042 | 15 | 0.28 |
| Photosensitive Member Production Example 184 | HOGaPc | 7 | 98 | 0.07 | 150 | 0.58 | 0.0042 | 15 | 0.29 |
| Photosensitive Member Production Example 185 | ClGaPc | 16 | 114 | 0.14 | 170 | 0.67 | 0.0050 | 15 | 0.21 |
| Photosensitive Member Production Example 186 | ClGaPc | 15 | 105 | 0.14 | 170 | 0.67 | 0.0050 | 15 | 0.22 |
| Photosensitive Member Production Example 187 | ClGaPc | 23 | 184 | 0.12 | 170 | 0.67 | 0.0050 | 15 | 0.25 |
| Photosensitive Member Production Example 188 | ClGaPc | 13 | 103 | 0.13 | 170 | 0.67 | 0.0050 | 15 | 0.27 |
| Photosensitive Member Production Example 189 | ClGaPc | 13 | 138 | 0.10 | 170 | 0.67 | 0.0050 | 15 | 0.27 |
| Photosensitive Member Production Example 190 | ClGaPc | 12 | 153 | 0.08 | 170 | 0.67 | 0.0050 | 15 | 0.26 |
| Photosensitive Member Production Example 191 | ClGaPc | 12 | 88 | 0.13 | 170 | 0.67 | 0.0050 | 15 | 0.25 |
| Photosensitive Member Production Example 192 | ClGaPc | 17 | 132 | 0.13 | 170 | 0.67 | 0.0050 | 15 | 0.25 |
| Photosensitive Member Production Example 193 | ClGaPc | 18 | 153 | 0.12 | 170 | 0.67 | 0.0050 | 15 | 0.24 |
| Photosensitive Member Production Example 194 | ClGaPc | 18 | 128 | 0.14 | 170 | 0.67 | 0.0050 | 15 | 0.25 |
| Photosensitive Member Production Example 195 | TiOPc | 23 | 248 | 0.09 | 150 | 0.45 | 0.0066 | 15 | 0.28 |
| Photosensitive Member Production Example 196 | TiOPc | 27 | 238 | 0.11 | 150 | 0.45 | 0.0066 | 15 | 0.28 |
| Photosensitive Member Production Example 197 | TiOPc | 29 | 230 | 0.13 | 150 | 0.45 | 0.0066 | 15 | 0.29 |
| Photosensitive Member Production Example 198 | TiOPc | 31 | 221 | 0.14 | 150 | 0.45 | 0.0066 | 15 | 0.30 |
| Photosensitive Member Production Example 199 | TiOPc | 34 | 210 | 0.16 | 150 | 0.45 | 0.0066 | 15 | 0.30 |
| Photosensitive Member Production Example 200 | TiOPc | 34 | 205 | 0.16 | 150 | 0.45 | 0.0066 | 15 | 0.30 |
| Photosensitive Member Production Example 201 | TiOPc | 33 | 201 | 0.16 | 150 | 0.45 | 0.0066 | 15 | 0.29 |
| Photosensitive Member Production Example 202 | TiOPc | 27 | 181 | 0.15 | 150 | 0.45 | 0.0066 | 15 | 0.28 |
| Photosensitive Member Production Example 203 | TiOPc | 23 | 155 | 0.15 | 150 | 0.45 | 0.0066 | 15 | 0.29 |
| Photosensitive Member Production Example 204 | TiOPc | 27 | 201 | 0.13 | 150 | 0.41 | 0.0066 | 15 | 0.26 |
| Photosensitive Member Production Example 205 | HOGaPc | 189 | 383 | 0.49 | 150 | 0.58 | 0.0042 | 15 | 0.21 |
| Photosensitive Member Production Example 206 | HOGaPc | 265 | 425 | 0.62 | 150 | 0.58 | 0.0042 | 15 | 0.18 |
| Photosensitive Member Production Example 207 | HOGaPc | 53 | 325 | 0.16 | 150 | 0.58 | 0.0042 | 15 | 0.28 |
| Photosensitive Member Production Example 208 | HOGaPc | 77 | 102 | 0.76 | 150 | 0.58 | 0.0042 | 15 | 0.29 |
| Photosensitive Member Production Example 209 | HOGaPc | 72 | 105 | 0.69 | 150 | 0.58 | 0.0042 | 15 | 0.27 |
| Photosensitive Member Production Example 210 | ClGaPc | 100 | 128 | 0.78 | 170 | 0.67 | 0.0050 | 15 | 0.25 |
| Photosensitive Member Production Example 211 | HOGaPc | 29 | 93 | 0.31 | 100 | 0.58 | 0.0055 | 15 | 0.25 |
| Photosensitive Member Production Example 212 | HOGaPc | 29 | 93 | 0.31 | 150 | 0.19 | 0.0018 | 15 | 0.05 |
| Photosensitive Member Production Example 213 | HOGaPc | 29 | 93 | 0.31 | 190 | 0.19 | 0.0018 | 15 | 0.06 |
| Photosensitive Member Production Example 214 | HOGaPc | 29 | 93 | 0.31 | 150 | 0.26 | 0.0024 | 15 | 0.08 |
| Photosensitive Member Production Example 215 | HOGaPc | 29 | 93 | 0.31 | 190 | 0.26 | 0.0024 | 15 | 0.10 |
| Photosensitive Member Production Example 216 | HOGaPc | 29 | 93 | 0.31 | 150 | 0.31 | 0.0030 | 15 | 0.12 |
| Photosensitive Member Production Example 217 | HOGaPc | 29 | 93 | 0.31 | 190 | 0.31 | 0.0030 | 15 | 0.15 |
| Photosensitive Member Production Example 218 | HOGaPc | 29 | 93 | 0.31 | 150 | 0.35 | 0.0034 | 15 | 0.15 |
| Photosensitive Member Production Example 219 | HOGaPc | 29 | 93 | 0.31 | 190 | 0.35 | 0.0034 | 15 | 0.19 |
| Photosensitive Member Production Example 220 | HOGaPc | 29 | 93 | 0.31 | 150 | 0.41 | 0.0039 | 15 | 0.19 |
| Photosensitive Member Production Example 221 | HOGaPc | 29 | 93 | 0.31 | 190 | 0.41 | 0.0039 | 15 | 0.24 |
| Photosensitive Member Production Example 222 | HOGaPc | 29 | 93 | 0.31 | 150 | 0.51 | 0.0049 | 15 | 0.28 |

Photosensitive Member Production Example 223

An electrophotographic photosensitive member of Photosensitive Member Production Example 223 was produced in the same manner as in Photosensitive Member Production Example 37, except that the thickness of the charge generating layer was changed from 150 nm to 100 nm.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 224

An electrophotographic photosensitive member of Photosensitive Member Production Example 224 was produced in the same manner as in Photosensitive Member Production Example 37, except that the step of forming the charge generating layer by dipping of a coating liquid using the hydroxygallium phthalocyanine pigment subjected to the milling operation was changed as below.

In a sand mill K-800 (manufactured by Aimex, disk diameter: 70 mm, 5 disks) were dispersed 7.5 parts of the hydroxygallium phthalocyanine pigment subjected to the milling operation in Photosensitive Member Production Example 37, 22.5 parts of a polyvinyl butyral S-LEC BX-1 (produced by Sekisui Chemical), and 190 parts of cyclohexanone in each other with 482 parts of glass beads of 0.9 mm in diameter for 4 hours with cooling water of 18° C. This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 150 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 225

An electrophotographic photosensitive member of Photosensitive Member Production Example 225 was produced in the same manner as in Photosensitive Member Production Example 224, except that the thickness of the charge generating layer was changed from 150 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 226

An electrophotographic photosensitive member of Photosensitive Member Production Example 226 was produced in the same manner as in Photosensitive Member Production Example 37, except that the step of forming the charge generating layer by dipping of a coating liquid using the hydroxygallium phthalocyanine pigment subjected to the milling operation was changed as below.

In a sand mill K-800 (manufactured by Aimex, disk diameter: 70 mm, 5 disks) were dispersed 10 parts of the hydroxygallium phthalocyanine pigment subjected to the milling operation in Photosensitive Member Production Example 37, 20 parts of a polyvinyl butyral S-LEC BX-1 (produced by Sekisui Chemical), and 190 parts of cyclohexanone in each other with 482 parts of glass beads of 0.9 mm in diameter for 4 hours with cooling water of 18° C. This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 150 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 227

An electrophotographic photosensitive member of Photosensitive Member Production Example 227 was produced in the same manner as in Photosensitive Member Production Example 226, except that the thickness of the charge generating layer was changed from 150 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 228

An electrophotographic photosensitive member of Photosensitive Member Production Example 228 was produced in the same manner as in Photosensitive Member Production Example 37, except that the step of forming the charge generating layer by dipping of a coating liquid using the hydroxygallium phthalocyanine pigment subjected to the milling operation was changed as below.

In a sand mill K-800 (manufactured by Aimex, disk diameter: 70 mm, 5 disks) were dispersed 12 parts of the hydroxygallium phthalocyanine pigment subjected to the milling operation in Photosensitive Member Production Example 37, 18 parts of a polyvinyl butyral S-LEC BX-1 (produced by Sekisui Chemical), and 190 parts of cyclohexanone in each other with 482 parts of glass beads of 0.9 mm in diameter for 4 hours with cooling water of 18° C. This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 150 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 229

An electrophotographic photosensitive member of Photosensitive Member Production Example 229 was produced in the same manner as in Photosensitive Member Production Example 228, except that the thickness of the charge generating layer was changed from 150 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 230

An electrophotographic photosensitive member of Photosensitive Member Production Example 230 was produced in the same manner as in Photosensitive Member Production Example 37, except that the step of forming the charge generating layer by dipping of a coating liquid using the hydroxygallium phthalocyanine pigment subjected to the milling operation was changed as below.

In a sand mill K-800 (manufactured by Aimex, disk diameter: 70 mm, 5 disks) were dispersed 13.3 parts of the hydroxygallium phthalocyanine pigment subjected to the milling operation in Photosensitive Member Production Example 37, 16.7 parts of a polyvinyl butyral S-LEC BX-1 (produced by Sekisui Chemical), and 190 parts of cyclohexanone in each other with 482 parts of glass beads of 0.9 mm in diameter for 4 hours with cooling water of 18° C. This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 150 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 231

An electrophotographic photosensitive member of Photosensitive Member Production Example 230 was produced in the same manner as in Photosensitive Member Production Example 228, except that the thickness of the charge generating layer was changed from 150 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 232

An electrophotographic photosensitive member of Photosensitive Member Production Example 232 was produced in the same manner as in Photosensitive Member Production Example 37, except that the step of forming the charge generating layer by dipping of a coating liquid using the hydroxygallium phthalocyanine pigment subjected to the milling operation was changed as below.

In a sand mill K-800 (manufactured by Aimex, disk diameter: 70 mm, 5 disks) were dispersed 15 parts of the hydroxygallium phthalocyanine pigment subjected to the milling operation in Photosensitive Member Production Example 37, 15 parts of a polyvinyl butyral S-LEC BX-1 (produced by Sekisui Chemical), and 190 parts of cyclohexanone in each other with 482 parts of glass beads of 0.9 mm in diameter for 4 hours with cooling water of 18° C. This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 150 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 233

An electrophotographic photosensitive member of Photosensitive Member Production Example 232 was produced in the same manner as in Photosensitive Member Production Example 228, except that the thickness of the charge generating layer was changed from 150 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 234

An electrophotographic photosensitive member of Photosensitive Member Production Example 234 was produced in the same manner as in Photosensitive Member Production Example 37, except that the step of forming the charge generating layer by dipping of a coating liquid using the hydroxygallium phthalocyanine pigment subjected to the milling operation was changed as below.

In a sand mill K-800 (manufactured by Aimex, disk diameter: 70 mm, 5 disks) were dispersed 18 parts of the hydroxygallium phthalocyanine pigment subjected to the milling operation in Photosensitive Member Production Example 37, 12 parts of a polyvinyl butyral S-LEC BX-1 (produced by Sekisui Chemical), and 190 parts of cyclohexanone in each other with 482 parts of glass beads of 0.9 mm in diameter for 4 hours with cooling water of 18° C. This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 150 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 235

An electrophotographic photosensitive member of Photosensitive Member Production Example 235 was produced in the same manner as in Photosensitive Member Production Example 59, except that the thickness of the charge generating layer was changed from 170 nm to 100 nm.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 236

An electrophotographic photosensitive member of Photosensitive Member Production Example 236 was produced in the same manner as in Photosensitive Member Production Example 59, except that the thickness of the charge generating layer was changed from 170 nm to 130 nm.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 237

An electrophotographic photosensitive member of Photosensitive Member Production Example 237 was produced in the same manner as in Photosensitive Member Production Example 59, except that the thickness of the charge generating layer was changed from 170 nm to 150 nm.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 238

An electrophotographic photosensitive member of Photosensitive Member Production Example 238 was produced in the same manner as in Photosensitive Member Production Example 59, except that the step of forming the charge generating layer by dipping of a coating liquid using the hydroxygallium phthalocyanine pigment subjected to the milling operation was changed as below.

In a sand mill K-800 (manufactured by Aimex, disk diameter: 70 mm, 5 disks) were dispersed 7.5 parts of the hydroxygallium phthalocyanine pigment subjected to the milling operation in Photosensitive Member Production Example 59, 22.5 parts of a polyvinyl butyral S-LEC BX-1 (produced by Sekisui Chemical), and 190 parts of cyclohexanone in each other with 482 parts of glass beads of 0.9 mm in diameter for 4 hours with cooling water of 18° C. This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 170 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 239

An electrophotographic photosensitive member of Photosensitive Member Production Example 239 was produced in the same manner as in Photosensitive Member Production Example 238, except that the thickness of the charge generating layer was changed from 170 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 240

An electrophotographic photosensitive member of Photosensitive Member Production Example 240 was produced in the same manner as in Photosensitive Member Production Example 59, except that the step of forming the charge generating layer by dipping of a coating liquid using the hydroxygallium phthalocyanine pigment subjected to the milling operation was changed as below.

In a sand mill K-800 (manufactured by Aimex, disk diameter: 70 mm, 5 disks) were dispersed 10 parts of the hydroxygallium phthalocyanine pigment subjected to the milling operation in Photosensitive Member Production Example 59, 20 parts of a polyvinyl butyral S-LEC BX-1 (produced by Sekisui Chemical), and 190 parts of cyclohexanone in each other with 482 parts of glass beads of 0.9 mm in diameter for 4 hours with cooling water of 18° C. This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 170 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 241

An electrophotographic photosensitive member of Photosensitive Member Production Example 241 was produced in the same manner as in Photosensitive Member Production Example 240, except that the thickness of the charge generating layer was changed from 170 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 242

An electrophotographic photosensitive member of Photosensitive Member Production Example 242 was produced in the same manner as in Photosensitive Member Production Example 59, except that the step of forming the charge generating layer by dipping of a coating liquid using the hydroxygallium phthalocyanine pigment subjected to the milling operation was changed as below.

In a sand mill K-800 (manufactured by Aimex, disk diameter: 70 mm, 5 disks) were dispersed 12 parts of the hydroxygallium phthalocyanine pigment subjected to the milling operation in Photosensitive Member Production Example 59, 18 parts of a polyvinyl butyral S-LEC BX-1 (produced by Sekisui Chemical), and 190 parts of cyclohexanone in each other with 482 parts of glass beads of 0.9 mm in diameter for 4 hours with cooling water of 18° C. This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 170 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 243

An electrophotographic photosensitive member of Photosensitive Member Production Example 243 was produced in the same manner as in Photosensitive Member Production Example 242, except that the thickness of the charge generating layer was changed from 170 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 244

An electrophotographic photosensitive member of Photosensitive Member Production Example 244 was produced in the same manner as in Photosensitive Member Production Example 59, except that the step of forming the charge generating layer by dipping of a coating liquid using the hydroxygallium phthalocyanine pigment subjected to the milling operation was changed as below.

In a sand mill K-800 (manufactured by Aimex, disk diameter: 70 mm, 5 disks) were dispersed 13.3 parts of the hydroxygallium phthalocyanine pigment subjected to the milling operation in Photosensitive Member Production Example 59, 16.7 parts of a polyvinyl butyral S-LEC BX-1 (produced by Sekisui Chemical), and 190 parts of cyclohexanone in each other with 482 parts of glass beads of 0.9 mm in diameter for 4 hours with cooling water of 18° C. This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 170 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 245

An electrophotographic photosensitive member of Photosensitive Member Production Example 245 was produced in the same manner as in Photosensitive Member Production Example 244, except that the thickness of the charge generating layer was changed from 170 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 246

An electrophotographic photosensitive member of Photosensitive Member Production Example 246 was produced in the same manner as in Photosensitive Member Production Example 59, except that the step of forming the charge generating layer by dipping of a coating liquid using the hydroxygallium phthalocyanine pigment subjected to the milling operation was changed as below.

In a sand mill K-800 (manufactured by Aimex, disk diameter: 70 mm, 5 disks) were dispersed 15 parts of the hydroxygallium phthalocyanine pigment subjected to the milling operation in Photosensitive Member Production Example 59, 15 parts of a polyvinyl butyral S-LEC BX-1 (produced by Sekisui Chemical), and 190 parts of cyclohexanone in each other with 482 parts of glass beads of 0.9 mm in diameter for 4 hours with cooling water of 18° C. This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 170 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 247

An electrophotographic photosensitive member of Photosensitive Member Production Example 247 was produced in the same manner as in Photosensitive Member Production Example 246, except that the thickness of the charge generating layer was changed from 170 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 248

An electrophotographic photosensitive member of Photosensitive Member Production Example 248 was produced in the same manner as in Photosensitive Member Production Example 59, except that the step of forming the charge generating layer by dipping of a coating liquid using the hydroxygallium phthalocyanine pigment subjected to the milling operation was changed as below.

In a sand mill K-800 (manufactured by Aimex, disk diameter: 70 mm, 5 disks) were dispersed 18 parts of the hydroxygallium phthalocyanine pigment subjected to the milling operation in Photosensitive Member Production Example 59, 12 parts of a polyvinyl butyral S-LEC BX-1 (produced by Sekisui Chemical), and 190 parts of cyclohexanone in each other with 482 parts of glass beads of 0.9 mm in diameter for 4 hours with cooling water of 18° C. This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 170 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 249

An electrophotographic photosensitive member of Photosensitive Member Production Example 249 was produced in the same manner as in Photosensitive Member Production Example 248, except that the thickness of the charge generating layer was changed from 170 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 250

An electrophotographic photosensitive member of Photosensitive Member Production Example 250 was produced in the same manner as in Photosensitive Member Production Example 81, except that the thickness of the charge generating layer was changed from 170 nm to 100 nm.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 251

An electrophotographic photosensitive member of Photosensitive Member Production Example 251 was produced in the same manner as in Photosensitive Member Production Example 81, except that the thickness of the charge generating layer was changed from 170 nm to 130 nm.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 252

An electrophotographic photosensitive member of Photosensitive Member Production Example 252 was produced in the same manner as in Photosensitive Member Production Example 81, except that the thickness of the charge generating layer was changed from 170 nm to 150 nm.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 253

An electrophotographic photosensitive member of Photosensitive Member Production Example 253 was produced in the same manner as in Photosensitive Member Production Example 81, except that the step of forming the charge generating layer by dipping of a coating liquid using the chlorogallium phthalocyanine pigment subjected to the milling operation was changed as below.

In a sand mill K-800 (manufactured by Aimex, disk diameter: 70 mm, 5 disks) with cooling water of 18° C. were dispersed 7.5 parts of the chlorogallium phthalocyanine pigment subjected to the milling operation in Photosensitive Member Production Example 81, 22.5 parts of a polyvinyl butyral S-LEC BX-1 (produced by Sekisui Chemical), and 253 parts of cyclohexanone in each other with 643 parts of glass beads of 0.9 mm in diameter for 4 hours. This operation was performed under the condition where the disks were rotated at 1,800 rpm. To the resulting dispersion liquid were added 592 parts of cyclohexanone and 845 parts of ethyl acetate to yield a coating liquid for forming a charge generating layer. This coating liquid was applied to the surface of the undercoat layer by dipping. The resulting coating film was heated to dry at 100° C. for 10 minutes to yield a 170 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 254

An electrophotographic photosensitive member of Photosensitive Member Production Example 254 was produced in the same manner as in Photosensitive Member Production Example 253, except that the thickness of the charge generating layer was changed from 170 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 255

An electrophotographic photosensitive member of Photosensitive Member Production Example 255 was produced in the same manner as in Photosensitive Member Production Example 81, except that the step of forming the charge generating layer by dipping of a coating liquid using the chlorogallium phthalocyanine pigment subjected to the milling operation was changed as below.

In a sand mill K-800 (manufactured by Aimex, disk diameter: 70 mm, 5 disks) with cooling water of 18° C. were dispersed 10 parts of the chlorogallium phthalocyanine pigment subjected to the milling operation in Photosensitive Member Production Example 81, 20 parts of a polyvinyl butyral S-LEC BX-1 (produced by Sekisui Chemical), and 253 parts of cyclohexanone in each other with 643 parts of glass beads of 0.9 mm in diameter for 4 hours. This operation was performed under the condition where the disks were rotated at 1,800 rpm. To the resulting dispersion liquid were added 592 parts of cyclohexanone and 845 parts of ethyl acetate to yield a coating liquid for forming a charge generating layer. This coating liquid was applied to the surface of the undercoat layer by dipping. The resulting coating film was heated to dry at 100° C. for 10 minutes to yield a 170 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 256

An electrophotographic photosensitive member of Photosensitive Member Production Example 256 was produced in the same manner as in Photosensitive Member Production Example 255, except that the thickness of the charge generating layer was changed from 170 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 257

An electrophotographic photosensitive member of Photosensitive Member Production Example 257 was produced in the same manner as in Photosensitive Member Production Example 81, except that the step of forming the charge generating layer by dipping of a coating liquid using the chlorogallium phthalocyanine pigment subjected to the milling operation was changed as below.

In a sand mill K-800 (manufactured by Aimex, disk diameter: 70 mm, 5 disks) with cooling water of 18° C. were dispersed 12 parts of the chlorogallium phthalocyanine pigment subjected to the milling operation in Photosensitive Member Production Example 81, 18 parts of a polyvinyl butyral S-LEC BX-1 (produced by Sekisui Chemical), and 253 parts of cyclohexanone in each other with 643 parts of glass beads of 0.9 mm in diameter for 4 hours. This operation was performed under the condition where the disks were rotated at 1,800 rpm. To the resulting dispersion liquid were added 592 parts of cyclohexanone and 845 parts of ethyl acetate to yield a coating liquid for forming a charge generating layer. This coating liquid was applied to the surface of the undercoat layer by dipping. The resulting coating film was heated to dry at 100° C. for 10 minutes to yield a 170 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 258

An electrophotographic photosensitive member of Photosensitive Member Production Example 258 was produced in the same manner as in Photosensitive Member Production Example 257, except that the thickness of the charge generating layer was changed from 170 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 259

An electrophotographic photosensitive member of Photosensitive Member Production Example 259 was produced in the same manner as in Photosensitive Member Production Example 81, except that the step of forming the charge generating layer by dipping of a coating liquid using the chlorogallium phthalocyanine pigment subjected to the milling operation was changed as below.

In a sand mill K-800 (manufactured by Aimex, disk diameter: 70 mm, 5 disks) with cooling water of 18° C. were dispersed 13.3 parts of the chlorogallium phthalocyanine pigment subjected to the milling operation in Photosensitive Member Production Example 81, 16.7 parts of a polyvinyl butyral S-LEC BX-1 (produced by Sekisui Chemical), and 253 parts of cyclohexanone in each other with 643 parts of glass beads of 0.9 mm in diameter for 4 hours. This operation was performed under the condition where the disks were rotated at 1,800 rpm. To the resulting dispersion liquid were added 592 parts of cyclohexanone and 845 parts of ethyl acetate to yield a coating liquid for forming a charge generating layer. This coating liquid was applied to the surface of the undercoat layer by dipping. The resulting coating film was heated to dry at 100° C. for 10 minutes to yield a 170 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 260

An electrophotographic photosensitive member of Photosensitive Member Production Example 260 was produced in the same manner as in Photosensitive Member Production Example 259, except that the thickness of the charge generating layer was changed from 170 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 261

An electrophotographic photosensitive member of Photosensitive Member Production Example 261 was produced in the same manner as in Photosensitive Member Production Example 81, except that the step of forming the charge generating layer by dipping of a coating liquid using the chlorogallium phthalocyanine pigment subjected to the milling operation was changed as below.

In a sand mill K-800 (manufactured by Aimex, disk diameter: 70 mm, 5 disks) with cooling water of 18° C. were dispersed 15 parts of the chlorogallium phthalocyanine pigment subjected to the milling operation in Photosensitive Member Production Example 81, 15 parts of a polyvinyl butyral S-LEC BX-1 (produced by Sekisui Chemical), and 253 parts of cyclohexanone in each other with 643 parts of glass beads of 0.9 mm in diameter for 4 hours. This operation was performed under the condition where the disks were rotated at 1,800 rpm. To the resulting dispersion liquid were added 592 parts of cyclohexanone and 845 parts of ethyl acetate to yield a coating liquid for forming a charge generating layer. This coating liquid was applied to the surface of the undercoat layer by dipping. The resulting coating film was heated to dry at 100° C. for 10 minutes to yield a 170 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 262

An electrophotographic photosensitive member of Photosensitive Member Production Example 262 was produced in the same manner as in Photosensitive Member Production Example 261, except that the thickness of the charge generating layer was changed from 170 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 263

An electrophotographic photosensitive member of Photosensitive Member Production Example 263 was produced in the same manner as in Photosensitive Member Production Example 81, except that the step of forming the charge generating layer by dipping of a coating liquid using the chlorogallium phthalocyanine pigment subjected to the milling operation was changed as below.

In a sand mill K-800 (manufactured by Aimex, disk diameter: 70 mm, 5 disks) with cooling water of 18° C. were dispersed 18 parts of the chlorogallium phthalocyanine pigment subjected to the milling operation in Photosensitive Member Production Example 81, 12 parts of a polyvinyl butyral S-LEC BX-1 (produced by Sekisui Chemical), and 253 parts of cyclohexanone in each other with 643 parts of glass beads of 0.9 mm in diameter for 4 hours. This operation was performed under the condition where the disks were rotated at 1,800 rpm. To the resulting dispersion liquid were added 592 parts of cyclohexanone and 845 parts of ethyl acetate to yield a coating liquid for forming a charge generating layer. This coating liquid was applied to the surface of the undercoat layer by dipping. The resulting coating film was heated to dry at 100° C. for 10 minutes to yield a 170 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 264

An electrophotographic photosensitive member of Photosensitive Member Production Example 264 was produced in the same manner as in Photosensitive Member Production Example 263, except that the thickness of the charge generating layer was changed from 170 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 265

An electrophotographic photosensitive member of Photosensitive Member Production Example 265 was produced in the same manner as in Photosensitive Member Production Example 81, except that the step of forming the charge generating layer by dipping of a coating liquid using the chlorogallium phthalocyanine pigment subjected to the milling operation was changed as below.

In a sand mill K-800 (manufactured by Aimex, disk diameter: 70 mm, 5 disks) with cooling water of 18° C. were dispersed 20 parts of the chlorogallium phthalocyanine pigment subjected to the milling operation in Photosensitive Member Production Example 81, 10 parts of a polyvinyl butyral S-LEC BX-1 (produced by Sekisui Chemical), and 253 parts of cyclohexanone in each other with 643 parts of glass beads of 0.9 mm in diameter for 4 hours. This operation was performed under the condition where the disks were rotated at 1,800 rpm. To the resulting dispersion liquid were added 592 parts of cyclohexanone and 845 parts of ethyl acetate to yield a coating liquid for forming a charge generating layer. This coating liquid was applied to the surface of the undercoat layer by dipping. The resulting coating film was heated to dry at 100° C. for 10 minutes to yield a 170 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 266

An electrophotographic photosensitive member of Photosensitive Member Production Example 266 was produced in the same manner as in Photosensitive Member Production Example 109, except that the thickness of the charge generating layer was changed from 150 nm to 100 nm.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 267

An electrophotographic photosensitive member of Photosensitive Member Production Example 267 was produced in the same manner as in Photosensitive Member Production Example 109, except that the step of forming the charge generating layer by dipping of a coating liquid using the hydroxygallium phthalocyanine pigment subjected to the milling operation was changed as below.

Polyvinyl butyral S-LEC BX-1 (produced by Sekisui Chemical) and cyclohexanone were added to the solution obtained by the centrifugation performed as in Photosensitive Member Production Example 109 so that the ratio of the hydroxygallium phthalocyanine pigment, the polyvinyl butyral and the cyclohexanone would be 7.5:22.5:190. In a sand mill K-800 (manufactured by Aimex, disk diameter: 70 mm, 5 disks), 220 parts of this mixture was subjected to dispersion with 482 parts of glass beads of 0.9 mm in diameter for 4 hours with cooling water of 18° C. This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 150 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 268

An electrophotographic photosensitive member of Photosensitive Member Production Example 268 was produced in the same manner as in Photosensitive Member Production Example 267, except that the thickness of the charge generating layer was changed from 150 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 269

An electrophotographic photosensitive member of Photosensitive Member Production Example 269 was produced in the same manner as in Photosensitive Member Production Example 109, except that the step of forming the charge generating layer by dipping of a coating liquid using the hydroxygallium phthalocyanine pigment subjected to the milling operation was changed as below.

Polyvinyl butyral S-LEC BX-1 (produced by Sekisui Chemical) and cyclohexanone were added to the solution obtained by the centrifugation performed as in Photosensitive Member Production Example 109 so that the ratio of the hydroxygallium phthalocyanine pigment, the polyvinyl butyral and the cyclohexanone would be 10:20:190. In a sand mill K-800 (manufactured by Aimex, disk diameter: 70 mm, 5 disks), 220 parts of this mixture was subjected to dispersion with 482 parts of glass beads of 0.9 mm in diameter for 4 hours with cooling water of 18° C. This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 150 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 270

An electrophotographic photosensitive member of Photosensitive Member Production Example 270 was produced in Example 269, except that the thickness of the charge generating layer was changed from 150 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 271

An electrophotographic photosensitive member of Photosensitive Member Production Example 271 was produced in the same manner as in Photosensitive Member Production Example 109, except that the step of forming the charge generating layer by dipping of a coating liquid using the hydroxygallium phthalocyanine pigment subjected to the milling operation was changed as below.

Polyvinyl butyral S-LEC BX-1 (produced by Sekisui Chemical) and cyclohexanone were added to the solution obtained by the centrifugation performed as in Photosensitive Member Production Example 109 so that the ratio of the hydroxygallium phthalocyanine pigment, the polyvinyl butyral and the cyclohexanone would be 12:18:190. In a sand mill K-800 (manufactured by Aimex, disk diameter: 70 mm, 5 disks), 220 parts of this mixture was subjected to dispersion with 482 parts of glass beads of 0.9 mm in diameter for 4 hours with cooling water of 18° C. This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 150 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 272

An electrophotographic photosensitive member of Photosensitive Member Production Example 272 was produced in the same manner as in Photosensitive Member Production Example 271, except that the thickness of the charge generating layer was changed from 150 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 273

An electrophotographic photosensitive member of Photosensitive Member Production Example 273 was produced in the same manner as in Photosensitive Member Production Example 109, except that the step of forming the charge generating layer by dipping of a coating liquid using the hydroxygallium phthalocyanine pigment subjected to the milling operation was changed as below.

Polyvinyl butyral S-LEC BX-1 (produced by Sekisui Chemical) and cyclohexanone were added to the solution obtained by the centrifugation performed as in Photosensitive Member Production Example 109 so that the ratio of the hydroxygallium phthalocyanine pigment, the polyvinyl butyral and the cyclohexanone would be 13.3:16.7:190. In a sand mill K-800 (manufactured by Aimex, disk diameter: 70 mm, 5 disks), 220 parts of this mixture was subjected to dispersion with 482 parts of glass beads of 0.9 mm in diameter for 4 hours with cooling water of 18° C. This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 150 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 274

An electrophotographic photosensitive member of Photosensitive Member Production Example 274 was produced in the same manner as in Photosensitive Member Production Example 273, except that the thickness of the charge generating layer was changed from 150 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 275

An electrophotographic photosensitive member of Photosensitive Member Production Example 275 was produced in the same manner as in Photosensitive Member Production Example 109, except that the step of forming the charge generating layer by dipping of a coating liquid using the hydroxygallium phthalocyanine pigment subjected to the milling operation was changed as below.

Polyvinyl butyral S-LEC BX-1 (produced by Sekisui Chemical) and cyclohexanone were added to the solution obtained by the centrifugation performed as in Photosensitive Member Production Example 109 so that the ratio of the hydroxygallium phthalocyanine pigment, the polyvinyl butyral and the cyclohexanone would be 15:15:190. In a sand mill K-800 (manufactured by Aimex, disk diameter: 70 mm, 5 disks), 220 parts of this mixture was subjected to dispersion with 482 parts of glass beads of 0.9 mm in diameter for 4 hours with cooling water of 18° C. This operation was performed under the condition where the disks were rotated at 1,800 rpm. To the resulting dispersion liquid were added 444 parts of cyclohexanone and 634 parts of ethyl acetate to yield a coating liquid for forming a charge generating layer. This coating liquid was applied to the surface of the undercoat layer by dipping. The resulting coating film was heated to dry at 100° C. for 10 minutes to yield a 150 nm-thick charge generating layer.

The physical properties of the phthalocyanine pigment, the charge generating layer, and the electrophotographic photosensitive member that were produced as just described were determined in the same manner as in Photosensitive Member Production Example 1, and the results are shown in Table 5.

Photosensitive Member Production Example 276

An electrophotographic photosensitive member of Photosensitive Member Production Example 276 was produced in the same manner as Photosensitive Member Production Example 275, except that the thickness of the charge generating layer was changed from 150 nm to 190 nm.

The physical properties of the phthalocyanine pigment, the charge generating layer, and the electrophotographic photosensitive member that were produced as just described were determined in the same manner as in Photosensitive Member Production Example 1, and the results are shown in Table 5.

TABLE 5

Physical Properties of Phthalocyanine Pigments and Photosensitive Members

| Photosensitive Member Production Example No. | Pigment | Crystallite correlation length r [nm] | Crystalline particle size R [nm] | k = r/R | Charge generating layer thickness d [nm] | Volume ratio P of charge generating material | Absorption coefficient α [$nm^{-1}$] | Charge transport layer thickness [μm] | $\Phi_i \cdot \Psi_i$ |
|---|---|---|---|---|---|---|---|---|---|
| Photosensitive Member Production Example 223 | HOGaPc | 27 | 122 | 0.22 | 100 | 0.58 | 0.0055 | 15 | 0.23 |
| Photosensitive Member Production Example 224 | HOGaPc | 27 | 122 | 0.22 | 150 | 0.19 | 0.0018 | 15 | 0.04 |
| Photosensitive Member Production Example 225 | HOGaPc | 27 | 122 | 0.22 | 190 | 0.19 | 0.0018 | 15 | 0.06 |
| Photosensitive Member Production Example 226 | HOGaPc | 27 | 122 | 0.22 | 150 | 0.26 | 0.0024 | 15 | 0.08 |
| Photosensitive Member Production Example 227 | HOGaPc | 27 | 122 | 0.22 | 190 | 0.26 | 0.0024 | 15 | 0.10 |
| Photosensitive Member Production Example 228 | HOGaPc | 27 | 122 | 0.22 | 150 | 0.31 | 0.0030 | 15 | 0.12 |
| Photosensitive Member Production Example 229 | HOGaPc | 27 | 122 | 0.22 | 190 | 0.31 | 0.0030 | 15 | 0.15 |
| Photosensitive Member Production Example 230 | HOGaPc | 27 | 122 | 0.22 | 150 | 0.35 | 0.0034 | 15 | 0.14 |
| Photosensitive Member Production Example 231 | HOGaPc | 27 | 122 | 0.22 | 190 | 0.35 | 0.0034 | 15 | 0.18 |
| Photosensitive Member Production Example 232 | HOGaPc | 27 | 122 | 0.22 | 150 | 0.41 | 0.0039 | 15 | 0.18 |
| Photosensitive Member Production Example 233 | HOGaPc | 27 | 122 | 0.22 | 190 | 0.41 | 0.0039 | 15 | 0.23 |
| Photosensitive Member Production Example 234 | HOGaPc | 27 | 122 | 0.22 | 150 | 0.51 | 0.0049 | 15 | 0.27 |
| Photosensitive Member Production Example 235 | HOGaPc | 39 | 136 | 0.28 | 100 | 0.58 | 0.0042 | 15 | 0.21 |
| Photosensitive Member Production Example 236 | HOGaPc | 39 | 136 | 0.28 | 130 | 0.58 | 0.0055 | 15 | 0.27 |
| Photosensitive Member Production Example 237 | HOGaPc | 39 | 136 | 0.28 | 150 | 0.58 | 0.0055 | 15 | 0.30 |
| Photosensitive Member Production Example 238 | HOGaPc | 39 | 136 | 0.28 | 170 | 0.19 | 0.0013 | 15 | 0.06 |
| Photosensitive Member Production Example 239 | HOGaPc | 39 | 136 | 0.28 | 190 | 0.19 | 0.0013 | 15 | 0.06 |
| Photosensitive Member Production Example 240 | HOGaPc | 39 | 136 | 0.28 | 170 | 0.26 | 0.0018 | 15 | 0.09 |
| Photosensitive Member Production Example 241 | HOGaPc | 39 | 136 | 0.28 | 190 | 0.26 | 0.0018 | 15 | 0.10 |
| Photosensitive Member Production Example 242 | HOGaPc | 39 | 136 | 0.28 | 170 | 0.31 | 0.0023 | 15 | 0.13 |

TABLE 5-continued

Physical Properties of Phthalocyanine Pigments and Photosensitive Members

| Photosensitive Member Production Example No. | Pigment | Crystallite correlation length r [nm] | Crystalline particle size R [nm] | k = r/R | Charge generating layer thickness d [nm] | Volume ratio P of charge generating material | Absorption coefficient α [$nm^{-1}$] | Charge transport layer thickness [μm] | $\Phi_i \cdot \Psi_i$ |
|---|---|---|---|---|---|---|---|---|---|
| Photosensitive Member Production Example 243 | HOGaPc | 39 | 136 | 0.28 | 190 | 0.31 | 0.0023 | 15 | 0.14 |
| Photosensitive Member Production Example 244 | HOGaPc | 39 | 136 | 0.28 | 170 | 0.35 | 0.0026 | 15 | 0.15 |
| Photosensitive Member Production Example 245 | HOGaPc | 39 | 136 | 0.28 | 190 | 0.35 | 0.0026 | 15 | 0.17 |
| Photosensitive Member Production Example 246 | HOGaPc | 39 | 136 | 0.28 | 170 | 0.41 | 0.0029 | 15 | 0.19 |
| Photosensitive Member Production Example 247 | HOGaPc | 39 | 136 | 0.28 | 190 | 0.41 | 0.0029 | 15 | 0.21 |
| Photosensitive Member Production Example 248 | HOGaPc | 39 | 136 | 0.28 | 170 | 0.51 | 0.0036 | 15 | 0.27 |
| Photosensitive Member Production Example 249 | HOGaPc | 39 | 136 | 0.28 | 190 | 0.51 | 0.0036 | 15 | 0.30 |
| Photosensitive Member Production Example 250 | ClGaPc | 31 | 127 | 0.25 | 100 | 0.67 | 0.0050 | 15 | 0.19 |
| Photosensitive Member Production Example 251 | ClGaPc | 31 | 127 | 0.25 | 130 | 0.67 | 0.0050 | 15 | 0.25 |
| Photosensitive Member Production Example 252 | ClGaPc | 31 | 127 | 0.25 | 150 | 0.67 | 0.0050 | 15 | 0.28 |
| Photosensitive Member Production Example 253 | ClGaPc | 31 | 127 | 0.25 | 170 | 0.19 | 0.0050 | 15 | 0.09 |
| Photosensitive Member Production Example 254 | ClGaPc | 31 | 127 | 0.25 | 190 | 0.19 | 0.0050 | 15 | 0.10 |
| Photosensitive Member Production Example 255 | ClGaPc | 31 | 127 | 0.25 | 170 | 0.26 | 0.0050 | 15 | 0.13 |
| Photosensitive Member Production Example 256 | ClGaPc | 31 | 127 | 0.25 | 190 | 0.26 | 0.0050 | 15 | 0.14 |
| Photosensitive Member Production Example 257 | ClGaPc | 31 | 127 | 0.25 | 170 | 0.31 | 0.0050 | 15 | 0.15 |
| Photosensitive Member Production Example 258 | ClGaPc | 31 | 127 | 0.25 | 190 | 0.31 | 0.0050 | 15 | 0.17 |
| Photosensitive Member Production Example 259 | ClGaPc | 31 | 127 | 0.25 | 170 | 0.35 | 0.0050 | 15 | 0.17 |
| Photosensitive Member Production Example 260 | ClGaPc | 31 | 127 | 0.25 | 190 | 0.35 | 0.0050 | 15 | 0.19 |
| Photosensitive Member Production Example 261 | ClGaPc | 31 | 127 | 0.25 | 170 | 0.41 | 0.0050 | 15 | 0.20 |
| Photosensitive Member Production Example 262 | ClGaPc | 31 | 127 | 0.25 | 190 | 0.41 | 0.0050 | 15 | 0.22 |
| Photosensitive Member Production Example 263 | ClGaPc | 31 | 127 | 0.25 | 170 | 0.51 | 0.0050 | 15 | 0.25 |
| Photosensitive Member Production Example 264 | ClGaPc | 31 | 127 | 0.25 | 190 | 0.51 | 0.0050 | 15 | 0.28 |
| Photosensitive Member Production Example 265 | ClGaPc | 31 | 127 | 0.25 | 170 | 0.58 | 0.0050 | 15 | 0.30 |
| Photosensitive Member Production Example 266 | HOGaPc | 26 | 110 | 0.24 | 100 | 0.58 | 0.0055 | 15 | 0.26 |
| Photosensitive Member Production Example 267 | HOGaPc | 26 | 110 | 0.24 | 150 | 0.19 | 0.0018 | 15 | 0.06 |
| Photosensitive Member Production Example 268 | HOGaPc | 26 | 110 | 0.24 | 190 | 0.19 | 0.0018 | 15 | 0.08 |
| Photosensitive Member Production Example 269 | HOGaPc | 26 | 110 | 0.24 | 150 | 0.26 | 0.0024 | 15 | 0.10 |
| Photosensitive Member Production Example 270 | HOGaPc | 26 | 110 | 0.24 | 190 | 0.26 | 0.0024 | 15 | 0.12 |
| Photosensitive Member Production Example 271 | HOGaPc | 26 | 110 | 0.24 | 150 | 0.31 | 0.0030 | 15 | 0.14 |
| Photosensitive Member Production Example 272 | HOGaPc | 26 | 110 | 0.24 | 190 | 0.31 | 0.0030 | 15 | 0.17 |
| Photosensitive Member Production Example 273 | HOGaPc | 26 | 110 | 0.24 | 150 | 0.35 | 0.0034 | 15 | 0.17 |
| Photosensitive Member Production Example 274 | HOGaPc | 26 | 110 | 0.24 | 190 | 0.35 | 0.0034 | 15 | 0.21 |
| Photosensitive Member Production Example 275 | HOGaPc | 26 | 110 | 0.24 | 150 | 0.41 | 0.0039 | 15 | 0.21 |
| Photosensitive Member Production Example 276 | HOGaPc | 26 | 110 | 0.24 | 190 | 0.41 | 0.0039 | 15 | 0.26 |

Evaluation

Each of the electrophotographic photosensitive members of Photosensitive Member Production Examples 1 to 276 was mounted in an electrophotographic apparatus, and the electrophotographic properties thereof were examined at one or more charged potentials set for evaluation. The results are shown as Examples 1 to 161 and Comparative Examples 1 to 140 in Tables 6 to 12. In the examination of these Examples, when the latent image contrast was higher than 290 V, it was determined that the advantageous effect of the concept of the present disclosure was produced.

The "Photosensitive Member Production Example" for each of the Examples and Comparative Examples in Tables 6 to 12 refers to the Photosensitive Member Production Example in which the photosensitive member used for evaluation was produced, and "k=r/R" and "$\Phi_i\Psi_i$" represent parameters of the photosensitive member of the corresponding Photosensitive Member Production Example. "k=r/R" and "$\Phi_i\Psi_i$" are the same as the values shown in Tables 1 to 5. Also, "Charged potential (V)" represents the value set for the examination of the corresponding Example or Comparative Example, and "Charge electric filed intensity (V/μm)" represents the quotient of the charged potential (V) divided by the thickness of the charge transport layer (μm) of the photosensitive member of the corresponding Photosensitive Member Production Example. "Latent image contrast (V)", "Fogging value", and "Number of leakage sheets ($\times 10^3$)" are electrophotographic properties representing sensitivity, effect of reducing fogging, and effect of reducing leakage, respectively. The electrophotographic apparatus used for the evaluation and how the evaluation was performed will be described below.

Apparatus Used for Evaluation

The apparatus used for evaluation of the electrophotographic photosensitive members produced in Photosensitive Member Production Examples 1 to 276 was prepared as below.

A laser beam printer Color Laser Jet CP3525dn manufactured by Hewlett-Packard was modified as below as the electrophotographic apparatus used for examinations. The laser beam printer was modified so that the charging conditions and the amount of laser exposure could be varied. Also, the electrophotographic photosensitive member to be examined was mounted to the cyan process cartridge of the laser beam printer, and this cartridge was attached to the station for cyan. Furthermore, the printer was modified so that it was able to be operated without other process cartridges (for magenta, yellow, and black).

For outputting images, only the cyan process cartridge was mounted to the laser beam printer, and a cyan single-color pattern was outputted.

Evaluation of Sensitivity

For evaluating the sensitivity of the electrophotographic photosensitive members, latent image contrast was measured as below. First, charging conditions and the amount of image exposure were adjusted so that the charged potential and the exposure potential of the electrophotographic photosensitive member produced in Photosensitive Member Production Example 163 could be −450 V and −170 V, respectively, at normal temperature and normal humidity (23° C., 50% RH). The latent image contrast at this time is 280 V. For measuring the surface potential of the electrophotographic photosensitive member, a potential probe Model 6000B-8 (manufactured by Trek Japan) was put at the developing position of the process cartridge, and the surface potential at the center in the longitudinal direction of the electrophotographic photosensitive member was measured with a surface electrometer Model 344 (manufactured by Trek Japan).

Subsequently, the amount of image exposure was fixed at the value adjusted above, and the latent image contrast of each of the photosensitive members of photosensitive member production examples 1 to 276 was measured at the corresponding charged potential set as shown in Tables 6 to 12. The higher the latent image contrast, the high the sensitivity of the electrophotographic photosensitive member. In the examination of these Examples, when the latent image contrast was higher than 290 V, it was determined that the advantageous effect of the concept of the present disclosure was produced.

Evaluation of Fogging

For evaluation of fogging over the image pattern of each electrophotographic photosensitive member, image density was measured as below from the viewpoint of image quality (uniformity in charge). At normal temperature and normal humidity (23° C., 50% RH), first, the charged potential of the electrophotographic photosensitive members of Photosensitive Member Production Examples 1 to 276 was set to the corresponding value shown in Tables 6 to 12, and the amount of image exposure was adjusted so that the latent image contrast could be 330 V. Also, the developing potential was adjusted so that Vback could be 150 V. The latent image contrast at this time is 180 V. At these settings, a 3-dot, 100-space vertical line pattern was successively outputted onto 10,000 A4 plain paper sheets by repeating consecutive output onto 3 sheets followed by a 6-second pause.

After output to 10,000 sheets, a white solid pattern was outputted, and the worst reflection density $F_1$ [%] was measured. For this measurement, A4 highly white paper sheets GF-C081 A4 (available from Canon Marketing Japan) were used as the test paper. The average of reflection densities of the paper sheets before pattern output was defined as $F_0$ [%], and the value [%] of fogging (fogging value) was defined by $F_0-F_1$. For measuring the density, a white light photometer (TC-6DS, produced by Tokyo Denshoku) was used. The lower the value, the higher the effect of reducing fogging. In the evaluation conducted herein, evaluation grades AA to D represent that the test results were good, and evaluation grade E represents that the test results were unacceptable.

AA: The fogging value was less than 1.0.
A: The fogging value was in the range of 1.0 to less than 1.5.
B: The fogging value was in the range of 1.5 to less than 2.0.
C: The fogging value was in the range of 2.0 to less than 2.5.
D: The fogging value was in the range of 2.5 to less than 5.0.
E: The fogging value was more than 5.0.

Evaluation of Leakage

Leakage in the electrophotographic photosensitive member was examined as below. At low temperature and low humidity (15° C., 10% RH), first, the charged potential of the electrophotographic photosensitive members of Photosensitive Member Production Examples 1 to 276 was set to the corresponding value shown in Tables 6 to 12, and the amount of image exposure was adjusted so that the latent image contrast could be 330 V. Also, the developing potential was adjusted so that Vback could be 200 V. The latent image contrast at this time is 130 V. A 3-dot 100-space vertical line pattern was successively outputted onto A4 plain paper sheets at these settings while a white solid pattern was outputted onto one sheet every 1,000 sheets.

Subsequently, blue spots in the area of each of the resulting white solid patterns equivalent to the area of the outside curved surface of the electrophotographic photosensitive member were counted. Then, the number of sheets that had been fed when at least 10 blue spots were detected in the area of the white solid pattern for the first time was defined as the number of leakage sheets.

TABLE 6

$\Phi_i$ and $\Psi_i$ of Photosensitive Members and Test Results

| Example No. | Photosensitive Member Production Example No. | k = r/R | $\Phi_i \cdot \Psi_i$ | Charged potential [V] | Charge electric filed intensity [V/μm] | Latent image contrast [V] | Fogging value | Number of leakage sheets ($\times 10^3$) |
|---|---|---|---|---|---|---|---|---|
| Example 1 | Photosensitive Member Production Example 1 | 0.25 | 0.34 | −450 | 30 | 348 | AA(0.9) | 27 |
| Example 2 | Photosensitive Member Production Example 2 | 0.26 | 0.35 | −450 | 30 | 336 | AA(0.9) | 26 |
| Example 3 | Photosensitive Member Production Example 3 | 0.30 | 0.36 | −450 | 30 | 328 | AA(0.9) | 26 |
| Example 4 | Photosensitive Member Production Example 4 | 0.32 | 0.37 | −450 | 30 | 350 | AA(0.9) | 25 |
| Example 5 | Photosensitive Member Production Example 5 | 0.35 | 0.37 | −450 | 30 | 334 | AA(0.8) | 26 |
| Example 6 | Photosensitive Member Production Example 6 | 0.22 | 0.32 | −450 | 30 | 331 | AA(0.9) | 25 |
| Example 7 | Photosensitive Member Production Example 7 | 0.26 | 0.34 | −450 | 30 | 324 | AA(0.8) | 25 |
| Example 8 | Photosensitive Member Production Example 8 | 0.31 | 0.37 | −450 | 30 | 356 | AA(0.8) | 25 |
| Example 9 | Photosensitive Member Production Example 9 | 0.38 | 0.38 | −450 | 30 | 347 | AA(0.8) | 26 |
| Example 10 | Photosensitive Member Production Example 10 | 0.41 | 0.38 | −450 | 30 | 337 | AA(0.9) | 25 |
| Example 11 | Photosensitive Member Production Example 11 | 0.31 | 0.32 | −450 | 30 | 342 | AA(0.8) | 26 |
| Example 12 | Photosensitive Member Production Example 12 | 0.31 | 0.41 | −450 | 30 | 369 | B(1.8) | 26 |
| Example 13 | Photosensitive Member Production Example 13 | 0.31 | 0.44 | −450 | 30 | 353 | B(1.7) | 26 |
| Example 14 | Photosensitive Member Production Example 14 | 0.31 | 0.38 | −450 | 30 | 334 | B(1.7) | 25 |
| Example 15 | Photosensitive Member Production Example 15 | 0.31 | 0.45 | −450 | 30 | 364 | AA(0.9) | 26 |
| Example 16 | Photosensitive Member Production Example 16 | 0.31 | 0.54 | −450 | 30 | 364 | B(1.8) | 27 |
| Example 17 | Photosensitive Member Production Example 17 | 0.31 | 0.48 | −450 | 30 | 364 | AA(0.8) | 26 |
| Example 18 | Photosensitive Member Production Example 18 | 0.31 | 0.58 | −450 | 30 | 364 | C(2.0) | 25 |
| Example 19 | Photosensitive Member Production Example 19 | 0.31 | 0.51 | −450 | 30 | 364 | B(1.9) | 27 |
| Example 20 | Photosensitive Member Production Example 20 | 0.31 | 0.61 | −450 | 30 | 364 | D(2.7) | 26 |

TABLE 6-continued $\Phi_i$ and $\Psi_i$ of Photosensitive Members and Test Results

| Example No. | Photosensitive Member Production Example No. | k = r/R | $\Phi_i \cdot \Psi_i$ | Charged potential [V] | Charge electric filed intensity [V/μm] | Latent image contrast [V] | Fogging value | Number of leakage sheets ($\times 10^3$) |
|---|---|---|---|---|---|---|---|---|
| Example 21 | Photosensitive Member Production Example 8 | 0.31 | 0.37 | −480 | 32 | 377 | C(2.0) | 20 |
| Example 22 | Photosensitive Member Production Example 8 | 0.31 | 0.37 | −520 | 35 | 372 | AA(0.7) | 20 |
| Example 23 | Photosensitive Member Production Example 8 | 0.31 | 0.37 | −550 | 37 | 387 | AA(0.8) | 17 |
| Example 24 | Photosensitive Member Production Example 8 | 0.31 | 0.37 | −600 | 40 | 424 | AA(0.7) | 16 |
| Example 25 | Photosensitive Member Production Example 8 | 0.31 | 0.37 | −700 | 47 | 485 | AA(0.9) | 12 |
| Example 26 | Photosensitive Member Production Example 21 | 0.31 | 0.37 | −450 | 41 | 306 | C(2.2) | 12 |
| Example 27 | Photosensitive Member Production Example 22 | 0.31 | 0.37 | −450 | 35 | 337 | C(2.0) | 17 |
| Example 28 | Photosensitive Member Production Example 23 | 0.31 | 0.37 | −450 | 26 | 361 | AA(0.9) | 31 |
| Example 29 | Photosensitive Member Production Example 24 | 0.31 | 0.37 | −450 | 23 | 364 | AA(0.8) | 42 |
| Example 30 | Photosensitive Member Production Example 25 | 0.31 | 0.37 | −450 | 20 | 364 | AA(0.9) | 51 |
| Example 31 | Photosensitive Member Production Example 26 | 0.31 | 0.37 | −450 | 17 | 364 | AA(0.9) | 61 |
| Example 32 | Photosensitive Member Production Example 27 | 0.28 | 0.34 | −450 | 30 | 330 | AA(0.9) | 25 |
| Example 33 | Photosensitive Member Production Example 28 | 0.31 | 0.36 | −450 | 30 | 353 | AA(0.8) | 26 |
| Example 34 | Photosensitive Member Production Example 29 | 0.23 | 0.32 | −450 | 30 | 348 | AA(0.9) | 26 |
| Example 35 | Photosensitive Member Production Example 30 | 0.31 | 0.35 | −450 | 30 | 348 | AA(0.8) | 26 |
| Example 36 | Photosensitive Member Production Example 31 | 0.36 | 0.35 | −450 | 30 | 355 | AA(0.8) | 26 |
| Example 37 | Photosensitive Member Production Example 32 | 0.40 | 0.37 | −450 | 30 | 345 | AA(0.9) | 27 |
| Example 38 | Photosensitive Member Production Example 33 | 0.27 | 0.34 | −450 | 30 | 352 | AA(0.9) | 26 |
| Example 39 | Photosensitive Member Production Example 34 | 0.28 | 0.34 | −450 | 30 | 353 | AA(0.8) | 26 |
| Example 40 | Photosensitive Member Production Example 35 | 0.21 | 0.32 | −450 | 30 | 320 | AA(0.9) | 25 |
| Example 41 | Photosensitive Member Production Example 36 | 0.22 | 0.32 | −450 | 30 | 329 | AA(0.8) | 25 |

TABLE 7

$\Phi_i$ and $\Psi_i$ of Photosensitive Members and Test Results

| Example No. | Photosensitive Member Production Example No. | k = r/R | $\Phi_i \cdot \Psi_i$ | Charged potential [V] | Charge electric filed intensity [V/μm] | Latent image contrast [V] | Fogging value | Number of leakage sheets ($\times 10^3$) |
|---|---|---|---|---|---|---|---|---|
| Example 42 | Photosensitive Member Production Example 37 | 0.22 | 0.34 | −450 | 30 | 330 | AA(0.8) | 27 |
| Example 43 | Photosensitive Member Production Example 38 | 0.19 | 0.33 | −450 | 30 | 342 | AA(0.8) | 26 |
| Example 44 | Photosensitive Member Production Example 39 | 0.22 | 0.32 | −450 | 30 | 341 | AA(0.8) | 26 |
| Example 45 | Photosensitive Member Production Example 40 | 0.22 | 0.38 | −450 | 30 | 335 | B(1.7) | 26 |
| Example 46 | Photosensitive Member Production Example 41 | 0.22 | 0.42 | −450 | 30 | 347 | B(1.9) | 25 |
| Example 47 | Photosensitive Member Production Example 42 | 0.22 | 0.34 | −450 | 30 | 342 | B(1.7) | 25 |
| Example 48 | Photosensitive Member Production Example 43 | 0.22 | 0.43 | −450 | 30 | 340 | AA(0.9) | 27 |
| Example 49 | Photosensitive Member Production Example 44 | 0.22 | 0.52 | −450 | 30 | 364 | B(1.7) | 25 |
| Example 50 | Photosensitive Member Production Example 45 | 0.22 | 0.46 | −450 | 30 | 364 | AA(0.9) | 25 |
| Example 51 | Photosensitive Member Production Example 46 | 0.22 | 0.56 | −450 | 30 | 364 | B(1.9) | 26 |
| Example 52 | Photosensitive Member Production Example 47 | 0.22 | 0.49 | −450 | 30 | 364 | C(2.0) | 26 |
| Example 53 | Photosensitive Member Production Example 48 | 0.22 | 0.59 | −450 | 30 | 364 | D(2.9) | 25 |
| Example 54 | Photosensitive Member Production Example 37 | 0.22 | 0.34 | −480 | 32 | 363 | B(1.8) | 21 |
| Example 55 | Photosensitive Member Production Example 37 | 0.22 | 0.34 | −520 | 35 | 382 | AA(0.8) | 20 |
| Example 56 | Photosensitive Member Production Example 37 | 0.22 | 0.34 | −550 | 37 | 409 | AA(0.8) | 19 |
| Example 57 | Photosensitive Member Production Example 37 | 0.22 | 0.34 | −600 | 40 | 397 | AA(0.9) | 17 |
| Example 58 | Photosensitive Member Production Example 37 | 0.22 | 0.34 | −700 | 47 | 455 | AA(0.9) | 12 |
| Example 59 | Photosensitive Member Production Example 49 | 0.22 | 0.34 | −450 | 41 | 300 | B(1.8) | 12 |
| Example 60 | Photosensitive Member Production Example 50 | 0.22 | 0.34 | −450 | 35 | 329 | B(1.9) | 17 |
| Example 61 | Photosensitive Member Production Example 51 | 0.22 | 0.34 | −450 | 26 | 363 | AA(0.8) | 32 |
| Example 62 | Photosensitive Member Production Example 52 | 0.22 | 0.34 | −450 | 23 | 354 | AA(0.9) | 40 |
| Example 63 | Photosensitive Member Production Example 53 | 0.22 | 0.34 | −450 | 20 | 364 | AA(0.8) | 51 |
| Example 64 | Photosensitive Member Production Example 54 | 0.22 | 0.34 | −450 | 17 | 364 | AA(0.8) | 61 |
| Example 65 | Photosensitive Member Production Example 55 | 0.24 | 0.33 | −450 | 30 | 344 | D(2.5) | 26 |
| Example 66 | Photosensitive Member Production Example 56 | 0.25 | 0.33 | −450 | 30 | 352 | C(2.3) | 25 |
| Example 67 | Photosensitive Member Production Example 57 | 0.25 | 0.33 | −450 | 30 | 324 | C(2.1) | 26 |
| Example 68 | Photosensitive Member Production Example 58 | 0.26 | 0.33 | −450 | 30 | 323 | C(2.2) | 25 |
| Example 69 | Photosensitive Member Production Example 59 | 0.28 | 0.34 | −450 | 30 | 326 | D(2.5) | 26 |
| Example 70 | Photosensitive Member Production Example 60 | 0.28 | 0.37 | −450 | 30 | 358 | C(2.2) | 26 |
| Example 71 | Photosensitive Member Production Example 61 | 0.28 | 0.43 | −450 | 30 | 343 | D(2.5) | 26 |
| Example 72 | Photosensitive Member Production Example 62 | 0.28 | 0.47 | −450 | 30 | 375 | D(2.6) | 26 |
| Example 73 | Photosensitive Member Production Example 63 | 0.28 | 0.46 | −450 | 30 | 364 | C(2.4) | 27 |
| Example 74 | Photosensitive Member Production Example 64 | 0.28 | 0.50 | −450 | 30 | 364 | D(2.5) | 26 |
| Example 75 | Photosensitive Member Production Example 65 | 0.28 | 0.49 | −450 | 30 | 374 | D(3.3) | 25 |
| Example 76 | Photosensitive Member Production Example 66 | 0.28 | 0.53 | −450 | 30 | 364 | D(3.4) | 27 |
| Example 77 | Photosensitive Member Production Example 59 | 0.28 | 0.34 | −480 | 32 | 353 | D(3.0) | 21 |
| Example 78 | Photosensitive Member Production Example 59 | 0.28 | 0.34 | −520 | 35 | 362 | C(2.1) | 18 |

TABLE 7-continued $\Phi_i$ and $\Psi_i$ of Photosensitive Members and Test Results

| Example No. | Photosensitive Member Production Example No. | k = r/R | $\Phi_i \cdot \Psi_i$ | Charged potential [V] | Charge electric filed intensity [V/μm] | Latent image contrast [V] | Fogging value | Number of leakage sheets ($\times 10^3$) |
|---|---|---|---|---|---|---|---|---|
| Example 79 | Photosensitive Member Production Example 59 | 0.28 | 0.34 | −550 | 37 | 386 | C(2.2) | 19 |
| Example 80 | Photosensitive Member Production Example 59 | 0.28 | 0.34 | −600 | 40 | 408 | C(2.4) | 16 |
| Example 81 | Photosensitive Member Production Example 59 | 0.28 | 0.34 | −700 | 47 | 471 | C(2.2) | 12 |
| Example 82 | Photosensitive Member Production Example 67 | 0.28 | 0.34 | −450 | 41 | 295 | D(3.4) | 12 |
| Example 83 | Photosensitive Member Production Example 68 | 0.28 | 0.34 | −450 | 35 | 332 | D(3.5) | 17 |
| Example 84 | Photosensitive Member Production Example 69 | 0.28 | 0.34 | −450 | 26 | 364 | C(2.3) | 32 |
| Example 85 | Photosensitive Member Production Example 70 | 0.28 | 0.34 | −450 | 23 | 364 | C(2.1) | 40 |
| Example 86 | Photosensitive Member Production Example 71 | 0.28 | 0.34 | −450 | 20 | 364 | C(2.2) | 49 |
| Example 87 | Photosensitive Member Production Example 72 | 0.28 | 0.34 | −450 | 17 | 364 | C(2.1) | 61 |
| Example 88 | Photosensitive Member Production Example 73 | 0.24 | 0.33 | −450 | 30 | 350 | D(2.5) | 26 |

TABLE 8

$\Phi_i$ and $\Psi_i$ of Photosensitive Members and Test Results

| Example No. | Photosensitive Member Production Example No. | k = r/R | $\Phi_i \cdot \Psi_i$ | Charged potential [V] | Charge electric filed intensity [V/μm] | Latent image contrast [V] | Fogging value | Number of leakage sheets ($\times 10^3$) |
|---|---|---|---|---|---|---|---|---|
| Example 89 | Photosensitive Member Production Example 74 | 0.27 | 0.33 | −450 | 30 | 327 | C(2.4) | 26 |
| Example 90 | Photosensitive Member Production Example 75 | 0.28 | 0.33 | −450 | 30 | 322 | C(2.4) | 25 |
| Example 91 | Photosensitive Member Production Example 76 | 0.25 | 0.32 | −450 | 30 | 340 | C(2.2) | 26 |
| Example 92 | Photosensitive Member Production Example 77 | 0.27 | 0.32 | −450 | 30 | 335 | C(2.3) | 27 |
| Example 93 | Photosensitive Member Production Example 78 | 0.30 | 0.33 | −450 | 30 | 345 | C(2.3) | 25 |
| Example 94 | Photosensitive Member Production Example 79 | 0.31 | 0.34 | −450 | 30 | 349 | C(2.3) | 26 |
| Example 95 | Photosensitive Member Production Example 80 | 0.22 | 0.32 | −450 | 30 | 324 | C(2.2) | 25 |
| Example 96 | Photosensitive Member Production Example 81 | 0.25 | 0.32 | −450 | 30 | 339 | C(2.4) | 26 |
| Example 97 | Photosensitive Member Production Example 82 | 0.25 | 0.36 | −450 | 30 | 332 | C(2.5) | 25 |
| Example 98 | Photosensitive Member Production Example 83 | 0.25 | 0.32 | −450 | 30 | 340 | C(2.5) | 26 |
| Example 99 | Photosensitive Member Production Example 84 | 0.25 | 0.34 | −450 | 30 | 333 | C(2.4) | 25 |
| Example 100 | Photosensitive Member Production Example 85 | 0.25 | 0.38 | −450 | 30 | 360 | D(2.5) | 25 |
| Example 101 | Photosensitive Member Production Example 86 | 0.25 | 0.36 | −450 | 30 | 346 | D(3.2) | 25 |
| Example 102 | Photosensitive Member Production Example 87 | 0.25 | 0.40 | −450 | 30 | 366 | D(3.2) | 25 |
| Example 103 | Photosensitive Member Production Example 81 | 0.25 | 0.32 | −480 | 32 | 364 | D(3.3) | 21 |
| Example 104 | Photosensitive Member Production Example 81 | 0.25 | 0.32 | −520 | 35 | 363 | C(2.1) | 18 |
| Example 105 | Photosensitive Member Production Example 81 | 0.25 | 0.32 | −550 | 37 | 405 | C(2.3) | 17 |
| Example 106 | Photosensitive Member Production Example 81 | 0.25 | 0.32 | −600 | 40 | 429 | C(2.0) | 16 |
| Example 107 | Photosensitive Member Production Example 81 | 0.25 | 0.32 | −700 | 47 | 477 | C(2.1) | 13 |
| Example 108 | Photosensitive Member Production Example 88 | 0.25 | 0.32 | −450 | 41 | 304 | D(3.3) | 11 |
| Example 109 | Photosensitive Member Production Example 89 | 0.25 | 0.32 | −450 | 35 | 309 | D(3.0) | 17 |
| Example 110 | Photosensitive Member Production Example 90 | 0.25 | 0.32 | −450 | 26 | 343 | D(2.5) | 31 |
| Example 111 | Photosensitive Member Production Example 91 | 0.25 | 0.32 | −450 | 23 | 364 | C(2.3) | 41 |
| Example 112 | Photosensitive Member Production Example 92 | 0.25 | 0.32 | −450 | 20 | 364 | C(2.4) | 50 |
| Example 113 | Photosensitive Member Production Example 93 | 0.25 | 0.32 | −450 | 17 | 364 | C(2.1) | 62 |
| Example 114 | Photosensitive Member Production Example 94 | 0.23 | 0.32 | −450 | 30 | 341 | C(2.4) | 26 |
| Example 115 | Photosensitive Member Production Example 95 | 0.26 | 0.32 | −450 | 30 | 320 | C(2.4) | 26 |
| Example 116 | Photosensitive Member Production Example 96 | 0.24 | 0.32 | −450 | 30 | 336 | C(2.3) | 25 |
| Example 117 | Photosensitive Member Production Example 97 | 0.23 | 0.32 | −450 | 30 | 318 | C(2.2) | 25 |
| Example 118 | Photosensitive Member Production Example 98 | 0.26 | 0.33 | −450 | 30 | 340 | C(2.2) | 26 |
| Example 119 | Photosensitive Member Production Example 99 | 0.28 | 0.34 | −450 | 30 | 332 | C(2.2) | 25 |
| Example 120 | Photosensitive Member Production Example 100 | 0.23 | 0.32 | −450 | 30 | 333 | B(1.5) | 25 |
| Example 121 | Photosensitive Member Production Example 101 | 0.23 | 0.33 | −450 | 30 | 332 | A(1.4) | 26 |
| Example 122 | Photosensitive Member Production Example 102 | 0.25 | 0.33 | −450 | 30 | 350 | A(1.3) | 25 |
| Example 123 | Photosensitive Member Production Example 103 | 0.27 | 0.33 | −450 | 30 | 323 | A(1.3) | 27 |
| Example 124 | Photosensitive Member Production Example 104 | 0.23 | 0.32 | −450 | 30 | 317 | A(1.3) | 26 |
| Example 125 | Photosensitive Member Production Example 105 | 0.24 | 0.32 | −450 | 30 | 344 | B(1.5) | 26 |
| Example 126 | Photosensitive Member Production Example 106 | 0.27 | 0.32 | −450 | 30 | 345 | A(1.3) | 26 |

TABLE 9

$\Phi_i$ and $\Psi_i$ of Photosensitive Members and Test Results

| Example No. | Photosensitive Member Production Example No. | k = r/R | $\Phi_i \cdot \Psi_i$ | Charged potential [V] | Charge electric filed intensity [V/μm] | Latent image contrast [V] | Fogging value | Number of leakage sheets ($\times 10^3$) |
|---|---|---|---|---|---|---|---|---|
| Example 127 | Photosensitive Member Production Example 107 | 0.35 | 0.41 | −450 | 30 | 364 | AA(0.8) | 26 |
| Example 128 | Photosensitive Member Production Example 108 | 0.28 | 0.39 | −450 | 30 | 332 | AA(0.9) | 25 |
| Example 129 | Photosensitive Member Production Example 109 | 0.24 | 0.37 | −450 | 30 | 361 | AA(0.9) | 25 |
| Example 130 | Photosensitive Member Production Example 110 | 0.24 | 0.33 | −450 | 30 | 326 | AA(0.9) | 26 |
| Example 131 | Photosensitive Member Production Example 111 | 0.24 | 0.41 | −450 | 30 | 346 | B(1.7) | 26 |
| Example 132 | Photosensitive Member Production Example 112 | 0.24 | 0.45 | −450 | 30 | 344 | B(1.9) | 26 |
| Example 133 | Photosensitive Member Production Example 113 | 0.24 | 0.32 | −450 | 30 | 329 | AA(0.8) | 26 |
| Example 134 | Photosensitive Member Production Example 114 | 0.24 | 0.37 | −450 | 30 | 327 | B(1.9) | 26 |
| Example 135 | Photosensitive Member Production Example 115 | 0.24 | 0.49 | −450 | 30 | 376 | AA(0.8) | 26 |
| Example 136 | Photosensitive Member Production Example 116 | 0.24 | 0.56 | −450 | 30 | 364 | B(1.8) | 26 |
| Example 137 | Photosensitive Member Production Example 117 | 0.24 | 0.50 | −450 | 30 | 373 | AA(0.9) | 25 |
| Example 138 | Photosensitive Member Production Example 118 | 0.24 | 0.60 | −450 | 30 | 364 | B(1.8) | 25 |
| Example 139 | Photosensitive Member Production Example 119 | 0.24 | 0.53 | −450 | 30 | 364 | C(2.0) | 25 |
| Example 140 | Photosensitive Member Production Example 120 | 0.24 | 0.63 | −450 | 30 | 364 | D(3.0) | 25 |
| Example 141 | Photosensitive Member Production Example 109 | 0.24 | 0.37 | −480 | 32 | 368 | B(1.7) | 20 |
| Example 142 | Photosensitive Member Production Example 109 | 0.24 | 0.37 | −520 | 35 | 371 | AA(0.8) | 19 |
| Example 143 | Photosensitive Member Production Example 109 | 0.24 | 0.37 | −550 | 37 | 393 | AA(0.9) | 17 |
| Example 144 | Photosensitive Member Production Example 109 | 0.24 | 0.37 | −600 | 40 | 404 | AA(0.7) | 15 |
| Example 145 | Photosensitive Member Production Example 109 | 0.24 | 0.37 | −700 | 47 | 479 | AA(0.9) | 13 |
| Example 146 | Photosensitive Member Production Example 121 | 0.24 | 0.37 | −450 | 41 | 305 | C(2.0) | 11 |
| Example 147 | Photosensitive Member Production Example 122 | 0.24 | 0.37 | −450 | 35 | 339 | C(2.1) | 17 |
| Example 148 | Photosensitive Member Production Example 123 | 0.24 | 0.37 | −450 | 26 | 364 | AA(0.8) | 31 |
| Example 149 | Photosensitive Member Production Example 124 | 0.24 | 0.37 | −450 | 23 | 364 | AA(0.8) | 41 |
| Example 150 | Photosensitive Member Production Example 125 | 0.24 | 0.37 | −450 | 20 | 364 | AA(0.8) | 49 |
| Example 151 | Photosensitive Member Production Example 126 | 0.24 | 0.37 | −450 | 17 | 364 | AA(0.9) | 63 |
| Example 152 | Photosensitive Member Production Example 127 | 0.34 | 0.37 | −450 | 30 | 351 | C(2.2) | 26 |
| Example 153 | Photosensitive Member Production Example 128 | 0.26 | 0.38 | −450 | 30 | 350 | C(2.1) | 25 |
| Example 154 | Photosensitive Member Production Example 129 | 0.16 | 0.36 | −450 | 30 | 314 | AA(0.8) | 26 |
| Example 155 | Photosensitive Member Production Example 130 | 0.16 | 0.33 | −450 | 30 | 309 | AA(0.8) | 26 |
| Example 156 | Photosensitive Member Production Example 131 | 0.16 | 0.36 | −450 | 30 | 307 | AA(0.9) | 26 |
| Example 157 | Photosensitive Member Production Example 132 | 0.18 | 0.32 | −450 | 30 | 322 | A(1.4) | 25 |
| Example 158 | Photosensitive Member Production Example 133 | 0.18 | 0.32 | −450 | 30 | 323 | A(1.3) | 27 |
| Example 159 | Photosensitive Member Production Example 134 | 0.14 | 0.33 | −450 | 30 | 313 | C(2.1) | 27 |
| Example 160 | Photosensitive Member Production Example 135 | 0.16 | 0.34 | −450 | 30 | 304 | A(1.3) | 27 |
| Example 161 | Photosensitive Member Production Example 136 | 0.44 | 0.32 | −450 | 30 | 348 | D(3.1) | 26 |

TABLE 10

$\Phi_i$ and $\Psi_i$ of Photosensitive Members and Test Results

| Comparative Example No. | Photosensitive Member Production Example No. | k = r/R | $\Phi_i \cdot \Psi_i$ | Charged potential [V] | Charge electric filed intensity [V/μm] | Latent image contrast [V] | Fogging value | Number of leakage sheets ($\times 10^3$) |
|---|---|---|---|---|---|---|---|---|
| Comparative Example 1 | Photosensitive Member Production Example 137 | 0.10 | 0.14 | −450 | 30 | 226 | AA(0.9) | 26 |
| Comparative Example 2 | Photosensitive Member Production Example 138 | 0.10 | 0.19 | −450 | 30 | 216 | AA(0.7) | 26 |
| Comparative Example 3 | Photosensitive Member Production Example 139 | 0.10 | 0.22 | −450 | 30 | 226 | AA(0.7) | 26 |
| Comparative Example 4 | Photosensitive Member Production Example 140 | 0.11 | 0.24 | −450 | 30 | 233 | AA(0.7) | 25 |
| Comparative Example 5 | Photosensitive Member Production Example 141 | 0.11 | 0.25 | −450 | 30 | 231 | AA(0.9) | 26 |
| Comparative Example 6 | Photosensitive Member Production Example 142 | 0.12 | 0.26 | −450 | 30 | 231 | AA(0.8) | 26 |
| Comparative Example 7 | Photosensitive Member Production Example 143 | 0.10 | 0.23 | −450 | 30 | 233 | AA(0.8) | 25 |
| Comparative Example 8 | Photosensitive Member Production Example 144 | 0.08 | 0.23 | −450 | 30 | 231 | AA(0.9) | 26 |
| Comparative Example 9 | Photosensitive Member Production Example 145 | 0.08 | 0.22 | −450 | 30 | 230 | AA(0.9) | 25 |
| Comparative Example 10 | Photosensitive Member Production Example 146 | 0.08 | 0.21 | −450 | 30 | 223 | AA(0.7) | 26 |
| Comparative Example 11 | Photosensitive Member Production Example 147 | 0.13 | 0.21 | −450 | 30 | 235 | AA(0.8) | 25 |
| Comparative Example 12 | Photosensitive Member Production Example 148 | 0.13 | 0.23 | −450 | 30 | 242 | AA(0.7) | 25 |
| Comparative Example 13 | Photosensitive Member Production Example 149 | 0.14 | 0.20 | −450 | 30 | 219 | AA(0.8) | 26 |
| Comparative Example 14 | Photosensitive Member Production Example 150 | 0.14 | 0.27 | −450 | 30 | 229 | AA(0.7) | 26 |
| Comparative Example 15 | Photosensitive Member Production Example 151 | 0.15 | 0.21 | −450 | 30 | 232 | AA(0.9) | 25 |
| Comparative Example 16 | Photosensitive Member Production Example 152 | 0.16 | 0.30 | −450 | 30 | 243 | AA(0.7) | 26 |
| Comparative Example 17 | Photosensitive Member Production Example 153 | 0.15 | 0.26 | −450 | 30 | 240 | AA(0.9) | 25 |
| Comparative Example 18 | Photosensitive Member Production Example 154 | 0.15 | 0.20 | −450 | 30 | 222 | AA(0.8) | 25 |
| Comparative Example 19 | Photosensitive Member Production Example 155 | 0.11 | 0.21 | −450 | 30 | 233 | AA(0.8) | 25 |
| Comparative Example 20 | Photosensitive Member Production Example 156 | 0.12 | 0.21 | −450 | 30 | 227 | AA(0.7) | 25 |
| Comparative Example 21 | Photosensitive Member Production Example 157 | 0.12 | 0.22 | −450 | 30 | 221 | AA(0.7) | 26 |
| Comparative Example 22 | Photosensitive Member Production Example 158 | 0.11 | 0.19 | −450 | 30 | 227 | AA(0.7) | 27 |
| Comparative Example 23 | Photosensitive Member Production Example 159 | 0.12 | 0.19 | −450 | 30 | 233 | AA(0.8) | 25 |

TABLE 10-continued $\Phi_i$ and $\Psi_i$ of Photosensitive Members and Test Results

| Comparative Example No. | Photosensitive Member Production Example No. | k = r/R | $\Phi_i \cdot \Psi_i$ | Charged potential [V] | Charge electric filed intensity [V/μm] | Latent image contrast [V] | Fogging value | Number of leakage sheets ($\times 10^3$) |
|---|---|---|---|---|---|---|---|---|
| Comparative Example 24 | Photosensitive Member Production Example 160 | 0.12 | 0.21 | −450 | 30 | 228 | AA(0.8) | 27 |
| Comparative Example 25 | Photosensitive Member Production Example 161 | 0.12 | 0.28 | −450 | 30 | 247 | AA(0.8) | 25 |
| Comparative Example 26 | Photosensitive Member Production Example 162 | 0.15 | 0.30 | −450 | 30 | 249 | AA(0.7) | 25 |
| Comparative Example 27 | Photosensitive Member Production Example 163 | 0.16 | 0.30 | −450 | 30 | 280 | A(1.2) | 25 |
| Comparative Example 28 | Photosensitive Member Production Example 164 | 0.13 | 0.26 | −450 | 30 | 248 | A(1.3) | 25 |
| Comparative Example 29 | Photosensitive Member Production Example 165 | 0.13 | 0.25 | −450 | 30 | 231 | A(1.2) | 25 |
| Comparative Example 30 | Photosensitive Member Production Example 166 | 0.13 | 0.27 | −450 | 30 | 237 | A(1.4) | 26 |
| Comparative Example 31 | Photosensitive Member Production Example 167 | 0.13 | 0.28 | −450 | 30 | 230 | A(1.4) | 25 |
| Comparative Example 32 | Photosensitive Member Production Example 168 | 0.13 | 0.29 | −450 | 30 | 233 | A(1.2) | 25 |
| Comparative Example 33 | Photosensitive Member Production Example 169 | 0.08 | 0.21 | −450 | 30 | 220 | A(1.3) | 25 |
| Comparative Example 34 | Photosensitive Member Production Example 170 | 0.11 | 0.22 | −450 | 30 | 233 | A(1.3) | 25 |
| Comparative Example 35 | Photosensitive Member Production Example 171 | 0.11 | 0.21 | −450 | 30 | 238 | A(1.2) | 26 |
| Comparative Example 36 | Photosensitive Member Production Example 172 | 0.16 | 0.30 | −450 | 30 | 250 | A(1.1) | 25 |
| Comparative Example 37 | Photosensitive Member Production Example 173 | 0.14 | 0.25 | −450 | 30 | 233 | A(1.3) | 26 |
| Comparative Example 38 | Photosensitive Member Production Example 174 | 0.13 | 0.24 | −450 | 30 | 224 | A(1.2) | 26 |
| Comparative Example 39 | Photosensitive Member Production Example 175 | 0.13 | 0.26 | −450 | 30 | 226 | A(1.3) | 25 |
| Comparative Example 40 | Photosensitive Member Production Example 176 | 0.13 | 0.25 | −450 | 30 | 237 | A(1.2) | 26 |
| Comparative Example 41 | Photosensitive Member Production Example 177 | 0.09 | 0.15 | −450 | 30 | 212 | A(1.2) | 26 |
| Comparative Example 42 | Photosensitive Member Production Example 178 | 0.11 | 0.19 | −450 | 30 | 221 | A(1.3) | 25 |
| Comparative Example 43 | Photosensitive Member Production Example 179 | 0.12 | 0.22 | −450 | 30 | 220 | A(1.3) | 26 |
| Comparative Example 44 | Photosensitive Member Production Example 180 | 0.07 | 0.17 | −450 | 30 | 214 | A(1.1) | 26 |
| Comparative Example 45 | Photosensitive Member Production Example 181 | 0.05 | 0.14 | −450 | 30 | 227 | A(1.4) | 25 |
| Comparative Example 46 | Photosensitive Member Production Example 182 | 0.13 | 0.25 | −450 | 30 | 246 | A(1.2) | 25 |
| Comparative Example 47 | Photosensitive Member Production Example 183 | 0.14 | 0.28 | −450 | 30 | 252 | A(1.2) | 26 |
| Comparative Example 48 | Photosensitive Member Production Example 184 | 0.07 | 0.29 | −450 | 30 | 238 | A(1.2) | 26 |

TABLE 11

$\Phi_i$ and $\Psi_i$ of Photosensitive Members and Test Results

| Comparative Example No. | Photosensitive Member Production Example No. | k = r/R | $\Phi_i \cdot \Psi_i$ | Charged potential [V] | Charge electric filed intensity [V/μm] | Latent image contrast [V] | Fogging value | Number of leakage sheets ($\times 10^3$) |
|---|---|---|---|---|---|---|---|---|
| Comparative Example 49 | Photosensitive Member Production Example 185 | 0.14 | 0.21 | −450 | 30 | 223 | C(2.0) | 25 |
| Comparative Example 50 | Photosensitive Member Production Example 186 | 0.14 | 0.22 | −450 | 30 | 238 | C(2.2) | 25 |
| Comparative Example 51 | Photosensitive Member Production Example 187 | 0.12 | 0.25 | −450 | 30 | 236 | C(2.4) | 25 |
| Comparative Example 52 | Photosensitive Member Production Example 188 | 0.13 | 0.27 | −450 | 30 | 247 | C(2.4) | 26 |
| Comparative Example 53 | Photosensitive Member Production Example 189 | 0.10 | 0.27 | −450 | 30 | 232 | C(2.2) | 26 |
| Comparative Example 54 | Photosensitive Member Production Example 190 | 0.08 | 0.26 | −450 | 30 | 229 | C(2.2) | 25 |
| Comparative Example 55 | Photosensitive Member Production Example 191 | 0.13 | 0.25 | −450 | 30 | 230 | C(2.1) | 26 |
| Comparative Example 56 | Photosensitive Member Production Example 192 | 0.13 | 0.25 | −450 | 30 | 238 | D(2.5) | 26 |
| Comparative Example 57 | Photosensitive Member Production Example 193 | 0.12 | 0.24 | −450 | 30 | 232 | C(2.3) | 27 |
| Comparative Example 58 | Photosensitive Member Production Example 194 | 0.14 | 0.25 | −450 | 30 | 228 | C(2.4) | 27 |
| Comparative Example 59 | Photosensitive Member Production Example 195 | 0.09 | 0.28 | −450 | 30 | 231 | A(1.1) | 25 |
| Comparative Example 60 | Photosensitive Member Production Example 196 | 0.11 | 0.28 | −450 | 30 | 228 | A(1.3) | 26 |
| Comparative Example 61 | Photosensitive Member Production Example 197 | 0.13 | 0.29 | −450 | 30 | 236 | B(1.5) | 25 |
| Comparative Example 62 | Photosensitive Member Production Example 198 | 0.14 | 0.30 | −450 | 30 | 240 | A(1.2) | 26 |
| Comparative Example 63 | Photosensitive Member Production Example 199 | 0.16 | 0.30 | −450 | 30 | 240 | A(1.4) | 26 |
| Comparative Example 64 | Photosensitive Member Production Example 200 | 0.16 | 0.30 | −450 | 30 | 241 | B(1.5) | 25 |
| Comparative Example 65 | Photosensitive Member Production Example 201 | 0.16 | 0.29 | −450 | 30 | 237 | A(1.3) | 26 |
| Comparative Example 66 | Photosensitive Member Production Example 202 | 0.15 | 0.28 | −450 | 30 | 244 | A(1.3) | 25 |
| Comparative Example 67 | Photosensitive Member Production Example 203 | 0.15 | 0.29 | −450 | 30 | 236 | A(1.3) | 25 |
| Comparative Example 68 | Photosensitive Member Production Example 204 | 0.13 | 0.26 | −450 | 30 | 195 | A(1.3) | 26 |
| Comparative Example 69 | Photosensitive Member Production Example 205 | 0.49 | 0.21 | −450 | 30 | 260 | D(3.5) | 26 |
| Comparative Example 70 | Photosensitive Member Production Example 206 | 0.62 | 0.18 | −450 | 30 | 255 | D(3.8) | 26 |
| Comparative Example 71 | Photosensitive Member Production Example 207 | 0.16 | 0.28 | −450 | 30 | 234 | A(1.3) | 25 |
| Comparative Example 72 | Photosensitive Member Production Example 208 | 0.76 | 0.29 | −450 | 30 | 262 | D(3.6) | 26 |
| Comparative Example 73 | Photosensitive Member Production Example 209 | 0.69 | 0.27 | −450 | 30 | 258 | D(3.6) | 25 |
| Comparative Example 74 | Photosensitive Member Production Example 210 | 0.78 | 0.25 | −450 | 30 | 249 | E(5.2) | 26 |
| Comparative Example 75 | Photosensitive Member Production Example 211 | 0.31 | 0.25 | −450 | 30 | 265 | AA(0.9) | 26 |
| Comparative Example 76 | Photosensitive Member Production Example 212 | 0.31 | 0.05 | −450 | 30 | 87 | AA(0.9) | 26 |
| Comparative Example 77 | Photosensitive Member Production Example 213 | 0.31 | 0.06 | −450 | 30 | 90 | B(1.7) | 26 |
| Comparative Example 78 | Photosensitive Member Production Example 214 | 0.31 | 0.08 | −450 | 30 | 124 | AA(0.7) | 25 |
| Comparative Example 79 | Photosensitive Member Production Example 215 | 0.31 | 0.10 | −450 | 30 | 121 | B(1.6) | 25 |
| Comparative Example 80 | Photosensitive Member Production Example 216 | 0.31 | 0.12 | −450 | 30 | 153 | AA(0.8) | 26 |
| Comparative Example 81 | Photosensitive Member Production Example 217 | 0.31 | 0.15 | −450 | 30 | 158 | B(1.7) | 25 |

TABLE 11-continued $\Phi_i$ and $\Psi_i$ of Photosensitive Members and Test Results

| Comparative Example No. | Photosensitive Member Production Example No. | k = r/R | $\Phi_i \cdot \Psi_i$ | Charged potential [V] | Charge electric filed intensity [V/μm] | Latent image contrast [V] | Fogging value | Number of leakage sheets ($\times 10^3$) |
|---|---|---|---|---|---|---|---|---|
| Comparative Example 82 | Photosensitive Member Production Example 218 | 0.31 | 0.15 | −450 | 30 | 176 | AA(0.9) | 25 |
| Comparative Example 83 | Photosensitive Member Production Example 219 | 0.31 | 0.19 | −450 | 30 | 190 | B(1.7) | 26 |
| Comparative Example 84 | Photosensitive Member Production Example 220 | 0.31 | 0.19 | −450 | 30 | 212 | AA(0.8) | 25 |
| Comparative Example 85 | Photosensitive Member Production Example 221 | 0.31 | 0.24 | −450 | 30 | 218 | B(1.8) | 26 |
| Comparative Example 86 | Photosensitive Member Production Example 222 | 0.31 | 0.28 | −450 | 30 | 265 | AA(0.9) | 26 |
| Comparative Example 87 | Photosensitive Member Production Example 223 | 0.22 | 0.23 | −450 | 30 | 249 | AA(0.8) | 26 |
| Comparative Example 88 | Photosensitive Member Production Example 224 | 0.22 | 0.04 | −450 | 30 | 84 | AA(0.8) | 25 |
| Comparative Example 89 | Photosensitive Member Production Example 225 | 0.22 | 0.06 | −450 | 30 | 84 | B(1.8) | 26 |
| Comparative Example 90 | Photosensitive Member Production Example 226 | 0.22 | 0.08 | −450 | 30 | 120 | AA(0.7) | 25 |
| Comparative Example 91 | Photosensitive Member Production Example 227 | 0.22 | 0.10 | −450 | 30 | 125 | B(1.6) | 26 |
| Comparative Example 92 | Photosensitive Member Production Example 228 | 0.22 | 0.12 | −450 | 30 | 154 | AA(0.7) | 26 |
| Comparative Example 93 | Photosensitive Member Production Example 229 | 0.22 | 0.15 | −450 | 30 | 160 | B(1.8) | 26 |
| Comparative Example 94 | Photosensitive Member Production Example 230 | 0.22 | 0.14 | −450 | 30 | 177 | AA(0.8) | 26 |
| Comparative Example 95 | Photosensitive Member Production Example 231 | 0.22 | 0.18 | −450 | 30 | 182 | B(1.7) | 25 |
| Comparative Example 96 | Photosensitive Member Production Example 232 | 0.22 | 0.18 | −450 | 30 | 215 | AA(0.8) | 26 |
| Comparative Example 97 | Photosensitive Member Production Example 233 | 0.22 | 0.23 | −450 | 30 | 218 | B(1.7) | 26 |
| Comparative Example 98 | Photosensitive Member Production Example 234 | 0.22 | 0.27 | −450 | 30 | 270 | AA(0.7) | 25 |

TABLE 12

$\Phi_i$ and $\Psi_i$ of Photosensitive Members and Test Results

| Comparative Example No. | Photosensitive Member Production Example No. | k = r/R | $\Phi_i \cdot \Psi_i$ | Charged potential [V] | Charge electric filed intensity [V/μm] | Latent image contrast [V] | Fogging value | Number of leakage sheets ($\times 10^3$) |
|---|---|---|---|---|---|---|---|---|
| Comparative Example 99 | Photosensitive Member Production Example 235 | 0.28 | 0.21 | −450 | 30 | 245 | A(1.2) | 25 |
| Comparative Example 100 | Photosensitive Member Production Example 236 | 0.28 | 0.27 | −450 | 30 | 272 | B(1.5) | 25 |
| Comparative Example 101 | Photosensitive Member Production Example 237 | 0.28 | 0.30 | −450 | 30 | 280 | A(1.2) | 26 |
| Comparative Example 102 | Photosensitive Member Production Example 238 | 0.28 | 0.06 | −450 | 30 | 87 | C(2.4) | 25 |
| Comparative Example 103 | Photosensitive Member Production Example 239 | 0.28 | 0.06 | −450 | 30 | 84 | D(2.5) | 26 |
| Comparative Example 104 | Photosensitive Member Production Example 240 | 0.28 | 0.09 | −450 | 30 | 123 | C(2.1) | 25 |
| Comparative Example 105 | Photosensitive Member Production Example 241 | 0.28 | 0.10 | −450 | 30 | 125 | C(2.1) | 25 |
| Comparative Example 106 | Photosensitive Member Production Example 242 | 0.28 | 0.13 | −450 | 30 | 155 | C(2.0) | 27 |
| Comparative Example 107 | Photosensitive Member Production Example 243 | 0.28 | 0.14 | −450 | 30 | 156 | C(2.2) | 26 |
| Comparative Example 108 | Photosensitive Member Production Example 244 | 0.28 | 0.15 | −450 | 30 | 174 | C(2.3) | 25 |
| Comparative Example 109 | Photosensitive Member Production Example 245 | 0.28 | 0.17 | −450 | 30 | 182 | D(2.5) | 25 |
| Comparative Example 110 | Photosensitive Member Production Example 246 | 0.28 | 0.19 | −450 | 30 | 198 | C(2.0) | 26 |
| Comparative Example 111 | Photosensitive Member Production Example 247 | 0.28 | 0.21 | −450 | 30 | 220 | C(2.3) | 26 |
| Comparative Example 112 | Photosensitive Member Production Example 248 | 0.28 | 0.27 | −450 | 30 | 271 | C(2.2) | 26 |
| Comparative Example 113 | Photosensitive Member Production Example 249 | 0.28 | 0.30 | −450 | 30 | 268 | C(2.4) | 27 |
| Comparative Example 114 | Photosensitive Member Production Example 250 | 0.25 | 0.19 | −450 | 30 | 243 | A(1.3) | 26 |
| Comparative Example 115 | Photosensitive Member Production Example 251 | 0.25 | 0.25 | −450 | 30 | 254 | A(1.4) | 26 |
| Comparative Example 116 | Photosensitive Member Production Example 252 | 0.25 | 0.28 | −450 | 30 | 255 | B(1.5) | 26 |
| Comparative Example 117 | Photosensitive Member Production Example 253 | 0.25 | 0.09 | −450 | 30 | 86 | C(2.1) | 26 |
| Comparative Example 118 | Photosensitive Member Production Example 254 | 0.25 | 0.10 | −450 | 30 | 87 | C(2.1) | 25 |
| Comparative Example 119 | Photosensitive Member Production Example 255 | 0.25 | 0.13 | −450 | 30 | 120 | C(2.3) | 26 |
| Comparative Example 120 | Photosensitive Member Production Example 256 | 0.25 | 0.14 | −450 | 30 | 120 | C(2.2) | 25 |
| Comparative Example 121 | Photosensitive Member Production Example 257 | 0.25 | 0.15 | −450 | 30 | 151 | C(2.4) | 27 |
| Comparative Example 122 | Photosensitive Member Production Example 258 | 0.25 | 0.17 | −450 | 30 | 156 | C(2.3) | 25 |
| Comparative Example 123 | Photosensitive Member Production Example 259 | 0.25 | 0.17 | −450 | 30 | 173 | C(2.4) | 26 |
| Comparative Example 124 | Photosensitive Member Production Example 260 | 0.25 | 0.19 | −450 | 30 | 187 | C(2.3) | 26 |
| Comparative Example 125 | Photosensitive Member Production Example 261 | 0.25 | 0.20 | −450 | 30 | 208 | C(2.2) | 26 |
| Comparative Example 126 | Photosensitive Member Production Example 262 | 0.25 | 0.22 | −450 | 30 | 220 | C(2.2) | 26 |
| Comparative Example 127 | Photosensitive Member Production Example 263 | 0.25 | 0.25 | −450 | 30 | 250 | C(2.3) | 26 |
| Comparative Example 128 | Photosensitive Member Production Example 264 | 0.25 | 0.28 | −450 | 30 | 279 | C(2.2) | 26 |
| Comparative Example 129 | Photosensitive Member Production Example 265 | 0.25 | 0.30 | −450 | 30 | 262 | C(2.1) | 26 |
| Comparative Example 130 | Photosensitive Member Production Example 266 | 0.24 | 0.26 | −450 | 30 | 265 | AA(0.8) | 25 |
| Comparative Example 131 | Photosensitive Member Production Example 267 | 0.24 | 0.06 | −450 | 30 | 85 | AA(0.8) | 27 |
| Comparative Example 132 | Photosensitive Member Production Example 268 | 0.24 | 0.08 | −450 | 30 | 84 | B(1.8) | 25 |
| Comparative Example 133 | Photosensitive Member Production Example 269 | 0.24 | 0.10 | −450 | 30 | 118 | AA(0.9) | 26 |
| Comparative Example 134 | Photosensitive Member Production Example 270 | 0.24 | 0.12 | −450 | 30 | 129 | B(1.7) | 27 |
| Comparative Example 135 | Photosensitive Member Production Example 271 | 0.24 | 0.14 | −450 | 30 | 157 | AA(0.7) | 26 |
| Comparative Example 136 | Photosensitive Member Production Example 272 | 0.24 | 0.17 | −450 | 30 | 153 | B(1.9) | 25 |
| Comparative Example 137 | Photosensitive Member Production Example 273 | 0.24 | 0.17 | −450 | 30 | 182 | AA(0.8) | 26 |
| Comparative Example 138 | Photosensitive Member Production Example 274 | 0.24 | 0.21 | −450 | 30 | 191 | B(1.6) | 25 |

TABLE 12-continued $\Phi_i$ and $\Psi_i$ of Photosensitive Members and Test Results

| Comparative Example No. | Photosensitive Member Production Example No. | k = r/R | $\Phi_i \cdot \Psi_i$ | Charged potential [V] | Charge electric filed intensity [V/μm] | Latent image contrast [V] | Fogging value | Number of leakage sheets ($\times 10^3$) |
|---|---|---|---|---|---|---|---|---|
| Comparative Example 139 | Photosensitive Member Production Example 275 | 0.24 | 0.21 | −450 | 30 | 206 | AA(0.8) | 25 |
| Comparative Example 140 | Photosensitive Member Production Example 276 | 0.24 | 0.26 | −450 | 30 | 218 | B(1.8) | 27 |

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-089521 filed Apr. 28, 2017, which is hereby incorporated by reference herein in its entirety.

What is claimed is:

1. An electrophotographic photosensitive member comprising in this order:

a support member;

a charge generating layer having a thickness of less than 200 nm and containing a phthalocyanine pigment as a charge generating material; and a charge transport layer containing a charge transporting material, wherein the phthalocyanine pigment includes phthalocyanine crystalline particles having a particle size distribution and satisfies a requirement that the volume average of the products of Φi represented by equation (E1) and Ψi represented by equation (E2) is 0.31 or more:

$$\Phi_i = 1 - \frac{0.425}{kR_i}\sum_{n=1}^{\infty}\left[1 - \frac{\Gamma(n, kR_i/0.425)}{\Gamma(n)}\right]\left[1 - \frac{\Gamma(n, 15.7/(kR_i))}{\Gamma(n)}\right] \quad \text{(E1)}$$

$$\Psi_i = \begin{cases} 1 - 10^{-\alpha d} & (Pd/R_i > 1) \\ (Pd/R_i)(1 - 10^{-\alpha R_i/P}) & (Pd/R_i \leq 1) \end{cases} \quad \text{(E2)}$$

wherein k is a parameter representing the ratio r/R of the crystallite correlation length r of the phthalocyanine pigment to the volume average diameter R of the crystalline particles in the particle size distribution of the phthalocyanine pigment, and Ri represents the respective diameters of the crystalline particles in the particle size distribution, and wherein α represents the absorption coefficient of the charge generating layer, d represents the thickness of the charge generating layer, and P represents the ratio of the volume of the charge generating material to the total volume of the charge generating layer.

2. The electrophotographic photosensitive member according to claim 1, wherein the phthalocyanine pigment is a hydroxygallium phthalocyanine pigment having crystallites exhibiting peaks at Bragg angles 2θ of 7.4°±0.3° and 28.2°±0.3° in the CuKα X-ray diffraction spectrum thereof.

3. The electrophotographic photosensitive member according to claim 1, wherein the parameter k is in the range of 0.17 to 0.42.

4. The electrophotographic photosensitive member according to claim 1, wherein the volume ratio P is in the range of 0.42 to 0.72.

5. The electrophotographic photosensitive member according to claim 1, wherein the volume ratio P is in the range of 0.42 to 0.72, and wherein the thickness of the charge generating layer is 100 nm or more and less than 200 nm.

6. A process cartridge capable of being removably attached to an electrophotographic apparatus, the process cartridge comprising:

an electrophotographic photosensitive member; and at least one device selected from the group consisting of a charging device, a developing device, and a cleaning device, the at least one device being held together with the electrophotographic photosensitive member in one body, wherein the electrophotographic photosensitive member includes a support member, a charge generating layer having a thickness of less than 200 nm and containing a phthalocyanine pigment as a charge generating material, and a charge transport layer containing a charge transporting material in this order, wherein the phthalocyanine pigment includes phthalocyanine crystalline particles having a particle size distribution and satisfies a requirement that the volume average of the products of Φi represented by equation (E1) and Ψi represented by equation (E2) is 0.31 or more:

$$\Phi_i = 1 - \frac{0.425}{kR_i}\sum_{n=1}^{\infty}\left[1 - \frac{\Gamma(n, kR_i/0.425)}{\Gamma(n)}\right]\left[1 - \frac{\Gamma(n, 15.7/(kR_i))}{\Gamma(n)}\right] \quad \text{(E1)}$$

$$\Psi_i = \begin{cases} 1 - 10^{-\alpha d} & (Pd/R_i > 1) \\ (Pd/R_i)(1 - 10^{-\alpha R_i/P}) & (Pd/R_i \leq 1) \end{cases} \quad \text{(E2)}$$

wherein k is a parameter representing the ratio r/R of the crystallite correlation length r of the phthalocyanine pigment to the volume average diameter R of the crystalline particles in the particle size distribution of the phthalocyanine pigment, and Ri represents the respective diameters of the crystalline particles in the particle size distribution, and wherein α represents the absorption coefficient of the charge generating layer, d represents the thickness of the charge generating layer, and P represents the ratio of the volume of the charge generating material to the total volume of the charge generating layer.

7. An electrophotographic apparatus comprising:

an electrophotographic photosensitive member;

a charging device;

an exposure device;

a developing device; and a transfer device, wherein the electrophotographic photosensitive member includes a support member, a charge generating layer having a thickness of less than 200 nm and containing a phthalocyanine pigment as a charge generating material, and a charge transport layer containing a charge transporting material in this order, wherein the phthalocyanine pigment includes phthalocyanine crystalline particles having a particle size distribution and satisfies a requirement that the volume average of the products of Φi represented by equation (E1) andΨi represented by equation (E2) is 0.31 or more:

$$\Phi_i = 1 - \frac{0.425}{kR_i}\sum_{n=1}^{\infty}\left[1 - \frac{\Gamma(n, kR_i/0.425)}{\Gamma(n)}\right]\left[1 - \frac{\Gamma(n, 15.7/(kR_i))}{\Gamma(n)}\right] \quad \text{(E1)}$$

-continued $$\Psi_i = \begin{cases} 1 - 10^{-\alpha d} & (Pd/R_i > 1) \\ (Pd/R_i)(1 - 10^{-\alpha R_i/P}) & (Pd/R_i \leq 1) \end{cases} \quad \text{(E2)}$$

wherein k is a parameter representing the ratio r/R of the crystallite correlation length r of the phthalocyanine pigment to the volume average diameter R of the crystalline particles in the particle size distribution of the phthalocyanine pigment, and Ri represents the respective diameters of the crystalline particles in the particle size distribution, and wherein α represents the absorption coefficient of the charge generating layer, d represents the thickness of the charge generating layer, and P represents the ratio of the volume of the charge generating material to the total volume of the charge generating layer.

* * * * *